US011372362B2

(12) United States Patent
Ikegami et al.

(10) Patent No.: US 11,372,362 B2
(45) Date of Patent: Jun. 28, 2022

(54) IMAGE FORMING APPARATUS INCLUDING CAM HAVING COMPACT STRUCTURE CAPABLE OF DETECTION OF CONTACT STATE AND SEPARATED STATE OF DEVELOPING ROLLER RELATIVE TO PHOTOSENSITIVE DRUM

(71) Applicant: BROTHER KOGYO KABUSHIKI KAISHA, Nagoya (JP)

(72) Inventors: Yusuke Ikegami, Nagoya (JP); Masahito Saeki, Nagoya (JP); Toshiyuki Sano, Iwakura (JP); Shintaro Sakaguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/122,548

(22) Filed: Dec. 15, 2020

(65) Prior Publication Data

US 2021/0200135 A1 Jul. 1, 2021

(30) Foreign Application Priority Data

Dec. 25, 2019 (JP) ..... JP2019-234139

(51) Int. Cl.
*G03G 15/00* (2006.01)
*G03G 15/34* (2006.01)
(Continued)

(52) U.S. Cl.
CPC ..... *G03G 15/757* (2013.01); *G03G 15/0808* (2013.01); *G03G 15/346* (2013.01);
(Continued)

(58) Field of Classification Search
CPC ..... G03G 15/757; G03G 15/0808; G03G 15/346; G03G 21/1647; G03G 21/1857; G03G 2221/1657; G03G 2221/1684
See application file for complete search history.

(56) References Cited

U.S. PATENT DOCUMENTS 7,684,734 B2 * 3/2010 Sato ..... G03G 15/757 399/167
2010/0232815 A1 * 9/2010 Zheng ..... G03G 15/0858 399/27
(Continued)

FOREIGN PATENT DOCUMENTS

JP 61-287331 A 12/1986
JP 9-081858 A 3/1997
(Continued)

*Primary Examiner* — Ryan D Walsh
(74) *Attorney, Agent, or Firm* — Merchant & Gould P.C.

(57) ABSTRACT

An image forming apparatus includes a developing roller, a photo-interrupter, and a separation mechanism. The developing roller is movable between a contact position and a separated position. The photo-interrupter includes a light emitting element and a light receiving element. The separation mechanism includes a cam configured to move the developing roller between the contact position and the separated position. The cam includes a phase detection wall extending in a circumference direction. The phase detection wall has a first slit and a second slit. The first slit allows the light emitted from the light emitting element to pass therethrough when the developing roller is at the separated position. The second slit allows the light emitted from the light emitting element to pass therethrough when the developing roller is at the contact position. A size of the first slit in the circumferential direction is different from that of the second slit.

22 Claims, 25 Drawing Sheets

(51) Int. Cl.
*G03G 15/08* (2006.01)
*G03G 21/16* (2006.01)
*G03G 21/18* (2006.01)

(52) U.S. Cl.
CPC ..... *G03G 21/1647* (2013.01); *G03G 21/1857* (2013.01); *G03G 2221/1657* (2013.01); *G03G 2221/1684* (2013.01)

(56) References Cited

U.S. PATENT DOCUMENTS

2011/0058839 A1 3/2011 Tsukioka
2011/0293336 A1* 12/2011 Noso ..... G03G 21/1647 399/302
2012/0045248 A1* 2/2012 Suto ..... G03G 15/757 399/167
2012/0243908 A1* 9/2012 Aratachi ..... G03G 15/0806 399/167
2013/0064584 A1* 3/2013 Yonemoto ..... G03G 15/2032 399/328
2014/0169833 A1* 6/2014 Kawamura ..... G03G 21/1825 399/222
2017/0261918 A1* 9/2017 Zensai ..... G03G 21/1825
2018/0080505 A1 3/2018 Hashimoto
2018/0284657 A1 10/2018 Tokoro et al.
2020/0409290 A1* 12/2020 Saeki ..... G03G 15/0896
2021/0011427 A1* 1/2021 Saeki ..... G03G 15/0808
2021/0200140 A1* 7/2021 Sano ..... G03G 21/1633
2021/0325821 A1* 10/2021 Ikegami ..... G03G 21/1661

FOREIGN PATENT DOCUMENTS

JP 2000-242059 A 9/2000
JP 2009-204700 A 9/2009
JP 2009-282126 A 12/2009
JP 2011-53625 A 3/2011
JP 2012-128017 A 7/2012
JP 2018-047983 A 3/2018
JP 2018-173518 A 11/2018

* cited by examiner

IMAGE FORMING APPARATUS INCLUDING CAM HAVING COMPACT STRUCTURE CAPABLE OF DETECTION OF CONTACT STATE AND SEPARATED STATE OF DEVELOPING ROLLER RELATIVE TO PHOTOSENSITIVE DRUM

CROSS REFERENCE TO RELATED APPLICATION

This application claims priority from Japanese Patent Application No. 2019-234139 filed Dec. 25, 2019. The entire content of the priority application is incorporated herein by reference.

TECHNICAL FIELD

The present disclosure relates to an image forming apparatus capable of moving a developing roller between a contact position in contact with a photosensitive drum and a separated position away therefrom.

BACKGROUND

There has been known an electro-photographic type image forming apparatus capable of permitting the developing roller to be separated from the photosensitive drum at a proper timing in order to reduce dissipation of the developing roller.

Japanese Patent Application Publication No. 2012-128017 discloses an image forming apparatus in which cams are provided in one-to-one correspondence to developing rollers each associated with each color different from one another. Rotation of each cam permits each developing roller to contact with and to be separated from a corresponding photosensitive drum. The cam having a disc shape has a gear provided with a plate cam portion configured to move the developing roller between a contact position where the developing roller contacts the photosensitive drum and a separated position where the developing roller is separated from the photosensitive drum. Further, a rib-like flag is provided at the cam for detecting rotational phase indicative of a home position of the cam. The developing roller is separated from the photosensitive drum when a phase detection sensor detects the flag.

Japanese Patent Application Publication No. 2009-282126 discloses an image forming apparatus including a cam configured to permit the developing roller to contact with and to be separated from the photosensitive drum. The cam has a disc shape and has one surface provided with a plate cam portion and has another surface provided with a circular wall protruding therefrom. The circular wall has a plurality of slits for detection of rotational phase of the cam.

SUMMARY

According to the cam described in the Japanese Patent Application Publication No. 2012-128017, there is only one flag for the detection of the rotational phase of the cam when the developing roller is at the separated state. In this connection, accuracy as to rotational phase of the cam may be insufficient in order to stop rotation of the cam when the developing roller is in contact with the photosensitive drum.

On the other hand, according to the cam described in the Japanese Patent Application Publication No. 2009-282126, both the contacting state and the separated state of the developing roller relative to the photosensitive drum can be detected. However, because the plate cam portion is provided at one surface of the cam and the phase detection wall is provided at the opposite surface of the cam, dimension in an axial direction of the cam is inevitably increased in order to ensure sufficient functions of the plate cam portion and the phase detection wall. Hence, a resultant image forming apparatus becomes bulky.

In view of the foregoing, it is an object of the disclosure to provide a compact image forming apparatus including a compact cam structure capable of detecting both the contacting state and the separated state of the developing roller relative to the photosensitive drum.

In order to attain the above and other objects, according to one aspect, the disclosure provides an image forming apparatus including a photosensitive drum, a developing roller, a photo-interrupter, and a separation mechanism. The developing roller is movable between a contact position where the developing roller is in contact with the photosensitive drum and a separated position where the developing roller is separated from the photosensitive drum. The photo-interrupter includes a light emitting element and a light receiving element. The separation mechanism includes a cam. The cam is configured to move the developing roller between the contact position and the separated position. The cam is rotatable about a rotation axis extending in an axial direction. The cam includes a phase detection wall extending in a circumference direction around the rotating axis. The phase detection wall has a first slit and a second slit positioned away from the first slit in the circumferential direction. The first slit allows the light emitted from the light emitting element to pass therethrough when the developing roller is at the separated position. The second slit allows the light emitted from the light emitting element to pass therethrough when the developing roller is at the contact position. A size of the first slit in the circumferential direction is different from that of the second slit.

According to another aspect of the disclosure, there is provided an image forming apparatus including a photosensitive drum, a developing roller, a clutch, separation mechanism and a detector. The developing roller is movable between a contact position where the developing roller is in contact with the photosensitive drum and a separated position where the developing roller is separated from the photosensitive drum. The clutch is configured to control rotation the developing roller. The separation mechanism is configured to move the developing roller between the contact position and the separated position. The separation mechanism includes a cam rotatable about a rotation axis extending in an axial direction. The cam includes a gear, an end cam, a phase detection wall, and a plate cam. The gear has an outer peripheral surface provided with gear teeth, a first surface and a second surface opposite to the first surface in an axial direction of the disc portion. The end cam is disposed at the first surface of the gear in the axial direction. The end cam is configured to move the developing roller between the contact position and the separate position. The phase detection wall is disposed at the first surface of the gear and having a hollow cylindrical shape. The phase detection wall has a first slit and a second slit. The first slit and the second slit has a size in the circumferential direction different from each other. The plate cam is disposed at the second surface of the gear. The plate cam is configured to operate the clutch. The detector is configured to detect a slit on the phase detection wall. When the cam positions the developing roller at the separated position, the detector detects the first slit. When the cam positions the developing roller at the contact position, the detector detects the second slit.

BRIEF DESCRIPTION OF THE DRAWINGS

The particular features and advantages of the embodiment(s) as well as other objects will become apparent from the following description taken in connection with the accompanying drawings, in which:

FIG. 13 is a flowchart illustrating steps in a control process executed by a controller of the image forming apparatus according to the embodiment, the control process being executed when the image forming apparatus is turned on;

DETAILED DESCRIPTION

Figure 1:
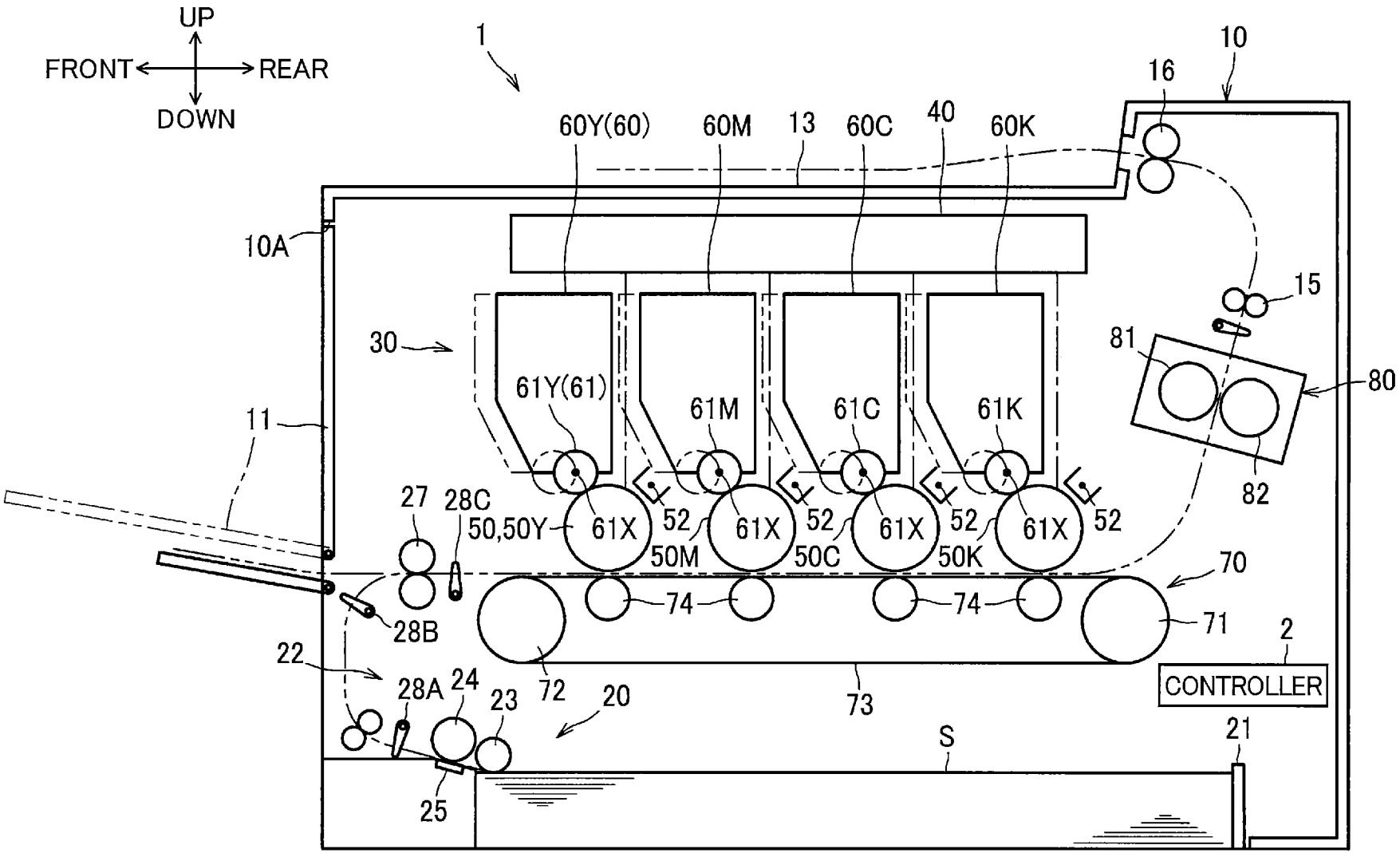
FIG. 1 is a schematic view illustrating an overall configuration of an image forming apparatus according to one embodiment.

An image forming apparatus 1 according to one embodiment of the present disclosure will be described with reference to FIGS. 1 through 25. A color printer is exemplified as the image forming apparatus 1 including a housing 10, a cover 11, a sheet feed unit 20, an image forming unit 30, and a controller 2.

In the following description, a left side, a right side, an upper side, and a lower side in FIG. 1 will be referred to as a front side, a rear side, an upper side, and a lower side of the image forming apparatus 1, respectively. Further, a near side and a far side in FIG. 1 will be referred to as a right side and a left side, respectively.

The housing 10 has a front end having a first opening 10A. The cover 11 is pivotally movable between a closed position closing the first opening 10A as indicated by a solid line and an open position opening the first opening 10A as indicated by a dashed-two dotted line. The housing 10 is provided with a cover sensor (not illustrated) configured to detect an opening state and a closing state of the cover 11, and the controller 2 is configured to determine the opening state and the closing state of the cover 11 according to a signal transmitted from the cover sensor. The housing 10 has a discharge tray 13 at an upper surface.

The sheet feed unit 20 is positioned at a lower internal portion of the housing 10. The sheet feed unit 20 includes a sheet tray 21 for accommodating sheets S, and a sheet feed mechanism 22 configured to supply sheets S from the sheet tray 21 toward the image forming unit 30. The sheet tray 21 is detachable from the housing 10 by pulling the sheet tray 21 frontward (leftward in FIG. 1).

The sheet feed mechanism 22 is positioned at a front internal portion of the housing 10. The sheet feed mechanism 22 includes a sheet feed roller 23, a separation roller 24, a separation pad 25, and a pair of registration rollers 27. In the present disclosure, the sheet S is as an example of an image forming medium on which an image can be formed by the image forming apparatus 1. For example, plain paper, an envelope, post card, thin paper, thick paper, glossy paper, resin sheet, and a seal are available as the sheet S.

In the sheet feed unit 20, the sheets S accommodated in the sheet tray 21 are configured to be fed by the sheet feed roller 23, and then separated one by one by the separation roller 24 and the separation pad 25. Subsequently, a position of the leading edge of each sheet S is configured to be regulated by the registration rollers 27 whose rotation is halted, and the sheet S is then configured to be supplied to the image forming unit 30 by the rotations of the registration rollers 27.

The sheet feed unit 20 includes a sheet supply sensor 28A, a pre-registration sensor 28B, and a post-registration sensor 28C. The sheet supply sensor 28A is positioned at a downstream side of the sheet feed roller 23 and the separation roller 24 in a sheet conveying direction. The pre-registration sensor 28B is positioned at an upstream side of the registration rollers 27 in the sheet conveying direction. The post-registration sensor 28C is positioned at a downstream side of the registration rollers 27.

The image forming unit 30 includes an exposure device 40, a drawer 90 (FIG. 2) including a plurality of photosensitive drums 50, a plurality of developing cartridges 60, a conveying device 70, and a fixing device 80.

The exposure device 40 includes a laser diode, a deflector, lenses, and mirrors those are not illustrated. The exposure device 40 is configured to emit a plurality of laser beams that expose respective photosensitive drums 50 to scan the surfaces of the drums.

The photosensitive drums 50 include: a first photosensitive drum 50Y for a color of yellow; a second photosensitive drum 50M for a color of magenta; a third photosensitive drum 50C for a color of cyan; and a fourth photosensitive drum 50K for a color of black. Throughout the specification and drawings, in a case where colors must be specified, members or components corresponding to the colors of yellow, magenta, cyan and black are designated by adding "Y", "M", "C", and "K", respectively. On the other hand, in a case where distinction of colors is unnecessary, the addition of "Y", "M", "C", and "K" is omitted and naming of "first" through "fourth" is also omitted.

Four developing cartridges 60 are provided in one-to-one correspondence with the four photosensitive drums 50. Specifically, the developing cartridges 60 include: a first developing cartridge 60Y including a first developing roller 61Y for supplying toner to the first photosensitive drum 50Y; a second developing cartridge 60M including a second developing roller 61M for supplying toner to the second photosensitive drum 50M; a third developing cartridge 60C including a third developing roller 61C for supplying toner to the third photosensitive drum 50C; and a fourth developing cartridge 60K including a fourth developing roller 61K for supplying toner to the fourth photosensitive drum 50K.

The first developing roller 61Y, the second developing roller 61M, the third developing roller 61C, and the fourth developing roller 61K are arranged in line in this order toward downstream in the sheet conveying direction.

Each of the developing cartridges 60 is movable between a contact position where the developing roller 61 is in contact with a corresponding one of the photosensitive drums 50 (indicated by a solid line in FIG. 1) and a separated position where the developing roller 61 is apart from the corresponding one of the photosensitive drums 50 (indicated by dashed-two dotted line in FIG. 1).

Figure 2:
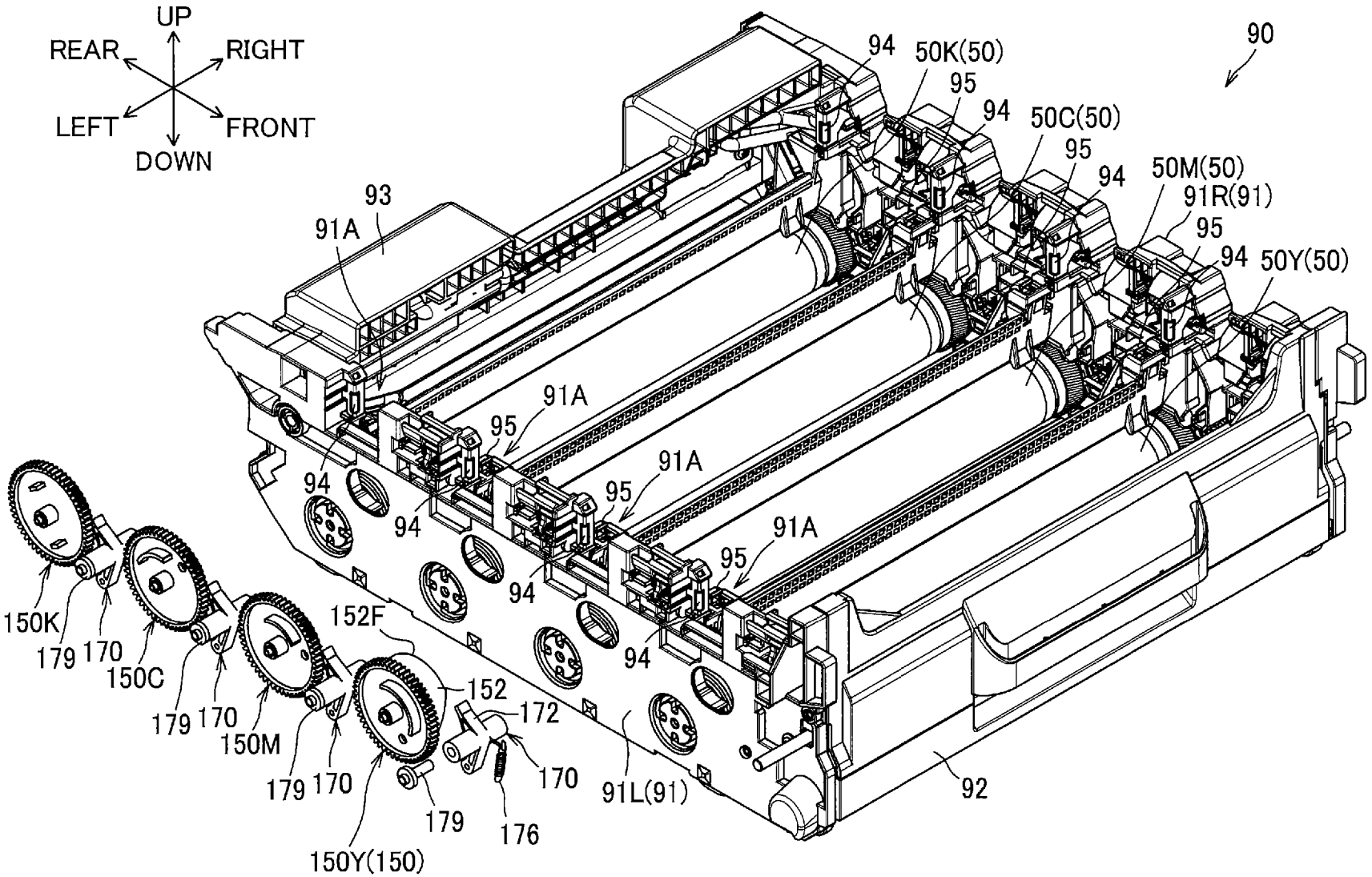
FIG. 2 is a perspective view of a drawer, cams, and cam followers in the image forming apparatus according to the embodiment.

As illustrated in FIG. 2, the photosensitive drums 50 are rotatably supported by the drawer 90. Further, the drawer 90 detachably supports the first developing cartridge 60Y, the second developing cartridge 60M, the third developing cartridge 60C, and the fourth developing cartridge 60K. The drawer 90 is attachable to and detachable from the housing 10 through the first opening 10A when the cover 11 is opened (FIG. 1).

The drawer 90 includes: a pair of side frames 91 positioned away from each other in an axial direction of each of the photosensitive drums 50; a front connection frame 92 connecting front end portions of respective side frames 91 to each other, and a rear connection frame 93 connecting rear end portions of respective side frames 91 to each other. The pair of side frames 91 includes a right side frame 91R positioned at the right side and a left side frame 91L positioned at the left side. Further, chargers 52 (FIG. 1) are provided in the drawer 90. Each of the chargers 52 is positioned in face a corresponding one of the photosensitive drums 50 for charging the same.

Although detailed illustration of the structure is omitted, the right and left side frames 91 respectively support right and left end portions of each of the photosensitive drums 50. Further, one of the side frames 91, i.e., the left side frame 91L has four second openings 91A. Each of the second openings 91A is in a form of a recess recessed downward from an upper end of the left side frame 91L. Each of the second openings 91A extends throughout a thickness of the left side frame 91L in a leftward/rightward direction. Thus, each of the second openings 91A is configured to allow a corresponding one of cam followers 170 (described later) to be positioned therein.

The image forming apparatus 1 further includes four separation mechanisms. Each of the separation mechanism is configured to move a corresponding one of the first developing roller 61Y, the second developing roller 61M, the third developing roller 61C, and the fourth developing roller 61K between a contact position in contact with a corresponding one of the photosensitive drums 50 and a separated position separated away from the corresponding one of the photosensitive drums 50. Each of the separation mechanisms is provided for a corresponding one of a first color, a second color, a third color, and a fourth color (yellow, magenta, cyan, and black).

Figure 7:
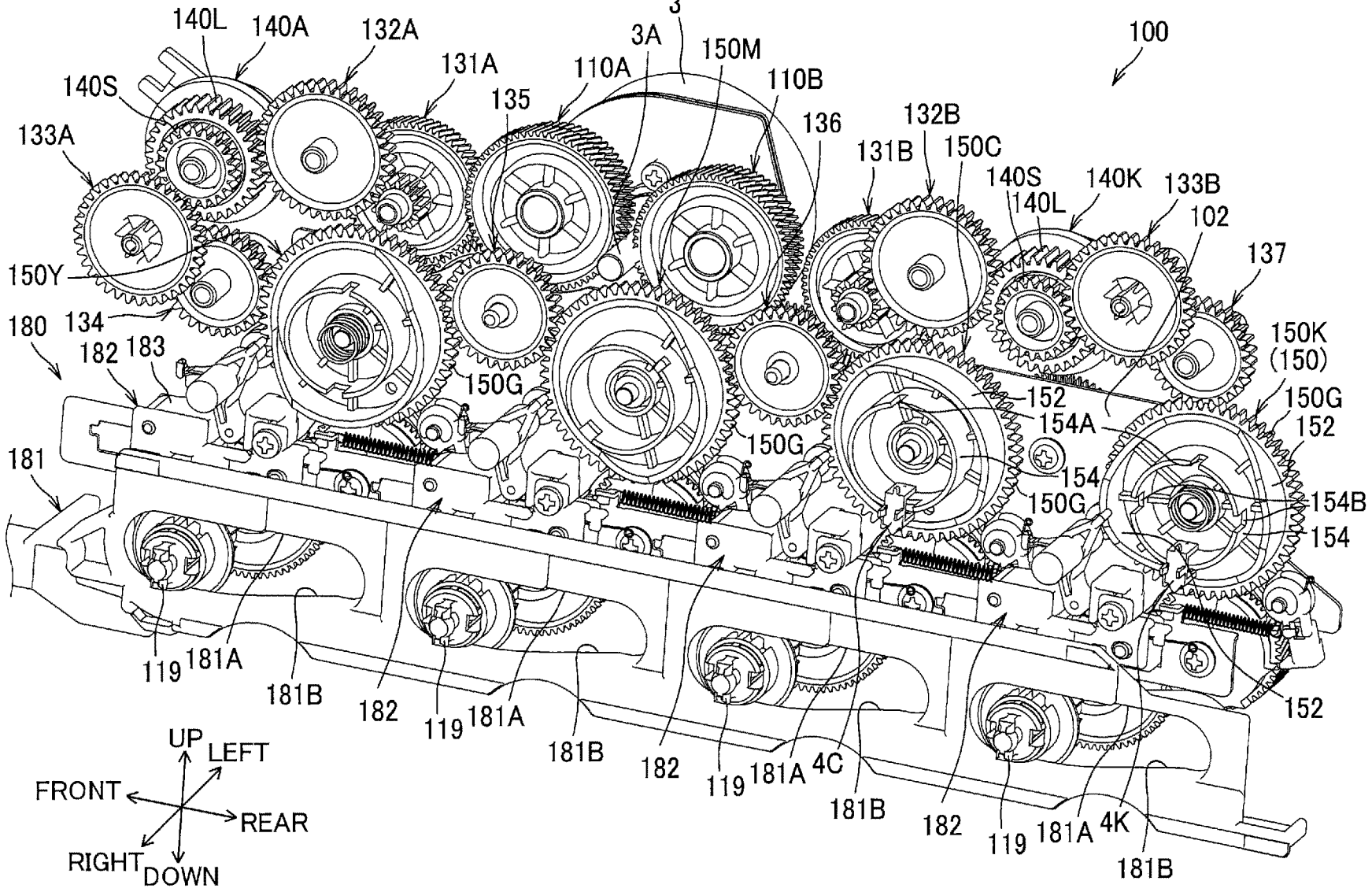
FIG. 7 is a perspective view of the power transmission mechanism as viewed from an upper right side thereof.

Specifically, each of the separation mechanisms includes: a cam 150 (150Y, 150M, 150C, 150K) rotatable about an axis parallel to a rotation axis 61X (FIG. 1) of a corresponding one of the developing rollers 60; a support shaft 179; a cam follower 170; a first spring 176; and a release member 180 (FIG. 7). The cam 150 includes a first cam portion 152 protruding rightward, i.e. inward in a direction of the rotation axis 61X of the corresponding one of the developing rollers 60 (hereinafter simply referred to as "axial direction"). The first cam portion 152A has an end face (right end face) serving as a portion of a cam surface 152F.

The support shaft 179 is elongated in the leftward/rightward direction. The support shaft 179 is provided at a side frame (not illustrated) of the housing 10.

The cam follower 170 is supported by the support shaft 179. The cam follower 170 is slidably movable relative to the support shaft 179 in an axial direction thereof, and is rotatable about an axis of the support shaft 179. The cam follower 170 includes a contact portion 172 contactable with the first cam portion 152.

Specifically, the cam follower 170 is movable between an operating position (illustrated in FIGS. 20A and 20B) where the contact portion 172 is capable of contacting the end face of the first cam portion 152 and a non-operating position (illustrated in FIGS. 21A and 21B) where the contact portion 172 is incapable of contacting the end face of the first cam portion 152. The cam follower 170 is not overlapped with the first cam portion 152 as viewed in the axial direction in a case where the cam follower 170 is positioned at the non-operating position.

Further, in a state where the cam follower 170 is at the operating position, the cam follower 170 is in contact with the cam surface 152F of the first cam portion 152 of the cam 150. Therefore, in the state where the cam follower 170 is at the operating position, the cam follower 170 may be guided by the cam 150 in accordance with the rotation of the cam 150 so as to be slidably movable along the support shaft 179 between a protruding position (illustrated in FIG. 4B) positioning the developing roller 61 at the separated position and a standby position (illustrated in FIG. 4A) positioning the developing roller 61 at the contact position.

In a state where the cam follower 170 is at the protruding position, the cam follower 170 is positioned in the second opening 91A to press the developing cartridge 60, so that the developing roller 61 is positioned at its separated position. In a state where the cam follower 170 is at the standby position, the cam follower 170 is positioned out of the second opening 91A, so that the developing roller 61 is positioned at its contact position.

The non-operating position of the cam follower 170 is provided by the movement of the release lever 180 in accordance with the movement of the cover 11 from the open position to the closed position. In a state where the cam follower 170 is at the non-operating position, the contact portion 172 is not guided by the first cam portion 152, so that the cam follower 170 is maintained at the standby position independently of the rotation of the cam 150.

Turning back to FIG. 2, the image forming apparatus 1 is provided four pair of cams 150 and cam followers 170, and each pair of cam 150 and cam follower 170 is provided for a corresponding one of four developing cartridges 60. Each pair of cam 150 and cam follower 170 positioned leftward of the left side frame 91L, i.e. outward of the left side frame 91L in the leftward/rightward direction. The cams 150, the cam followers 170, and the release members 180 will be described in detail later.

Counterpart abutment portions 94 are provided four each on respective upper portions of the side frames 91R and 91L of the drawer 90. The counterpart abutment portions 94 are configured to abut slide members 64 (FIG. 3A) described later. Each of the counterpart abutment portions 94 is in a form of a roller rotatable about an axis extending in an upward/downward direction. Here, the upward/downward direction may be defined as a third direction which is perpendicular to a first direction (leftward/rightward direction) in parallel to the axial direction of each of the photosensitive drums 50 and a second direction (frontward/rearward direction) in which the photosensitive drums 50 are juxtaposed.

The drawer 90 also includes a plurality of pressure members 95 two each for a corresponding one of the developing cartridges 60. For each of the developing cartridges 60, two of the pressure members 95 are positioned one each outward of a corresponding one of the photosensitive drums 50 in the axial direction thereof. Each of the pressure members 95 is urged rearward by a spring 95A (FIGS. 4A and 4B). In accordance with the attachment of the developing cartridge 60 to the drawer 90, the pair of pressure members 95 presses against the corresponding developing cartridge 60 (specifically, protrusion 63D of the developing cartridge 60 (FIGS. 3A through 4B) as will be described later) by urging forces of the respective springs 95, to permit the developing roller 61 to be in pressure contact with the corresponding photosensitive drum 50.

Figure 3A:
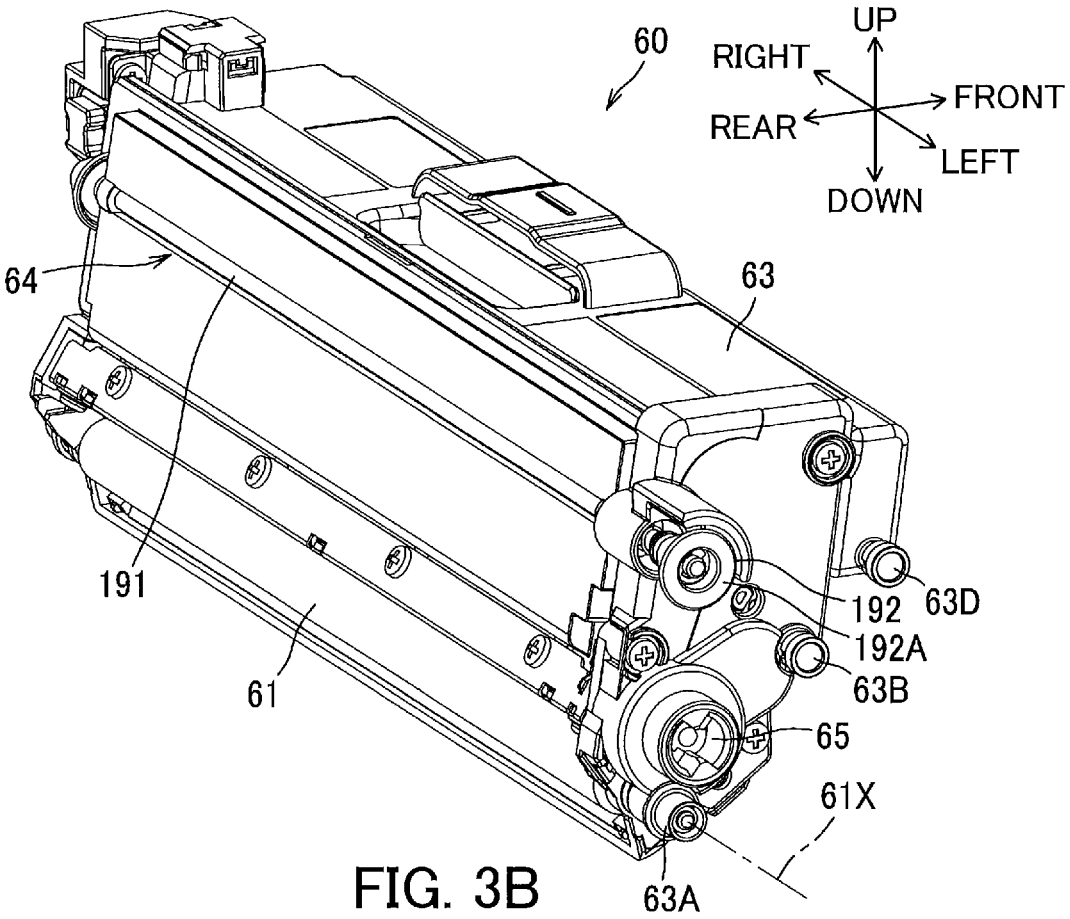
FIG. 3A is a perspective view of a developing cartridge in the image forming apparatus according to the embodiment.
Figure 3B:
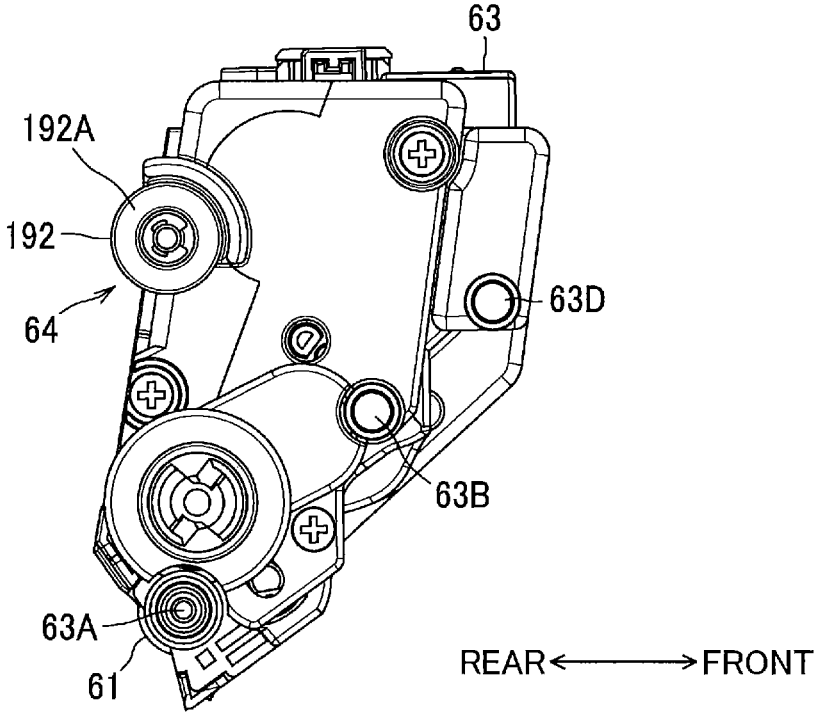
FIG. 3B is a side view of the developing cartridge.
Figure 4A:
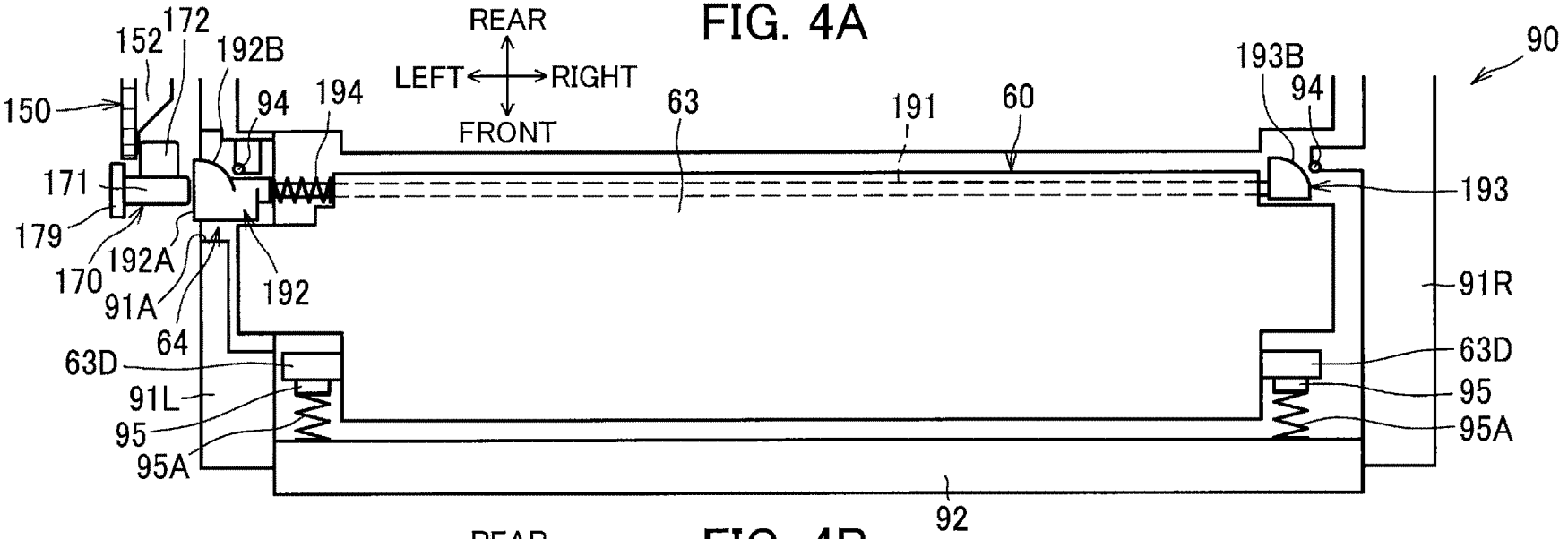
FIG. 4A is a schematic plan view illustrating the developing cartridge and components in the vicinity thereof for description of a slide member of the developing cartridge, and particularly illustrating a state where the cam follower is at a standby position in the image forming apparatus according to the embodiment.
Figure 4B:
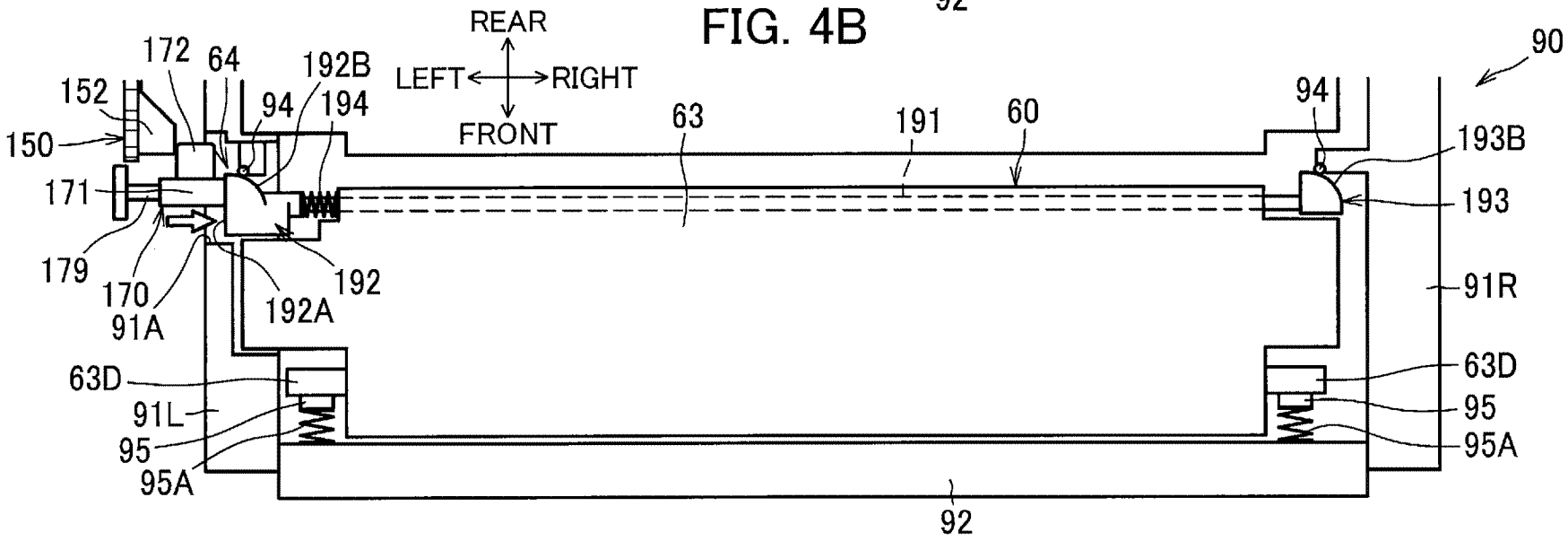
FIG. 4B is a schematic plan view illustrating the developing cartridge and the components in the vicinity thereof for description of the slide member, and particularly illustrating a state where the cam follower is at a protruding position in the image forming apparatus according to the embodiment.

As illustrated in FIGS. 3A and 3B, each of the developing cartridges 60 (60Y, 60M, 60C, 60K) includes a casing 63, the slide member 64, and a coupling 65. The casing 63 is configured to store toner of the corresponding color therein.

The casing 63 has one side surface in the axial direction (left end surface) provided with a first protruding portion 63A and a second protruding portion 63B. The first protruding portion 63A is coaxial with the rotation axis 61X of the developing roller 61. That is, the first protruding portion 63A protrudes in the axial direction. The second protruding portion 63B is positioned away from the first protruding portion 63A by a predetermined distance. In the present embodiment, the second protruding portion 63B is positioned diagonally above the first protruding portion 63A. That is, the second protruding portion 63B is positioned higher than the first protruding portion 63A.

The first and second protruding portions 63A and 63B are provided as rollers rotatable about their axes extending in parallel to the axial direction. Although not illustrated, the first and second protruding portions 63A and 63B are also provided at another side surface of the casing 63 in the axial direction (right end face) at positions symmetrical with the first and second protruding portions 63A and 63B provided at the one side surface (left end face).

Further, the above-described protrusion 63D configured to be pressed by the pressure members 95 is positioned frontward of and upward of the first and second protruding portions 63A, 63B. The protrusion 63D protrudes outward in the axial direction from each side surface of the casing 63 in the axial direction.

The coupling 65 is configured to be engaged with a coupling shaft 119 of a power transmission mechanism 100 described later. Rotational driving force is configured to be inputted to the coupling 65 from the coupling shaft 119.

The slide member 64 is slidably movable in the axial direction relative to the casing 63 upon application of the pressing force from the corresponding cam follower 170.

As illustrated in FIGS. 4A and 4B, the slide member 64 includes: a shaft 191; a first abutment member 192; and a second abutment member 193. The first abutment member 192 is fixed to one end (left end) of the shaft 191. The second abutment member 193 is fixed to another end (right end) of the shaft 191.

The casing 63 has a hole extending in the axial direction. The shaft 191 extends through the hole and is slidably supported by the casing 63.

The first abutment member 192 has a pressure receiving surface 192A and a sloped surface 192B. The pressure receiving surface 192A is a left end face of the first abutment member 192, that is, an end face thereof in the axial direction. The sloped surface 192B extends from the pressure receiving surface 192A to be sloped with respect to the axial direction. The pressure receiving surface 192A is configured to be pressed by the cam follower 170.

When the slide member 64 is pressed in the axial direction by the cam follower 170, the sloped surface 192B abuts against the corresponding counterpart abutment portion 94 of the drawer 90 to urge the developing cartridge 60 (i.e., a corresponding one of the developing cartridges 60Y, 60M, 60C, and 60K) in a direction parallel to the sheet conveying direction of the sheet S (frontward), thereby moving the developing cartridge 60 to the portion as illustrated in FIG. 4B. The sloped surface 192B is sloped in a curved fashion to extend gradually frontward toward the right. That is, the sloped surface 192B is sloped in a direction from the photosensitive drum 50 toward the corresponding developing roller 61 (frontward) as extending in a direction from the one end (left end) to the other end (right end) of the shaft 191 in the axial direction.

The second abutment member 193 has a sloped surface 193B similar to the sloped surface 192B of the first abutment member 192. When the slide member 64 is pressed in the axial direction by the corresponding cam follower 170, the second sloped surface 193B abuts against the counterpart abutment portion 94 of the drawer 90 to urge the developing cartridge 60 (i.e., a corresponding one of the developing cartridges 60Y, 60M, 60C, and 60K) in a direction parallel to the sheet conveying direction of the sheet S (frontward), thereby moving the developing cartridge 60 to the position as illustrated in FIG. 4B.

A spring 194 is interposed between the first abutment member 192 and the casing 63 to urge the slide member 64 leftward, i.e., outward in the axial direction. The spring 194 is a compression spring disposed over the shaft 191.

Figure 5:
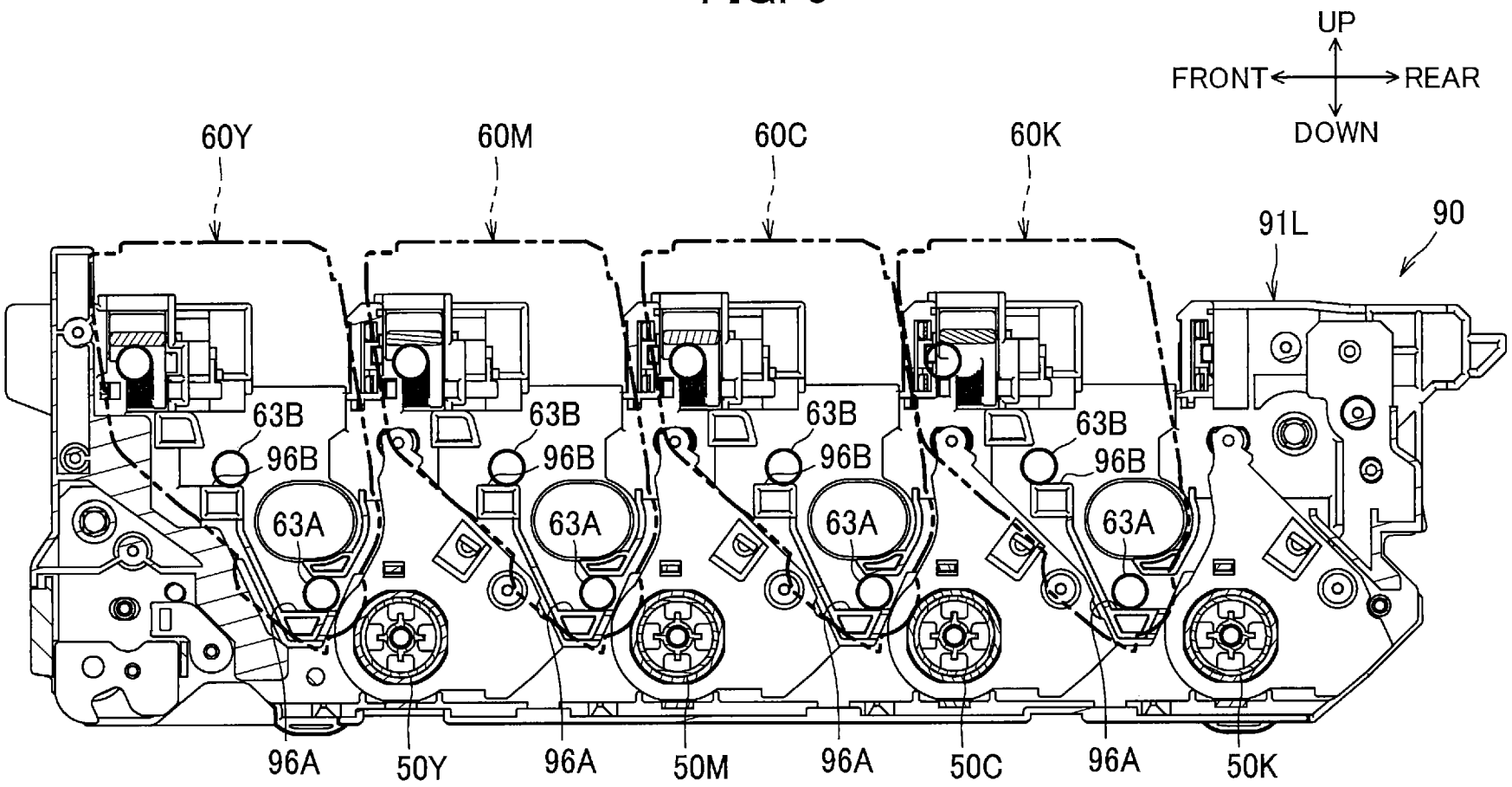
FIG. 5 is a side view of a side frame of the drawer, and particularly illustrating an inner surface side of the side frame at which the developing cartridge is positioned in the image forming apparatus according to the embodiment.

As illustrated in FIG. 5, the side frame 91L of the drawer 90 has an inner surface provided with sets of a first support surface 96A and a second support surface 96B. Each set of the first support surface 96A and the second support surface 96B supports the first protruding portion 63A and the second protruding portion 63B of the corresponding developing cartridge 60 from below when the developing roller 61 (i.e., a corresponding one of the developing rollers 61Y, 61M, 61C, and 61K) is moved from the contact position to the separated position. The first support surfaces 96A and the second support surfaces 96B extend in the sheet conveying direction of the sheet S (i.e., from the front to the rear).

The first support surfaces 96A are positioned to support the first protruding portions 63A. Each of the first support surface 96A is configured to guide a corresponding one of the developing rollers 61 and to fix a position thereof in the upward/downward direction when the corresponding developing cartridge 60 is attached to the drawer 90. Each of the second support surfaces 96B is positioned upward of a corresponding one of the first support surfaces 96A to support the second protruding portion 63B. Although not illustrated, the first and second support surfaces 96A and 96B are also provided at an inner surface of the right side frame 91R at positions symmetrical with the first and second support surfaces 96A and 96B of the left side frame 91L.

Referring to FIG. 5, when the developing roller 61 is positioned at its contact position in contact with the corresponding photosensitive drum 50, the first protruding portion 63A is positioned at a rear region of the corresponding first support surfaces 96A (see the first protruding portions 63A of the first through third developing cartridges 60Y, 60M and 60C). When the developing roller 61 is positioned at its separated position away from the corresponding photosensitive drum 50, the first protruding portion 63A is positioned at a front region of the corresponding first support surface 96A (see the first protruding portion 63A of the fourth developing cartridge 60K).

In this way, the first through fourth developing rollers 61Y, 61M, 61C, and 61K are moved frontward, i.e., in a direction opposite to the sheet conveying direction of the sheet S (toward upstream in the sheet conveying direction of the sheet S) when the separation mechanisms move the developing rollers 61Y, 61M, 61C, and 61K from the contact positions to the separated position, respectively.

Figure 18A:
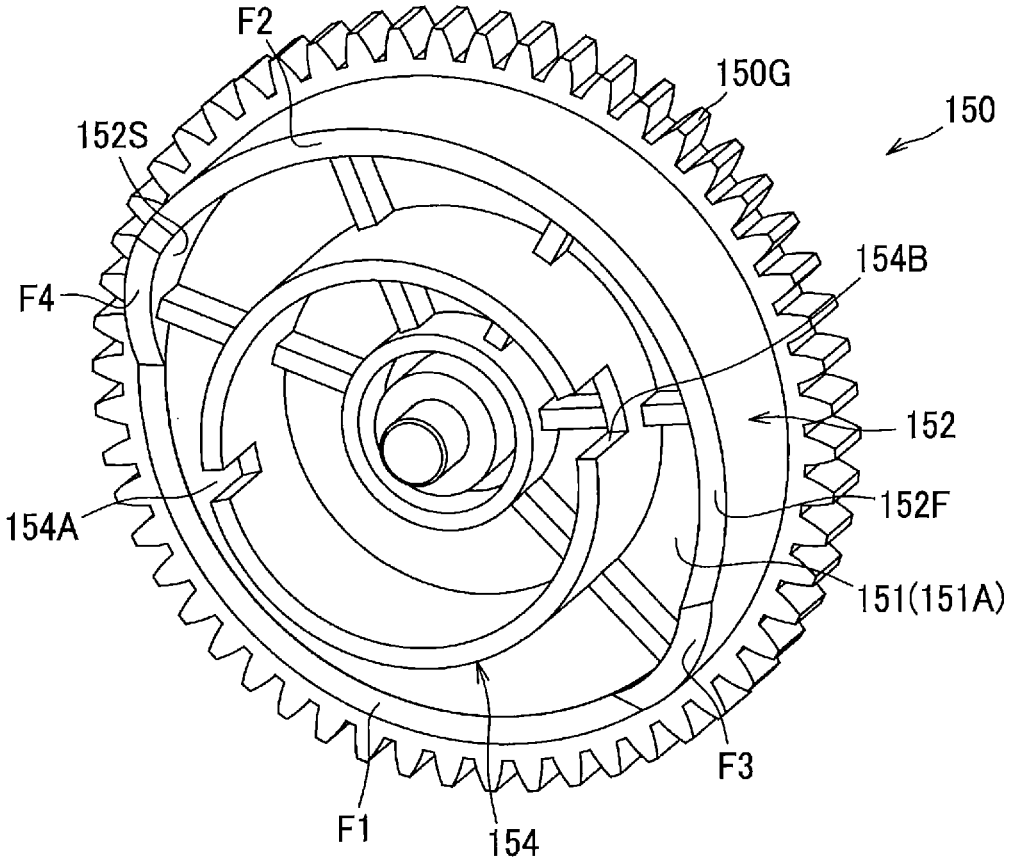
FIG. 18A is a perspective view of the cam for the color of yellow, magenta, and cyan as viewed in a direction from a first surface side toward a second surface side of the cam.
Figure 18B:
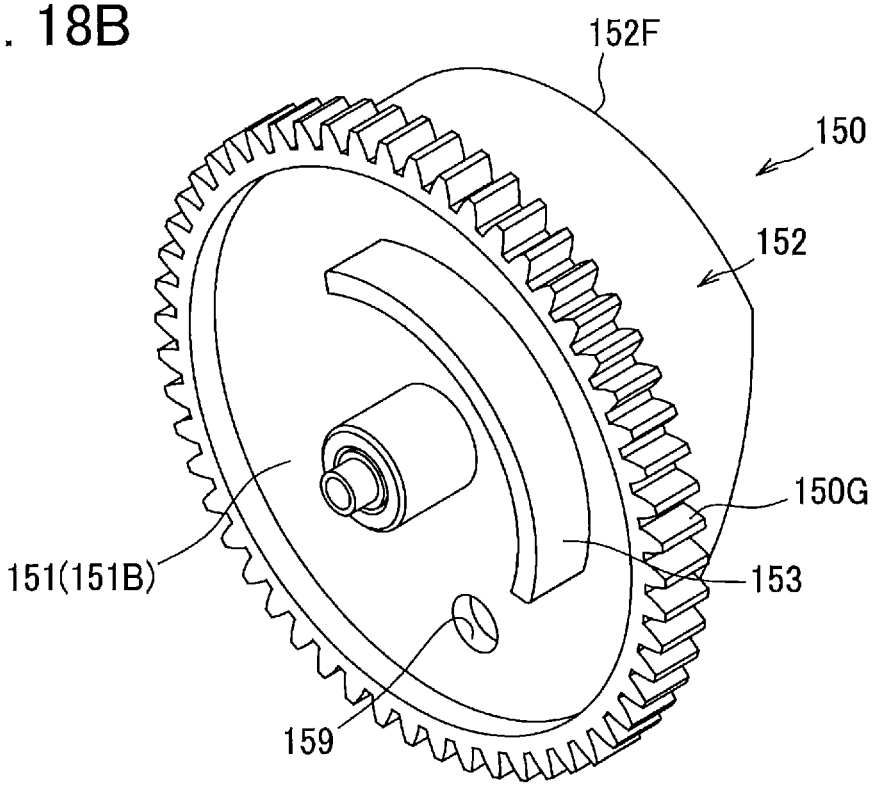
FIG. 18B is a perspective view of the cam for the color of yellow, magenta, and cyan as viewed in a direction from the second surface side toward the first surface side of the cam.

As illustrated in FIGS. 18A and 18B, each of the cams 150 includes a disc portion 151, a gear portion 150G, a first cam portion 152, a second cam portion 153, and a phase detection wall 154. The cam 150 is configured to rotate to move the corresponding developing roller 61 between the contact position and the separated position.

The disc portion 151 is generally circular plate shaped, and is rotatably supported by a support plate 102 (FIG. 7) fixed to the housing 10 of the image forming apparatus 1. The disc portion 151 has a single positioning hole 159 extending throughout a thickness thereof in the axial direction. For assembling each cam 150 to the support plate 102, an assembling tool (not illustrated) including a pin is used. The pin is inserted into the positioning hole 159, so that the cam 150 can be assembled to have a predetermined phase or angular position. Specifically, the assembling tool includes four pins. Each pin is inserted in each positioning hole 159 of each of the four cams 150, so that the four cams can be assembled to have predetermined angular positions.

The gear portion 150G is provided on an outer peripheral surface of the disc portion 151. The first cam portion 152 is an end cam configured to move the developing roller 61. The first cam portion 152 protrudes from a first surface 151A (one end surface of the disc portion 151) in the axial direction. The first cam portion 152 extends in a circumferential direction of the disc portion 151 and centered on the rotation axis of the cam 150. The first cam portion 152 has a protruding end face (right end face) constituting the cam surface 152F.

The cam surface 152F has a first holding surface F1, a second holding surface F2, a first guide surface F3, and a second guide surface F4. The first holding surface F1 is configured to hold the corresponding cam follower 170 at its standby position. The second holding surface F2 is configured to hold the corresponding cam follower 170 at its protruding position.

The first guide surface F3 connects the first holding surface F1 and the second holding surface F2 together and is inclined with respect to the first holding surface F1. The second guide surface F4 connects the second holding surface F2 and the first holding surface F1 together and is inclined with respect to the first holding surface F1. Note that a dot shading of the first cam portion 152 indicates the second holding surface F2 in FIGS. 10A, 10B, and 19A through 24B.

As will be described later in detail, the power transmission mechanism 100 includes a lever 160 and a clutch 120. The second cam portion 153 is configured to provide control to the clutch 120 (see FIG. 6) of the power transmission mechanism 100 to switch a power transmission status of the clutch 120 between a engaging state and a disengaging state in cooperation with the lever 160 (see FIG. 8) of the power transmission mechanism. The second cam portion 153 is a plate cam protruding from a second surface 151B (another end surface of the disc portion 151) in the axial direction. The second cam 153B protrudes leftward from a left side surface of the disc portion 151 in the axial direction. The second cam portion 153 is positioned opposite to the first cam portion 152 with respect to the disc portion 151. That is, protruding direction of the second cam portion 153 is opposite to the protruding direction of the first cam portion 152. The second cam portion 152 is arcuate in shape as viewed in the axial direction. The second cam portion 152 is integral with and coaxial with the disc portion 151, and hence, the second cam portion 152 rotates together with the first cam portion 151.

Separation sensors 4C and 4K (see FIG. 7, described later) are provided for detecting rotational phase of the cams 150C and 150K. The phase detection wall 154 extends in the circumferential direction of the cam 150 and is centered on the rotation axis of the cam 150 to block light emitted from the separation sensor 4C and 4K. The phase detection wall 154 protrudes in the axial direction from the first surface 151A of the disc portion 151, and is positioned closer to the rotation axis of the cam 150 than the first cam portion 152 is to the rotation axis. In other words, the phase detection wall 154 protrudes from the end surface of the disc portion 151 from which the first cam portion 152 also protrudes. The phase detection wall 154 is positioned radially inward of an inner peripheral surface 152S of the first cam portion 152.

The phase detection wall 154 has a first slit 154A and a second slit 154B those extending in the axial direction of the cam 150. The first slit 154A and second slit 154B are indicative of rotational phase or angular rotational position of the cam 150. The first slit 154A allows the light emitted from a light emitting element of the separation sensors 4C, 4*k* to pass therethrough when the developing roller 61 is at the separated position. The second slit 154B allows the light emitted from the light emitting element of the separation sensors 4C, 4*k* to pass therethrough when the developing roller 61 is at the contact position. The first slit 154A and the second slit 154B have dimension in the circumferential direction different from each other. Specifically, the second slit 154B has a size (width) in the circumferential direction greater than that of the first slit 154A.

In the cams 150Y, 150M, 150C for the colors of yellow, magenta and cyan, the first slit 154A and the second slit 154B are positioned at generally diametrically opposite side with respect to the rotation axis of the cam 150. On the other hand, in the cam 150K for the color of black, the first slit 154A and the second slit 154B are alternately arrayed with each other by approximately 90 degrees (see FIG. 7).

Figure 19A:
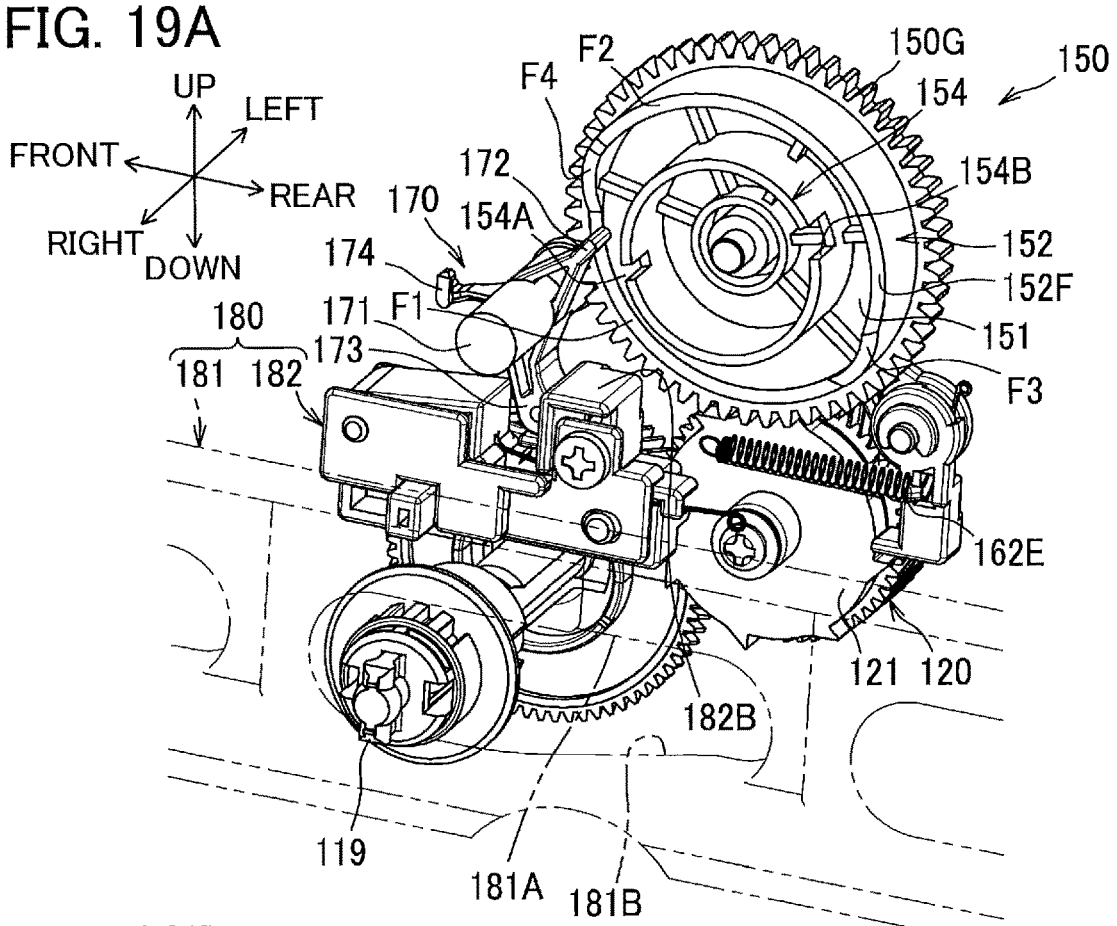
FIG. 19A is a perspective view illustrating the cam, the cam follower and the release member in a state where the cam rotates in a normal rotating direction and the developing roller is at a contact position in the image forming apparatus according to the embodiment.
Figure 19B:
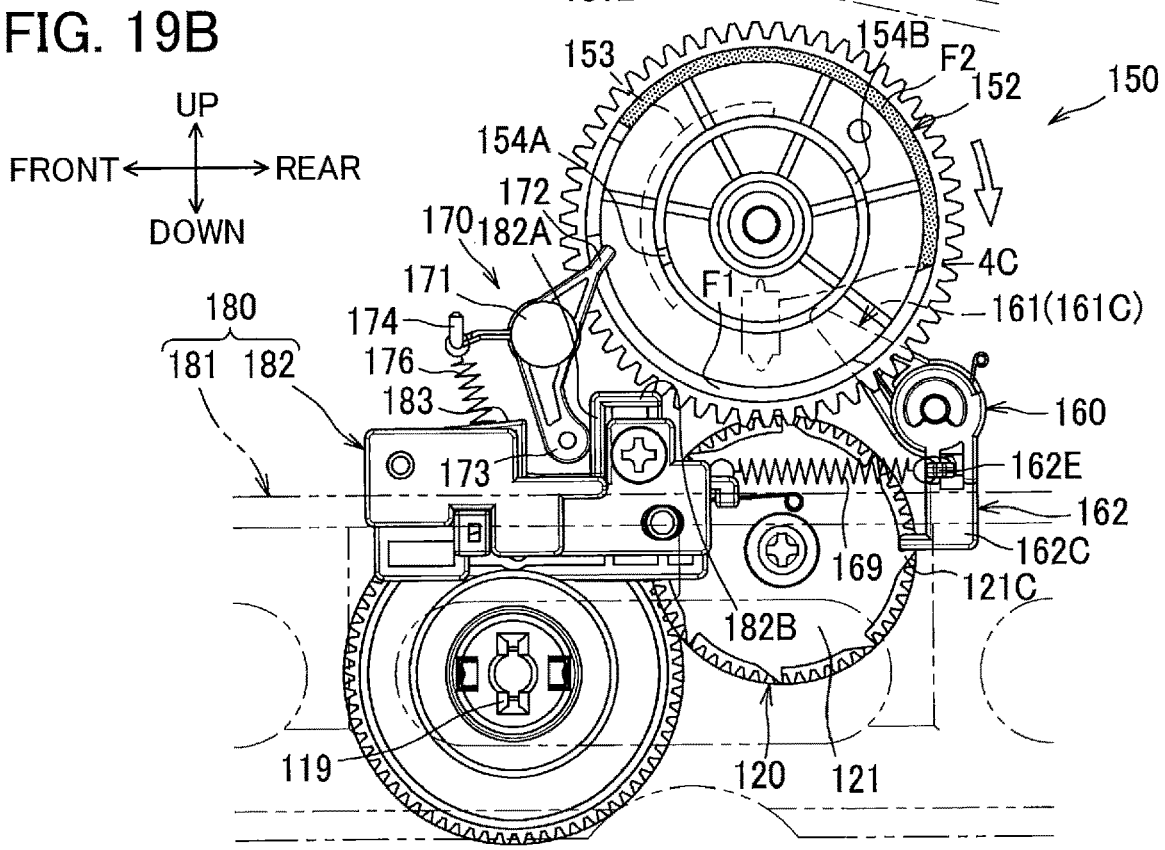
FIG. 19B is a side view illustrating the cam, the cam follower and the release member as viewed from the axial direction in the state where the cam rotates in the normal rotating direction and the developing roller is at the contact position in the image forming apparatus according to the embodiment.

As illustrated in FIGS. 19A and 19B, each of the cam followers 170 includes a slide shaft portion 171; a contact portion 172; an arm 173; and a spring hook 174. The slide shaft portion 171 is slidable with respect to the corresponding support shaft 179 fixed to the housing 10. The slide shaft portion 171 is movable in the axial direction. The contact portion 172 extends from the slide shaft portion 171. The contact portion 172 has an end face in the axial direction facing the cam surface 152F of the first cam portion 152 and contactable with the cam surface 152F.

The arm 173 extends in a direction away from the support shaft 179 and the slide shaft portion 171. The arm 173 extends in a direction different from the extending direction of the contact portion 172, for example extends downward from the slide shaft portion 171. The arm 173 extends in a radial direction of the support shaft 179. The spring hook 174 extends in a direction away from the slide shaft portion 171, for example, extends frontward from the slide shaft portion 171.

The first spring 176 (FIG. 2) is a tension spring having one end portion engaged with the spring hook 174 and another end portion engaged with the support plate 102 at a position lower than the spring hook 174. Hence, the first spring 176 urges the cam follower 170 toward the support plate 102, i.e., in a direction from the protruding position to the standby position. Further, the first spring 176 urges the cam follower 170 in a counterclockwise direction in FIGS. 19A and 19B, i.e., in a direction from the non-operating position to the operating position.

As illustrated in FIG. 7, the cams 150Y, 150M and 150C have generally the same configuration as one another except that a length of the first cam portion 152A of the cam 150Y in a rotational direction thereof is greater than a length of the first cam portion 152A of each of the remaining cams 150M and 150C. The cam 150K for the color of black has two first cam portions 152 each having a short length in a rotational direction thereof.

The housing 10 is provided with the separation sensors 4C and 4K respectively corresponding to the colors of black and cyan. Each of the separation sensors 4C and 4K is a phase sensor or displacement sensor for detecting a phase or rotational angular position of each of the cams 150C and 150K. Each of the separation sensors 4C and 4K is constituted by a photo-interrupter including the light emitting element and a light receiving element.

Each of the separation sensors 4C and 4K is configured to output ON signal to the controller 2 at a timing when the light emitted from the light emitting element is received in the light receiving element when the first slit 154A or the second slit 154B is positioned between the light emitting element and the light receiving element. Further, each of the separation sensors 4C and 4K is configured to output OFF signal to the controller 2 at a timing when the light emitted from the light emitting element is not received in the light receiving element when the phase detection wall 153 is positioned between light emitting element and the light receiving element, so that the light emitted from the light emitting element is shut off by the wall.

The first slit 154A and the second slit 154B allow the light emitted from the light emitting element of the separation sensor 4C and 4K to pass therethrough when the developing roller 61 is positioned at the separated position and the contact position, respectively. That is, each of the separation sensors 4C and 4K is configured to output ON signal to the controller 2 when each developing roller 61 is at the separated position and the light emitted from the light emitting element passes through the first slit 154A and is received in the light receiving element. Further, each of the separation sensors 4C and 4K is configured to output ON signal to the controller 2 when each developing roller 61 is at the contact position and the light emitted from the light emitting element passes through the second slit 154B and is received in the light receiving element. In other words, each of the separation sensors 4C and 4K is positioned to detect the first slit 154A when the developing roller 61 is at the separated position, and to detect the second slit 154B when the developing roller 61 is at the contact position.

In the depicted embodiment, receipt of the light by the light receiving element of the separation sensor 4C and 4K will be referred to as ON, and non-receipt of the light will be referred to as OFF. Voltage level of ON signal may be higher or lower than that of OFF signal. Incidentally, each of the cam 150Y and 150M has a part having a shape the same as the shape of the phase detection wall 154. However, separation sensor for each of the cam 150Y and 150M is not provided.

Turning back to FIG. 1, the conveying device 70 is positioned between the sheet tray 21 and the photosensitive drums 50. The conveying device 70 includes: a drive roller 71; a driven roller 72; an endless belt as a conveyer belt 73; and four transfer rollers 74. The conveyer belt 73 is mounted over the drive roller 71 and the driven roller 72 under tension, and has an outer peripheral surface facing each of the photosensitive drums 50. Each of the transfer rollers 74 is positioned within a loop of the conveyer belt 73 to nip the conveyer belt 73 in cooperation with a corresponding one of the photosensitive drums 50. The sheet S is configured to be conveyed as the conveyer belt 73 circulates while the sheet S is mounted on an upper portion of the outer peripheral surface of the conveyer belt 73, and at the same time, toner images formed on the photosensitive drums 50 are successively transferred to the sheet S.

The fixing device 80 is positioned rearward of the photosensitive drum 50K and the conveying device 70 in the upward/downward direction. The fixing device 80 includes a heat roller 81 and a pressure roller 82 positioned facing the heat roller 81. A pair of conveyer rollers 15 is positioned above the fixing device 80, and a pair of discharge rollers 16 is positioned above the conveyer rollers 15.

In the image forming unit 30, a peripheral surface of each photosensitive drum 50 is uniformly charged by the corresponding charger 52, and then is exposed to light by the laser beam irradiated from the exposure device 40. Thus, an electrostatic latent image based on image data is formed on the peripheral of each photosensitive drum 50.

Further, toner accommodated in the casing 63 of each developing cartridge 60 is carried on a peripheral surface of the developing roller 61 therein, and then is supplied from the developing roller 61 to the peripheral surface of the corresponding photosensitive drum 50 when the developing roller 61 comes into contact with the photosensitive drum 50. Hence, a toner image is formed on the peripheral surface of each photosensitive drum 50.

Subsequently, a toner image formed on each photosensitive drum 50 is transferred onto the sheet S when the sheet S supplied on the conveyer belt 73 moves past the portion between the photosensitive drum 50 and the corresponding transfer roller 74. Then, the toner image transferred onto the sheet S is thermally fixed to the sheet S when the sheet S passes a position between the heat roller 81 and the pressure roller 82.

The sheet S discharged from the fixing device 80 is then discharged onto the discharge tray 13 by the conveyer rollers 15 and the discharge rollers 16.

Next, a structure for driving and stopping the developing rollers 61, and a structure for moving the developing rollers 61 to come into contact with and to be separated from the photosensitive drums 50 will be described in detail.

Figure 6:
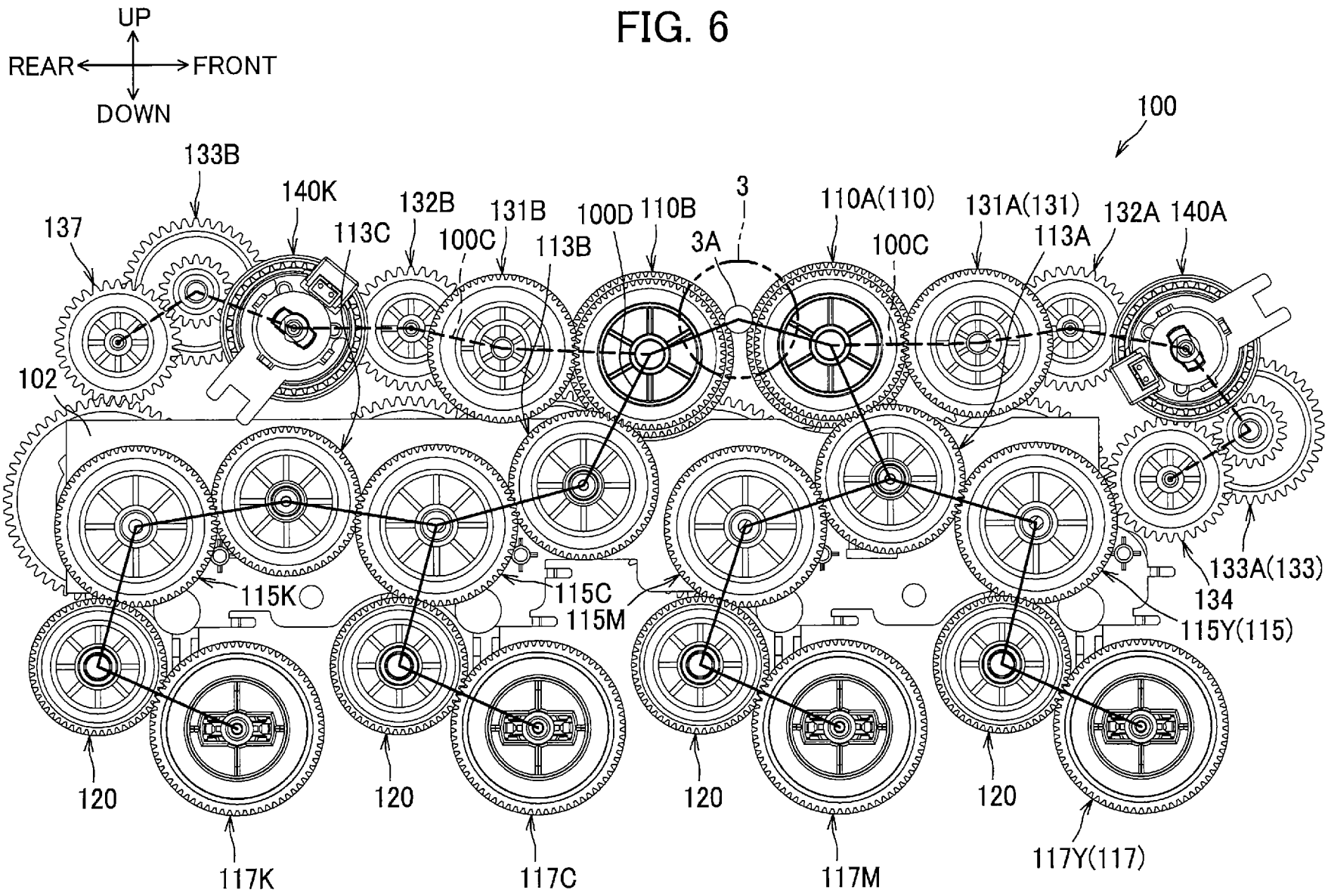
FIG. 6 is a view of a power transmission mechanism as viewed in an axial direction thereof and from a left side in the image forming apparatus according to the embodiment.

As illustrated in FIG. 6, the image forming apparatus 1 further includes: a motor 3 configured to drive the developing rollers 61; and the power transmission mechanism 100 configured to transmit driving force of the motor 3 to the first developing roller 61Y, the second developing roller 61M, the third developing roller 61C, and the fourth developing roller 61K. Each of the above-described cams 150 (constituting part of the corresponding separation mechanism) is mechanically connected to the power transmission mechanism 100. The power transmission mechanism 100 is configured not to transmit the driving force of the motor 3 to the first developing roller 61Y, the second developing roller 61M, the third developing roller 61C, and the fourth developing roller 61K when these developing rollers 61 are at their respective the separated positions.

The motor 3 is a drive source for driving the developing rollers 61 and the cams 150. The motor 3 is a reversible motor rotatable in normal rotating direction and reverse rotating direction and is controlled by the controller 2.

As illustrated in FIG. 6, the power transmission mechanism 100 includes: a power transmission gear train 100D configured to transmit the driving force of the motor 3 to the respective developing rollers 61; and a transmission control gear train 100C configured to control transmission of the driving force of the power transmission gear train 100D. The power transmission gear train 100D is mechanically connected to the transmission control gear train 100C.

Figure 8:
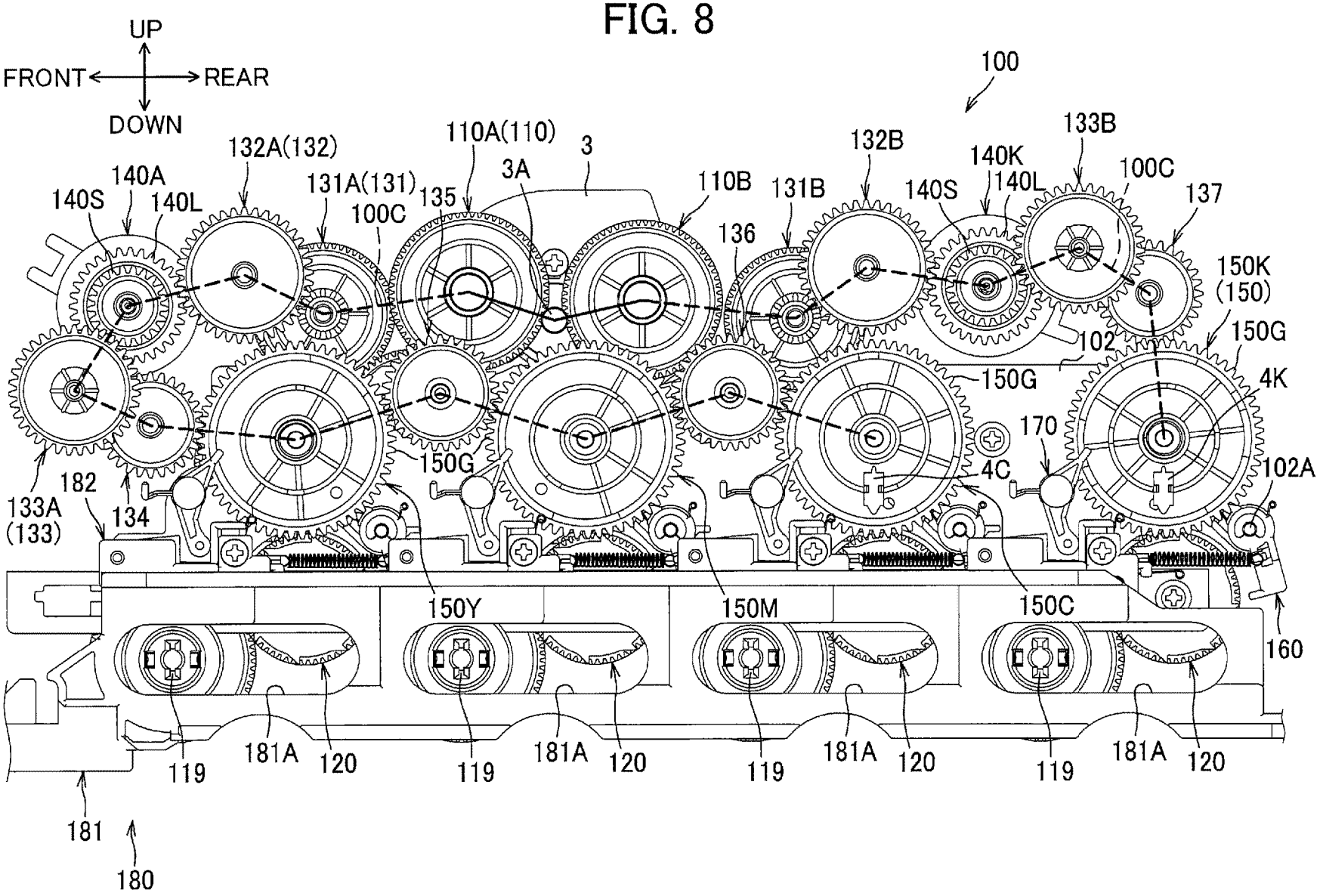
FIG. 8 is a view illustrating the power transmission mechanism as viewed in the axial direction and from a right side in the image forming apparatus according to the embodiment.

The transmission control gear grain 100C is configured to transmit the driving force of the motor 3 to each of the cams 150, and permits the cam 150 to be rotated in the normal rotating direction upon normal rotation of the motor 3, and permits the cam 150 to be rotated in the reverse rotating direction upon reverse rotation of the motor 3. In FIGS. 6 and 8, meshing engagement of the gears in the power transmission gear train 100D is indicated by a bold solid line, and meshing engagement of the gears in the transmission control gear train 100C is indicated by a bold broken line.

The power transmission gear train 100D includes: two first idle gears 110 (110A, 110B); three second idle gears 113A, 113B and 113C; four third idle gears 115 (115Y, 115M, 115C, 115K); four clutches 120; and four coupling gears 117 (117Y, 117M, 117C, 117K). Each of the gears constituting the power transmission gear train 100D is supported by the support plate 102 or a frame (not illustrated) of the housing 10 so as to be rotatable about an axis extending in the axial direction.

The motor 3 includes an output shaft 3A. A gear (not illustrated) is concentrically fixed to the output shaft 3A.

The third idle gears 115Y, 115M, 115C, 115K are provided in one-to-one correspondence with each of the four colors, and are arrayed in a front-to-rear direction.

The four clutches 120 have the same structure as one another. Each of the clutches 120 is in meshing engagement with a corresponding one of the third idle gears 115 (a corresponding one of the third idle gears 115Y, 115M, 115C, and 115K) to receive the driving force therefrom. The structure of each clutch 120 will be described later in detail.

Each of the coupling gears 117 is in meshing engagement with a corresponding one of the clutches 120. Each coupling gear 117 includes the coupling shaft 119 rotatable integrally therewith (FIG. 7). The coupling shaft 119 is movable in the axial direction in interlocking relation to the opening/closing movement of the cover 11. The coupling shaft 119 is configured to be engaged with the coupling 65 (FIG. 3A) of the corresponding developing cartridge 60 in accordance with the closing motion of the cover 11.

In the power transmission gear train 100D, the coupling gear 117Y for the color of yellow is configured to receive the driving force from the motor 3 through the first idle gear 110A, the second idle gear 113A, the third idle gear 115Y, and the clutch 120.

The coupling gear 117M for the color of magenta is configured to receive the driving force from the motor 3 through the first idle gear 110A, the second idle gear 113A, the third idle gear 115M, and the clutch 120.

The coupling gear 117C for the color of cyan is configured to receive the driving force from the motor 3 through the first idle gear 110B, the second idle gear 113B, the third idle gear 115C, and the clutch 120.

The coupling gear 117K for the color of black is configured to receive the driving force from the motor 3 through the first idle gear 110B, the second idle gear 113B, the third idle gear 115C, the second idle gear 113C, the third idle gear 115K, and the clutch 120.

As illustrated in FIGS. 7 and 8, the transmission control gear train 100C includes: two fourth idle gears 131 (131A, 131B); two fifth idle gears 132 (132A, 132B); a YMC clutch 140A and K clutch 140K those being an example of "clutch", two sixth idle gears 133 (133A, 133B); a seventh idle gear 134, an eighth idle gear 135; a ninth idle gear 136, a tenth idle gear 137; and the four cams 150 (150Y, 150M, 150C, 150K). These gears constituting the transmission control gear train 100C are supported by the support plate 102 or the frame (not illustrated) of the housing 10 so as to be rotatable about their axis extending in the axial direction. The YMC clutch 140A and the K clutch 140K are example of the clutch of the present disclosure.

Of the two fifth idle gears 132, the fifth idle gear 132A is positioned frontward of the fourth idle gear 131A, and the fifth idle gear 132B is positioned rearward of the fourth idle gear 131B. The fifth idle gear 132A is in meshing engagement with the fourth idle gear 131A, and the fifth idle gear 132B is in meshing engagement with the fourth idle gear 131B The YMC clutch 140A is configured to change-over transmission and cut-off of the driving force to the cams 150 with respect to the color of yellow, magenta, and cyan in the transmission control gear train 100C. That is, the YMC clutch 140A is configured to perform switching of the cams 150Y, 150M, and 150C between their rotating states and non-rotating states. The YMC clutch 140A includes a large diameter gear 140L and a small diameter gear 140S whose number of gear teeth is smaller than that of the large diameter gear 140L. The YMC clutch 140A is positioned frontward of the fifth idle gear 132A, and the large diameter gear 140L of the YMC clutch 140A is in meshing engagement with the fifth idle gear 132A.

An electromagnetic clutch is available as the YMC clutch 140A. Upon receipt of power supply (turning ON), the large diameter gear 140L and the small diameter gear 140S integrally rotate together, and upon halting of the power supply (turning OFF), the large diameter gear 140L idly rotates to prevent rotation of the small diameter gear 140S.

The K clutch 140K has the same structure as that of the YMC clutch 140A. The K clutch 140K is configured to perform change-over between transmission and cut-off of the driving force to the cam 150 with respect to the color of black (i.e., the cam 150K) in the transmission control gear train 100C. As in the YMC clutch 140A, the K clutch 140K includes the large diameter gear 140L and the small diameter gear 140S whose number of gear teeth is smaller than that of the large diameter gear 140L. The K clutch 140K is positioned rearward of the fifth idle gear 132B, and the large diameter gear 140L of the K clutch 140K is in meshing engagement with the fifth idle gear 132B.

Of the two sixth idle gears 133, the sixth idle gear 133A is positioned frontward of the YMC clutch 140A, and the sixth idle gear 133B is positioned rearward of the K clutch 140K. The sixth idle gear 133A is in meshing engagement with the small diameter gear 140S of the YMC clutch 140A, and the sixth idle gear 133B is in meshing engagement with the small diameter gear 140A of the K clutch 140K.

The seventh idle gear 134 is positioned between the sixth idle gear 133A and the cam 150Y. The seventh idle gear 134 is in meshing engagement with the sixth idle gear 133A and the gear portion 150G of the cam 150Y.

The eighth idle gear 135 is positioned between the cam 150Y and the cam 150M. The eighth idle gear 135 is in meshing engagement with the gear portion 150G of the cam 150Y and the gear portion 150G of the cam 150M.

The ninth idle gear 136 is positioned between the cam 150M and the cam 150C. The ninth idle gear 136 is in meshing engagement with the gear portion 150G of the cam 150M and the gear portion 150G of the cam 150C.

The tenth idle gear 137 is positioned between the sixth idle gear 133B and the cam 150K. The tenth idle gear 137 is in meshing engagement with the sixth idle gear 133B (FIG. 6) and the gear portion 150G of the cam 150K.

In the transmission control gear train 100C, the yellow cam 150Y is configured to receive the driving force of the motor 3 through the first idle gear 110A, the fourth idle gear 131A, the fifth idle gear 132A, the YMC clutch 140A, the sixth idle gear 133A, and the seventh idle gear 134. Further, the magenta cam 150M is configured to receive the driving force from the yellow cam 150Y through the eighth idle gear 135. Further, the cyan cam 150C is configured to receive the driving force from the magenta cam 150M through the ninth idle gear 136. The cams 150Y, 150M, and 150C are configured to rotate concurrently upon power supply to the YMC clutch 140A, and the cams 150Y, 150M and 150C are configured to stop rotating upon halting of the power supply to the YMC clutch 140A.

On the other hand, the black cam 150K is configured to receive the driving force of the motor 3 through the first idle gear 110B, the fourth idle gear 131B, the fifth idle gear 132B, the K clutch 140K, the sixth idle gear 133B, and the tenth idle gear 137. The cam 150K is configured to rotate upon power supply to the K clutch 140K, and the cam 150K is configured to stop rotating upon halting of the power supply to the K clutch 140K.

Next, the release member 180 will be described with reference to FIGS. 7, and 9A through 10B. As illustrated in FIG. 7, the release member 180 is configured to move each of the coupling shafts 119 in the axial direction in interlocking relation to the opening movement of the cover 11, and is configured to move each of the cam followers 170 from the operating position to the non-operating position.

Figure 9A:
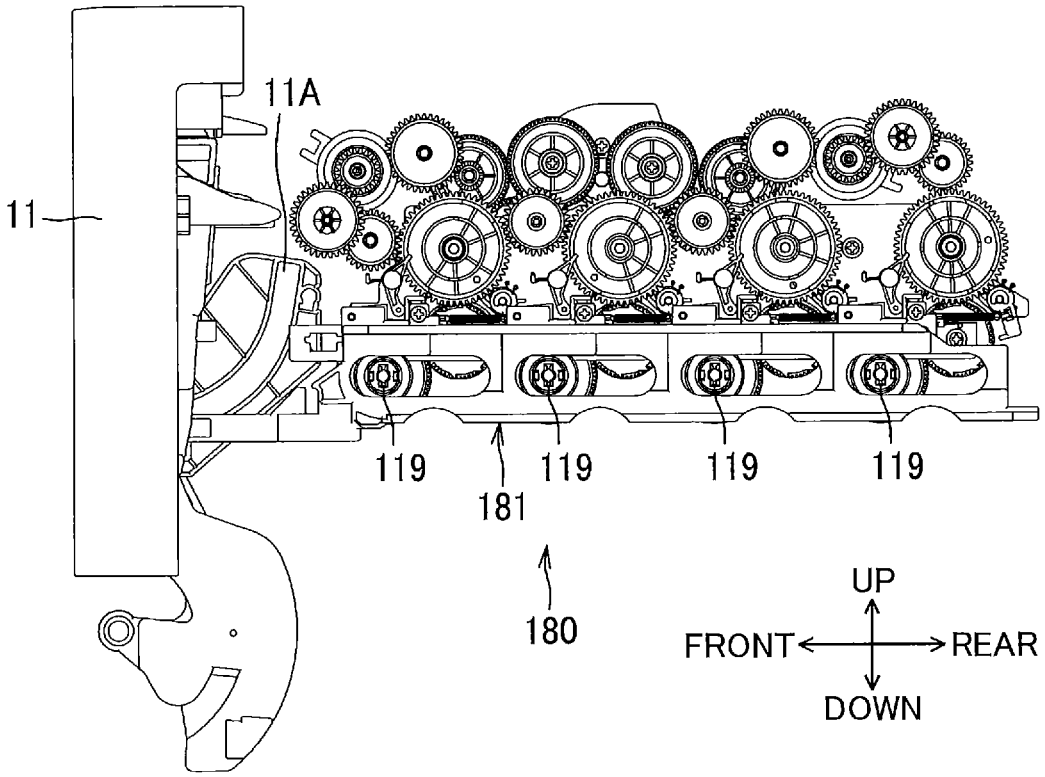
FIG. 9A is a side view illustrating a release member when a cover is at a closed position in the image forming apparatus according to the embodiment.
Figure 9B:
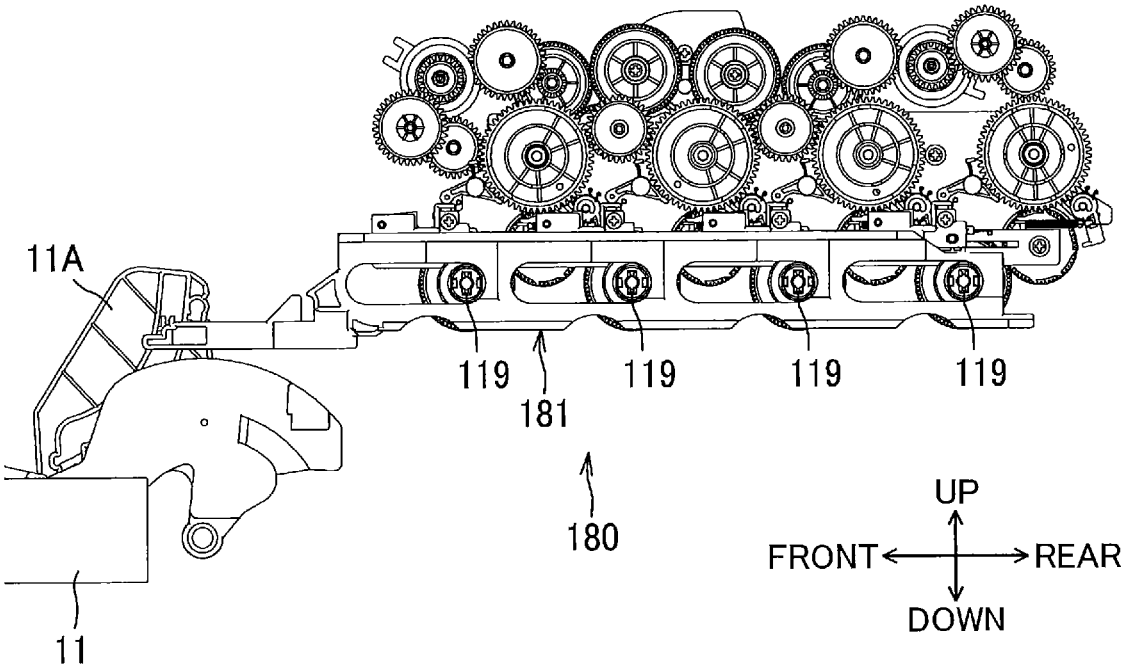
FIG. 9B is a side view illustrating the release member when the cover is at an open position in the image forming apparatus according to the embodiment.

As illustrated in FIG. 9A, the release member 180 is connected to the cover 11 through a link 11A. The release member 180 is linearly movable frontward in accordance with the movement of the cover 11 from the closed position illustrated in FIG. 9A to the open position illustrated in FIG. 9B. That is, the release member 180 is movable in interlocking relation to the opening/closing movement of the cover 11.

Figure 10A:
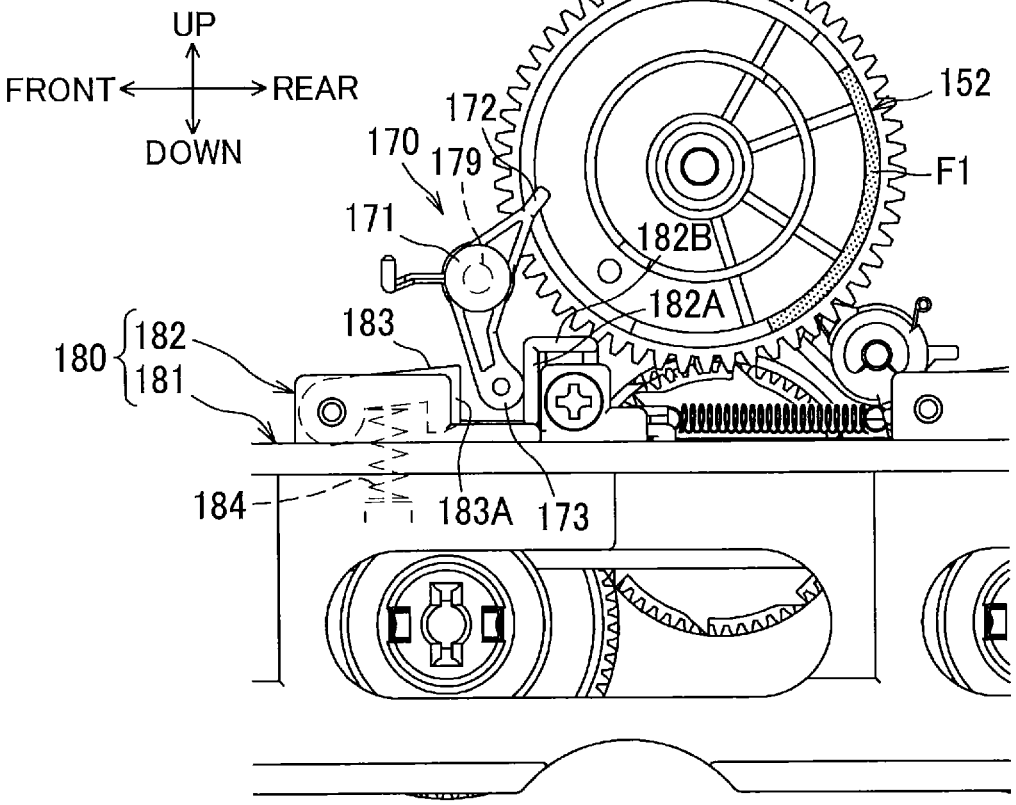
FIG. 10A is a view for description of a stopper and particularly illustrating the stopper at a restricting position where the stopper is free from urging by an arm in the image forming apparatus according to the embodiment.
Figure 10B:
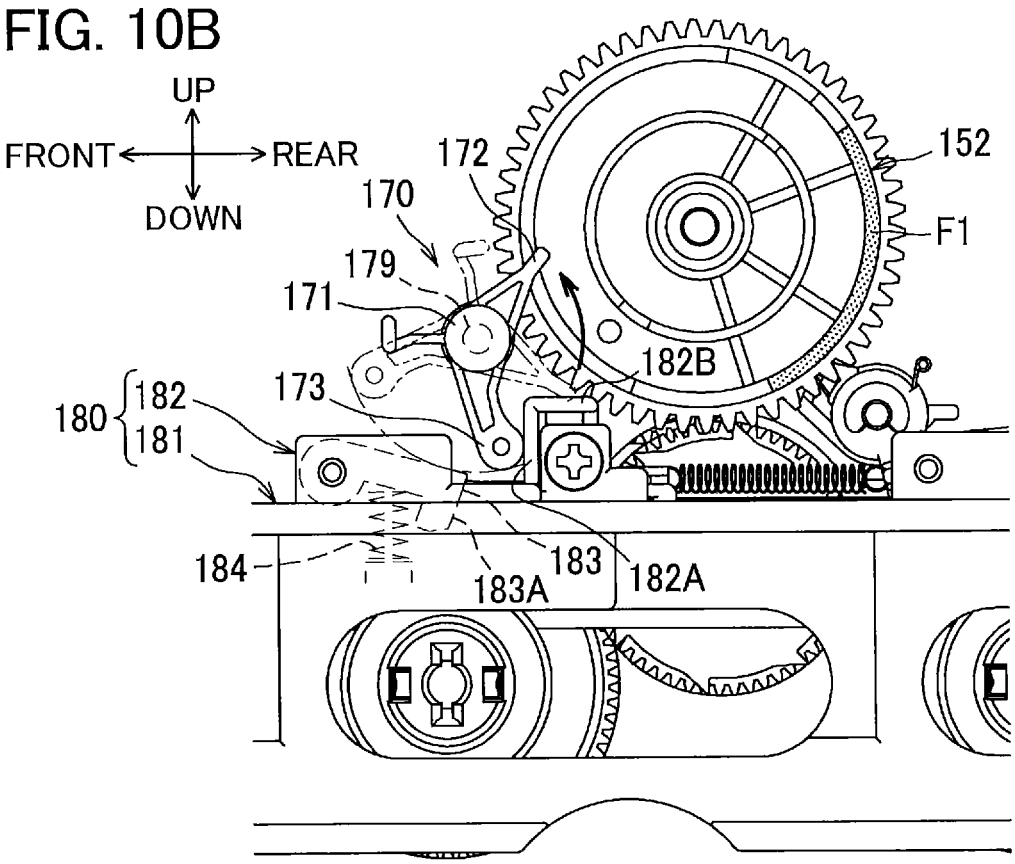
FIG. 10B is a view for description of the stopper and particularly illustrating the stopper pivotally moved to a non-restricting position by urging force from the arm.

Turning back to FIG. 7, the release member 180 includes: a coupling acting member 181 configured to move the coupling shafts 119; and four cam follower acting members 182 configured to move the cam followers 170. Further, the image forming apparatus 1 includes: four stoppers 183; and four stopper urging springs 184 as illustrated in FIGS. 10A and 10B. Each of the stoppers 183 is movable in accordance with the linear movement of the release member 180 and is pivotally movable with respect to the release member 180. Each of the stopper urging springs 184 urges a corresponding one of the stoppers 183. The coupling acting member 181 is supported by the housing 10 so as to be linearly movable in the frontward/rearward direction in which the photosensitive drums 50 are juxtaposed.

The coupling acting member 181 has a plurality of through-holes 181A those being in one-to-one correspondence with the coupling shafts 119. The coupling acting member 181 includes a plurality of coupling retraction cams 181B those being in one-to-one correspondence with the coupling shafts 119. Each of the through-holes 181A allows a tip end portion of a corresponding one of the coupling shafts 119 to extend therethrough, so that the corresponding coupling shaft 119 is engageable with the coupling 65. Each of the coupling retraction cams 181B has a surface sloped leftward in the rearward direction. In other words, the coupling retraction cams 181B has a cam having a wedge-shape that is thin in the left-right direction at the front side and thick at the rear side. Hence, each coupling retraction cam 181B moves the corresponding coupling shaft 119 in the axial direction (leftward) to disengage the coupling shaft 119 from the coupling 65 in accordance with the frontward movement of the release member 180.

Each of the four cam follower acting members 182 is provided in one-to-one correspondence with the four cam followers 170. Each cam follower acting member 182 is fixed to the coupling acting member 181 and is linearly movable in the frontward/rearward direction together with the coupling acting member 181.

As illustrated in FIGS. 10A and 10B, each cam follower acting member 182 includes: a release engagement portion 182A; and a cam follower holding portion 182B. The release engagement portion 182A extends upward at a position rearward of the arm 173 of the corresponding cam follower 170 that is positioned at the operating position. Hence, each release engagement portion 182A is configured to contact and press the corresponding arm 173 to pivotally move the corresponding cam follower 170 from the operating position to the non-operating position when the cover 11 is moved from the closed position to the opening position causing linear frontward movement of the release member 180. Further, in a case where the motor 3 rotates in a normal rotating direction to allow the first cam portion 152 to guide the corresponding contact portion 172 in a state where the cover 11 is at the closed position, the release engagement portion 182A is in contact with the arm 173 to prevent the cam follower 170 from pivotally moving about an axis of the support shaft 179.

Each of the cam follower holding portions 182B extends rearward from an upper end of a corresponding one of the release engagement portions 182A. The cam follower holding portion 182B has a surface facing upward. The arm 173 of the cam follower 170 that is at the non-operating position is in contact with the upper surface of the cam follower holding portion 182B to maintain a posture of the cam follower 170 when the cover 11 is moved from the closed position to the open position.

Each stopper 183 has a front end portion pivotally movably supported by the corresponding cam follower acting portion 182. Specifically, the stopper 183 is pivotally movable in upward/downward direction about an axis extending in the axial direction between a restricting position as illustrated in FIG. 10A and a non-restricting position as illustrated in FIG. 10B.

Each stopper urging spring 184 always urges the corresponding stopper 183 in a direction from the non-restricting position to the restricting position. In FIGS. 10A and 10B, a compression coil spring is illustrated as the stopper urging spring 184, and is positioned below the stopper 183. However, a torsion spring is also available as the stopper urging spring 184. When the stopper 183 is positioned at an uppermost position, the upper surface of the stopper 183 is positioned lower than the upper surface of the cam follower acting portion 182B.

In a case where the cover 11 moves from the open position to the closed position while the cam follower 170 is at the operating position, each of the stoppers 183 is positioned at the restricting position so that the corresponding arm 173 is positioned between the release engagement portion 182A and the stopper 183 as illustrated in FIG. 10A. Hence, the arm 173 can be brought into contact with the stopper 183 to prevent the cam follower 170 from pivotally moving from the operating position to the non-operating position when the cam 160 rotates in a reverse rotating direction by the rotation of the motor 3 in its reverse rotating direction (see FIG. 23B). Incidentally, in the present embodiment, the motor 3 rotates in the normal rotating direction when the image forming apparatus 1 performs image forming operation.

On the other hand, as illustrated in FIG. 10B, in a case where the cover 11 moves from the open position to the closed position while the cam follower 170 is at the non-operating position, the cam follower 170 may be pivotally moved from the non-operating position toward the operating position by the urging force of the first spring 176. At that time, the stopper 183 is pressed by the arm 173 and pivotally moves from the restricting position to the non-restricting position to allow the cam follower 170 to be further pivotally moved toward the operating position by the urging force of the first spring 176.

Figure 11A:
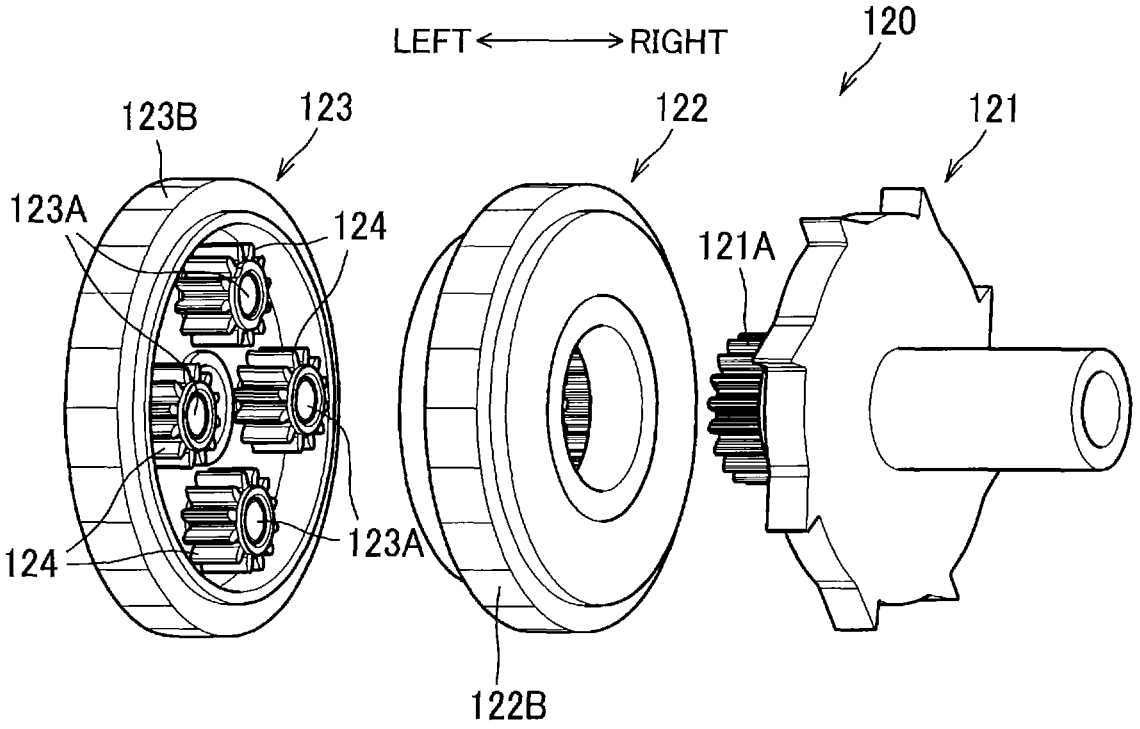
FIG. 11A is an exploded perspective view illustrating a clutch as viewed from a sun gear side thereof in the image forming apparatus according to the embodiment.
Figure 11B:
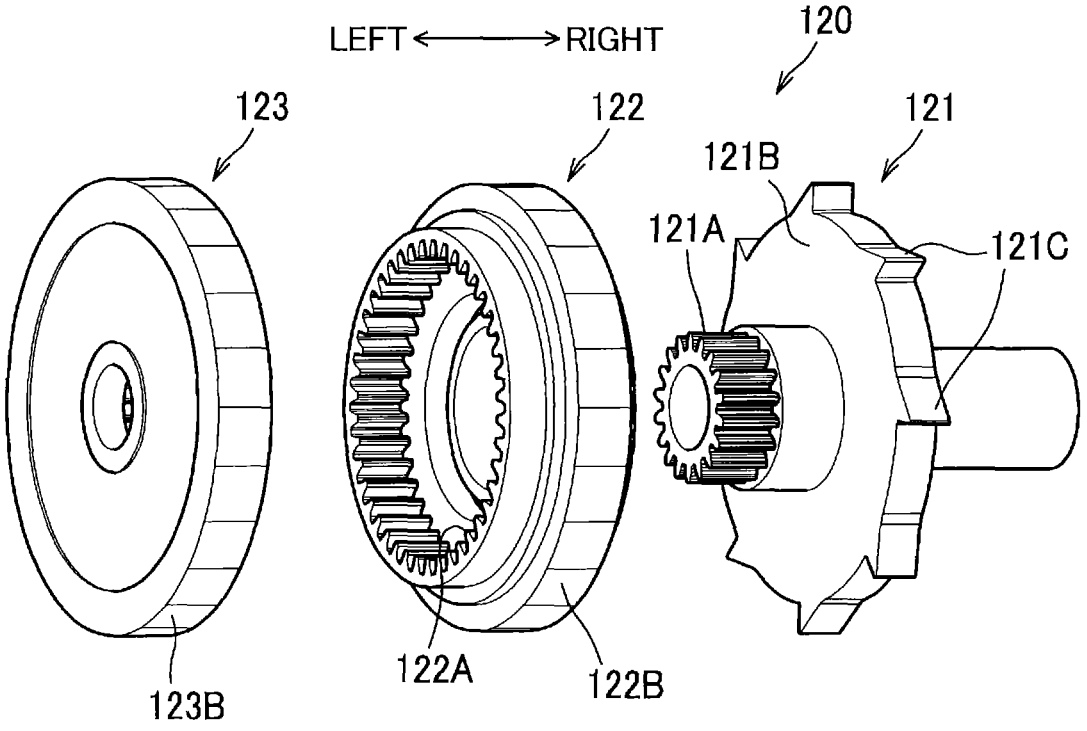
FIG. 11B is an exploded perspective view illustrating the clutch as viewed from a carrier side thereof in the image forming apparatus according to the embodiment.

Next, structures and functions of the clutches 120 will be described. As illustrated in FIGS. 11A and 11B, each clutch 120 includes a planetary gear mechanism. The clutch 120 is configured to switch a power transmission status between an engaging state in which the clutch 120 engages transmission of driving force from the motor 3 to the developing roller 61 and a disengaging state in which the clutch 120 disengages the transmission of the driving force from the motor 3 to the developing roller 61. Specifically, the clutch 120 includes: a sun gear 121 rotatable about an axis thereof; a ring gear 122; a carrier 123; and a plurality of (four) planetary gears 124 supported by the carrier 123. The ring gear 122 and the carrier 123 are rotatable coaxially about the axis of the sun gear 121.

The sun gear 121 includes: a gear portion 121A; a disc portion 121B rotatable integrally with the gear portion 121A; and a plurality of pawls 121C provided at an outer peripheral surface of the disc portion 121B. The pawls 121C have acute tip end portions each of which is inclined toward upstream in a rotational direction of the sun gear 121 along the outer peripheral surface. The ring gear 122 has an annular shape having an inner peripheral surface provided with an inner gear 122A and an outer peripheral surface provided with an input gear 122B.

The carrier 123 includes: a circular portion 123C; an annular portion 123D extending from an inner surface of the circular portion 123C; a four shaft portions 123A each extending from the inner surface of the circular portion 123C; and an output gear 123B provided at an outer peripheral surface of the annular portion 123D.

Each of the four planetary gears 124 is rotatably supported by a corresponding one of the four shaft portions 123A. Each planetary gear 124 is in meshing engagement with the gear portion 121A of the sun gear 121, and with the inner gear 122A of the ring gear 122.

As illustrated in FIG. 6, the input gear 122B of each clutch 120 is in meshing engagement with the corresponding third idle gear 115, and the output gear 123B is in meshing engagement with the corresponding coupling gear 117.

In a state where the rotation of the sun gear 121 is stopped, the driving force inputted into the input gear 122B can be transmitted to the output gear 123B (the engaging state). On the other hand, in a state where the sun gear 121 is allowed to rotate, the driving force inputted into the input gear 122B cannot be transmitted to the output gear 123B (the disengaging state). In a state where the clutch 120 is at the disengaging state and the driving force is inputted into the input gear 122 while load is imparted on the output gear 123B, the output gear 123B does not rotate and the sun gear 121 idly rotates.

As illustrated in FIG. 8, the power transmission mechanism 100 further includes a plurality of (four) levers 160 corresponding to the respective four colors of yellow, magenta, cyan and black. Four support shafts 102A are fixed to and extends from the support plate 102, and each lever 160 is pivotally supported by a corresponding one of the four support shafts 102A.

Each lever 160 is configured, in cooperation with the corresponding cam 150, to engage the sun gear 121 of the planetary gear mechanism in the corresponding clutch 120 to prevent the rotation of the sun gear 121 to provide the engaging state, and to disengage from the sun gear 121 to provide the disengaging state. Each lever 160 is configured to switch the clutch 120 between the engaging state and the disengaging state when the cam 150 is rotated in the normal rotating direction, and to maintain the clutch 120 in the disengaging state when the cam 150 is rotated in the reverse rotating direction.

Figure 12A:
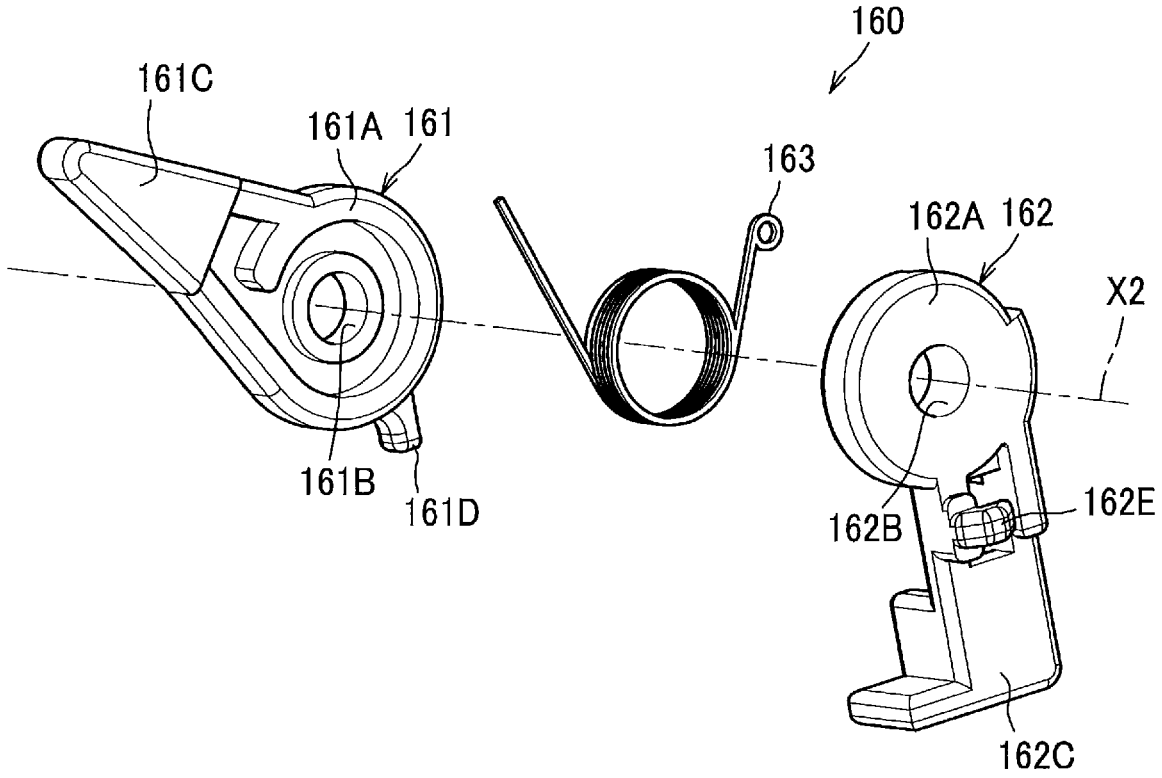
FIG. 12A is an exploded perspective view of a lever including a first lever and a second lever in the image forming apparatus according to the embodiment.

Specifically, as illustrated in FIG. 12A, the lever 160 includes: a first lever 161; a second lever 162; and a second spring 163. The first lever 161 is pivotally movable about a pivot axis X2 which is a center axis of the corresponding support shaft 102A. The first lever 161 is contactable with the corresponding second cam portion 153. The first lever 161 includes: a support portion 161A having a through-hole 161B into which the support shaft 102A is fitted; a first arm 161C extending from the support portion 161A; and a protrusion 161D protruding from the support portion 161A in a direction opposite to the extending direction of the first arm 161C.

Figure 12B:
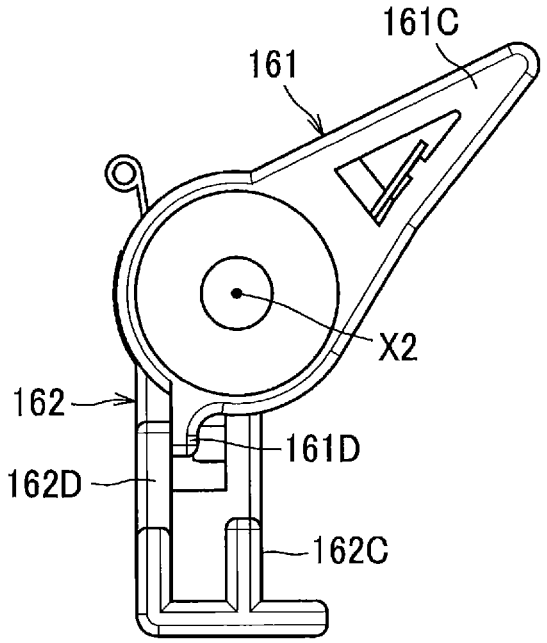
FIG. 12B is a view of the lever and particularly illustrating the first lever whose pivotal movement is restrained.
Figure 12C:
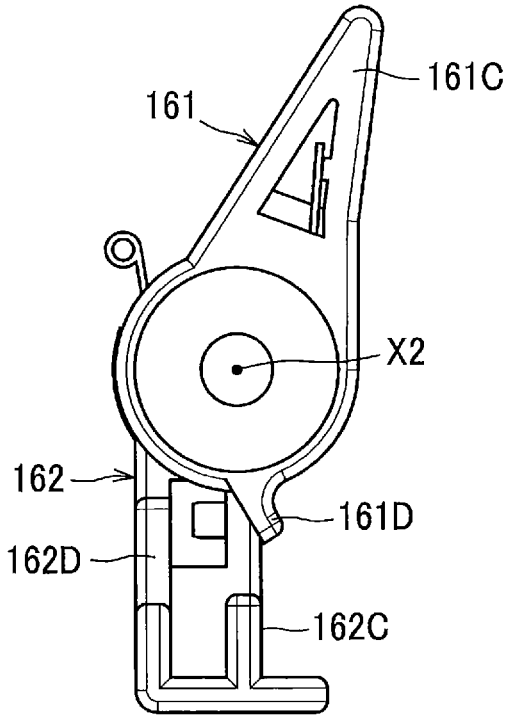
FIG. 12C is a view of the lever and particularly illustrating the first lever pivotally moved relative to the second lever.

The second lever 162 is pivotally movable about the pivot axis X2. The second lever 162 is engageable with the corresponding sun gear 121 which is one of the components of the clutch 120. The second lever 162 is assembled to the first lever 161, and is pivotally movable relative to the first lever 161 about the pivot axis X2 as illustrated in FIGS. 12B and 12C. In other words, the first lever 161 is assembled to the second lever 162, and is pivotally movable relative to the second lever 162 about the pivot axis X2. A pivotally moved position of the first lever 161 against the urging force of the second spring 163 as illustrated in FIG. 12C will be referred to as "pivotally moved position".

The second lever 162 includes: a support portion 162A having a through-hole 162B into which the support shaft 102A is fitted; a second arm 162C extending from the support portion 162A; a stop portion 162D; and a spring hook portion 162E. The stop portion 162D protrudes from the second arm 162C in an extending direction of the pivot axis X2. As illustrated in FIG. 12B, the stop portion 162D is contactable with the protrusion 161D of the first lever 161, so that pivotal movement of the second lever 162 in one direction relative to the first lever 161 is restricted.

The second spring 163 is a torsion spring, and is configured to urge the first lever 161 in a direction opposite to the above-described one direction so that the protrusion 161D is urged toward the stop portion 162D. In other words, the second spring 163 is configured to urge the second lever 162 so that the stop portion 162D of the second lever 162 comes in contact with the protrusion 161D of the first lever 161, thereby preventing the first lever 161 from pivotally moving relative to the second lever 162.

In a state where the first lever 161 and the second lever 162 are assembled together in each lever 160, the tip end portion of the second arm 162C extends toward an outer peripheral surface of the disc portion 121B of the corresponding sun gear 121. As illustrated in FIG. 19B, a third spring 169 which is a tension spring is provided. The third spring 169 has one end portion engaged with the spring hook portion 162E, and another end portion engaged with a spring hook portion (not illustrated) of the support plate 102.

Hence, the third spring 169 urges the second lever 162 in a clockwise direction in FIG. 19B. That is, the third spring 169 urges the second arm 162C of the second lever 162 in a direction to pivotally move toward the outer peripheral surface of the corresponding sun gear 121 (disc portion 121B) which is one of the components of the planetary gear mechanism. The second arm 162C can prevent the sun gear 121 from rotating upon engagement of the second arm 162C with the pawls 121C of the sun gear 121.

In each lever 160, the tip end portion of the first arm 161C of the first lever 161 is contactable with an outer peripheral surface of the corresponding second cam portion 153. The lever 160 is movable between a transmission position illustrated in FIGS. 19A and 19B and a non-transmission position illustrated in FIGS. 20A and 20B. In the transmission position, the tip end portion of the first lever 161 is apart from the second cam portion 153, and the second lever 162 is engaged with the pawls 121C of the clutch 120, thereby providing the engaging state of the clutch 120. In the non-transmission position, the tip end portion of the first lever 161 comes into contact with the second cam portion 153 and is moved by the second cam portion 153, so that the tip end portion of the second lever 162 is disengaged from the pawl portion 121C of the sun gear 121 which is one of the components of the planetary gear mechanism, thereby providing the disengaging state of the clutch 120.

Figure 24A:
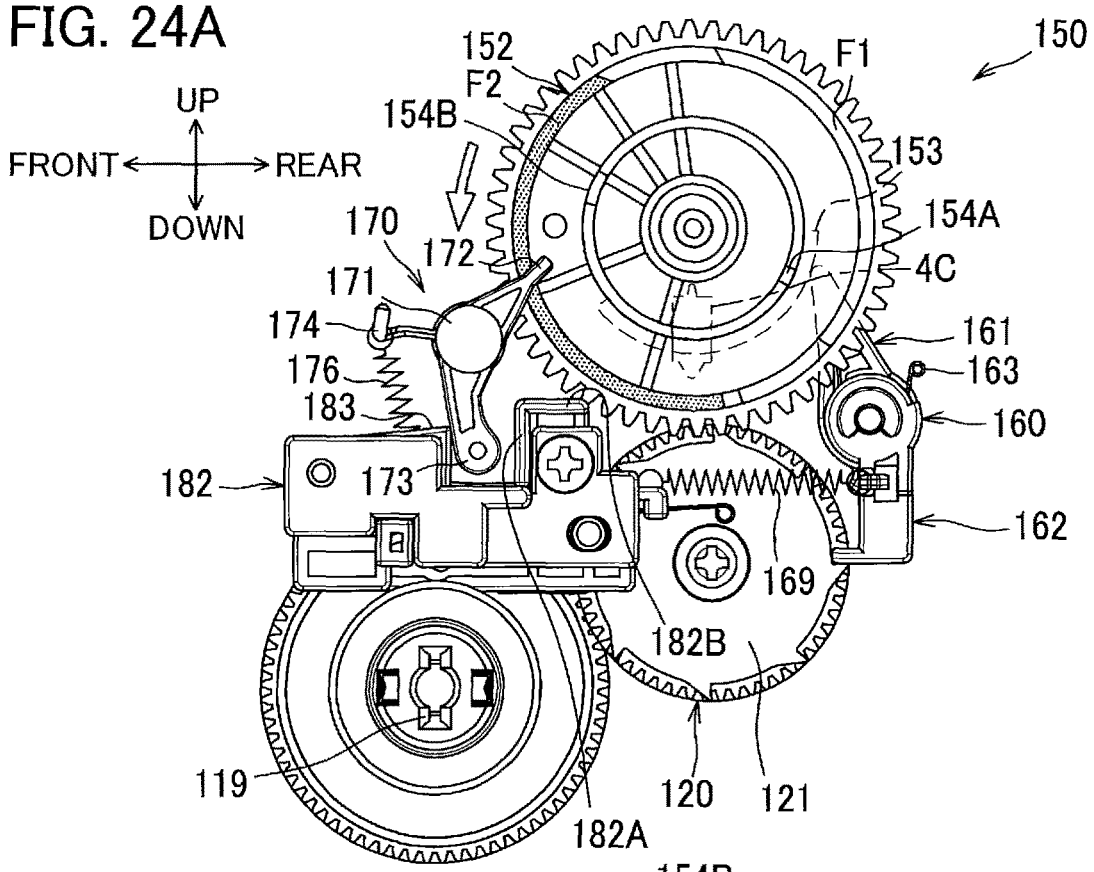
FIG. 24A is a side view illustrating the cam, the cam follower and the release member, and particularly illustrating a state where the developing roller is at the separated position and the first lever is at a pivotally moved position by further reverse rotation of the cam from the state illustrated in FIG. 23B.

Further, when the first lever 161 is pressed by the second cam portion 153 as a result of the rotation of the motor 3 in its reverse rotating direction in a state where the lever 160 is at the transmission position where the second lever 162 is engaged with the pawls 121C of the sun gear 121 which is one of the components of the planetary gear mechanism, the first lever 161 is pivotally moved relative to the second lever 162 to the pivotally moved position as illustrated in FIG. 24A against the urging force of the second spring 163. In this way, since the first lever 161 is pivotally movable relative to the second lever 162, application of excessive force to the lever 160 can be obviated while the motor 3 rotates in the reverse rotating direction.

Next, a control operation of the controller 2 will be described. The controller 2 is configured to control overall operations performed in the image forming apparatus 1. The controller 2 includes a CPU, a ROM, a RAM, an input/output portion, and the like. The controller 2 is configured to perform various processes by executing preliminarily stored programs.

In the present embodiment, the controller 2 is configured to control the YMC clutch 140A and the K clutch 140K according to signals transmitted from the separation sensors 4C and 4K, thereby controlling the contact/separation of the developing rollers 61 relative to the photosensitive drums 50.

Figure 14:
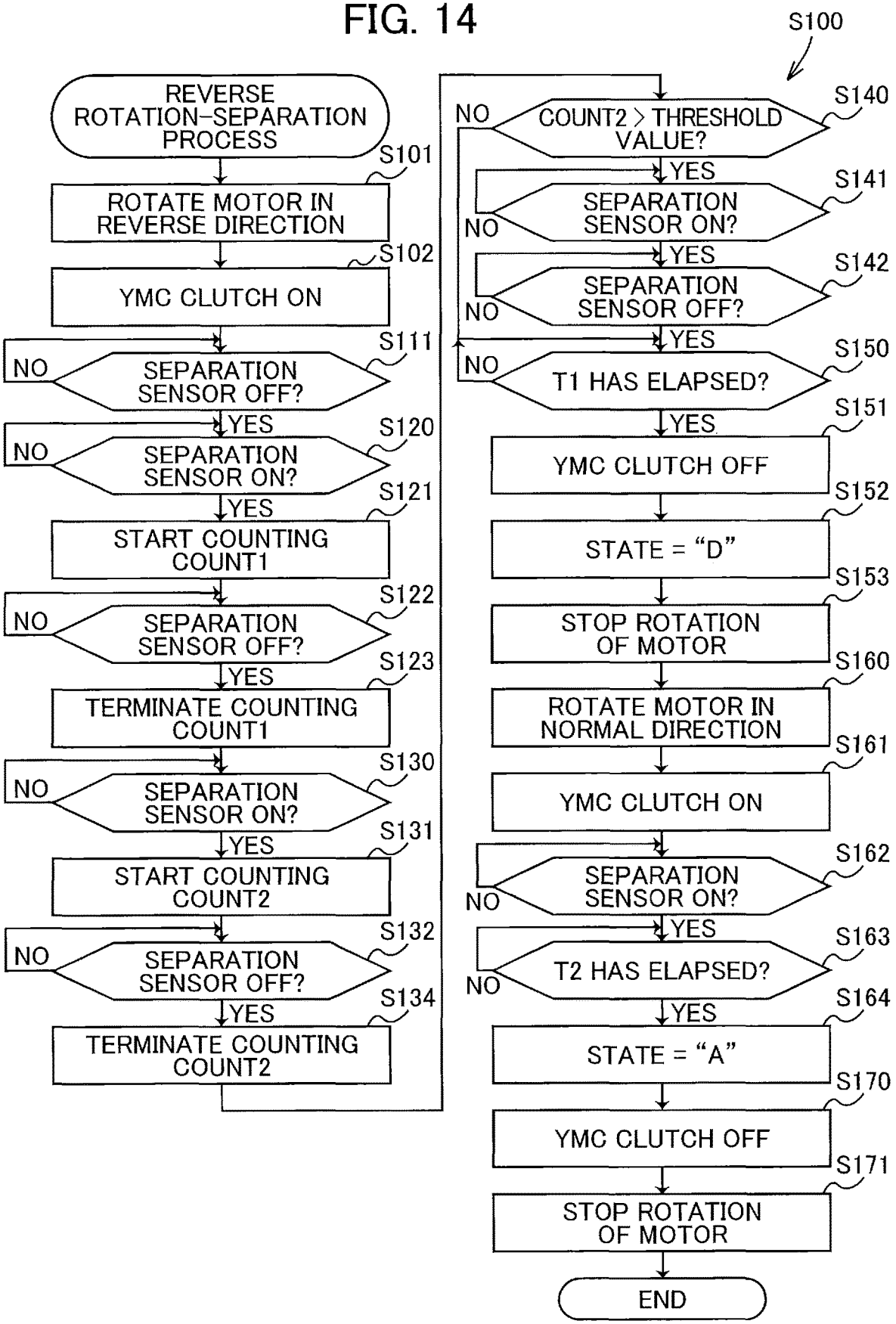
FIG. 14 is a flowchart illustrating steps in a reverse rotation-separation process executed by the controller of the image forming apparatus according to the embodiment.

When the cover 11 is moved from the open position to the closed position, the controller 2 is configured to perform a first initial control as illustrated in steps S101 through S153 in FIG. 14. In the first initial control, the controller 2 permits the cam 150 to start rotating in its reverse rotating direction, and then controls the cam 150 to stop rotating after detection of the first slit 154A based on a time period during which the light emitted from the light emitting element of the separation sensor 4C and 4K passes through the first slit 154A or the second slit 154B.

Further, the controller 2 is configured to perform a second initial control as illustrated in steps S160 through S171 in FIG. 14 after performing the first initial control. In the second initial control, the controller 2 permits the cam 150 to start rotating in its normal rotating direction, and controls the cam 150 to stop rotating at a timing when the cam 150 rotates to the angular position at which the light emitted from the light emitting element of the separation sensor 4C and 4K passes through the first slit 154A.

Further, the controller 2 permits the cam 150 to stop rotating at a timing when the cam 150 rotates to the angular position at which the light emitted from the light emitting element of the separation sensor 4C and 4K passes through the second slit 154B so as to maintain the developing roller 61 in contact position where the developing roller 61 is in contact with a corresponding one of the photosensitive drums 50 during image forming operation on the sheet S. To this effect, the controller 2 performs following processing illustrated in FIGS. 13 and 14.

Figure 13:
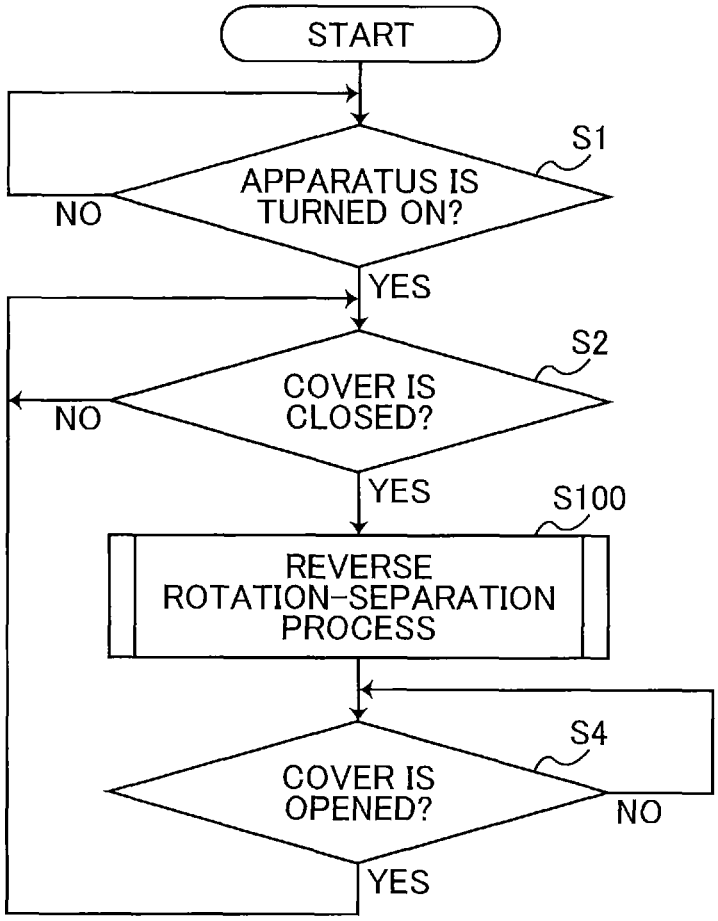

As illustrated in FIG. 13, in S1, the controller 2 determines whether the image forming apparatus 1 is turned on (S1). If the image forming apparatus 1 is turned on (S1: YES), the controller 2 advances to S2. On the other hand, when the image forming apparatus 1 is not turned on (S1: NO), the controller 2 waits for the image forming apparatus 1 being turned on.

After the image forming apparatus 1 is turned ON (S1: YES), in S2, the controller 2 determines whether the cover 11 is closed according to a signal transmitted from the unillustrated cover sensor. If the cover 11 is still opened (S2: NO), the controller 2 waits for the cover 11 being closed. If the cover is closed (S2: YES), in S100, the controller 2 permits the cam 150 to rotate in its reverse rotating direction to execute a reverse rotation-separation process for separating each of the developing roller 61 from a corresponding one of the photosensitive drums 50.

Then, in S4, the controller 2 determines whether the cover 11 is opened according to the signal transmitted from the cover sensor. If the cover 11 is closed (S4: NO), the controller 2 waits for the cover 2 being opened. If the cover 11 is opened (S4: YES), the controller 2 returns to S2 to wait for the cover 11 being closed.

As illustrated in FIG. 14, in the reverse rotation-separation process (S100), the controller 2 performs an initializing movement process where the cams 150, and the levers 160 and the cam followers 170 those cooperating with the cams 150 are returned to their initial positions after the cover 11 is closed.

First, in S101, the controller 2 permits the motor 3 to rotate in the reverse rotating direction, and in S102, the controller 2 then places the YMC clutch 140A into an ON state. Hence, each of the cams 150 (cams 150Y, 150M, and 150C) rotates in its reverse rotating direction (i.e., counterclockwise direction in FIGS. 19A through 24B).

Then, in S111, the controller 2 determines whether the separation sensor 4C is turned OFF (S111). If the separation sensor 4C is not turned OFF (S111: NO), the controller 2 waits for the separation sensor 4C being turned OFF. If the separation sensor 4C is turned OFF (S111; YES), in S120, the controller 2 determines whether the separation sensor 4C is turned ON. If the separation sensor 4C is not turned ON (S120: NO), the controller 2 waits for the separation sensor 4C being turned ON. If the separation sensor 4C is turned ON (S120; YES), in S121, the controller 2 starts counting a count 1 (S121). The count 1 is a value corresponding to a size of the slit that is initially detected by the separation sensor 4C after starting reverse rotation of the cam 150.

Then, in S122 the controller 2 determines whether the separation sensor 4C is turned OFF. If the separation sensor 4C is not turned OFF (S122: NO), the controller 2 waits for the separation sensor 4C being turned OFF. If the separation sensor 4C is turned OFF (S122; YES), the controller 2 terminates counting of the count 1.

Then, in S130, the controller 2 determines whether the separation sensor 4C is turned ON. If the separation sensor 4C is not turned ON (S130: NO), the controller 2 waits for the separation sensor 4C being turned ON. After the separation sensor 4C is turned ON (S130; YES), in S131, the controller 2 starts counting a count 2. The count 2 is a value corresponding to a size of the slit that is secondly detected by the separation sensor 4C after starting reverse rotation of the cam 150.

Then, in S132, the controller 2 determines whether the separation sensor 4C is turned OFF. If the separation sensor 4C is not turned OFF (S132: NO), the controller 2 waits for the separation sensor 4C being turned OFF. If the separation sensor 4C is turned OFF (S132; Yes), in S 134, the controller 2 terminates counting of the count 2.

Then, in S140, the controller 2 determines whether the count 2 is greater than a predetermined threshold value. The predetermined threshold value is a time period longer than a time period for which the first slit 154A moves past the separation sensor 4C and shorter than a time period for which the second slit 154B moves past the separation sensor 4C.

If the controller 2 determines that the count 2 is greater than the predetermined threshold value (S140: YES), the controller 2 waits for the separation sensor 4C being turned ON (S141), and then waits for the separation sensor 4C being turned OFF (S142). This is because "the count 2 is greater than the predetermined threshold value" implies that the second slit 154B is just moved past the separation sensor 4C.

After the separation sensor 4C is turned OFF (S142: YES) or if the count 2 is smaller than the predetermined threshold value (S140: NO), in S150, the controller 2 determines whether a predetermined time period T1 is elapsed. The predetermined time period T1 is a time period for rotating the cam 150 by a predetermined angle from a timing at which the first slit 154A is moved past the separation sensor 4C.

As a result of determination that the predetermined time period T1 is elapsed (S150: YES), the controller 2 places the YMC clutch 140A into its OFF state (S151), and stores a state of the cam 150 as a state "D" (S152). Rotation of the cam 150 is stopped upon turning OFF the YMC clutch 140A.

Figure 15:
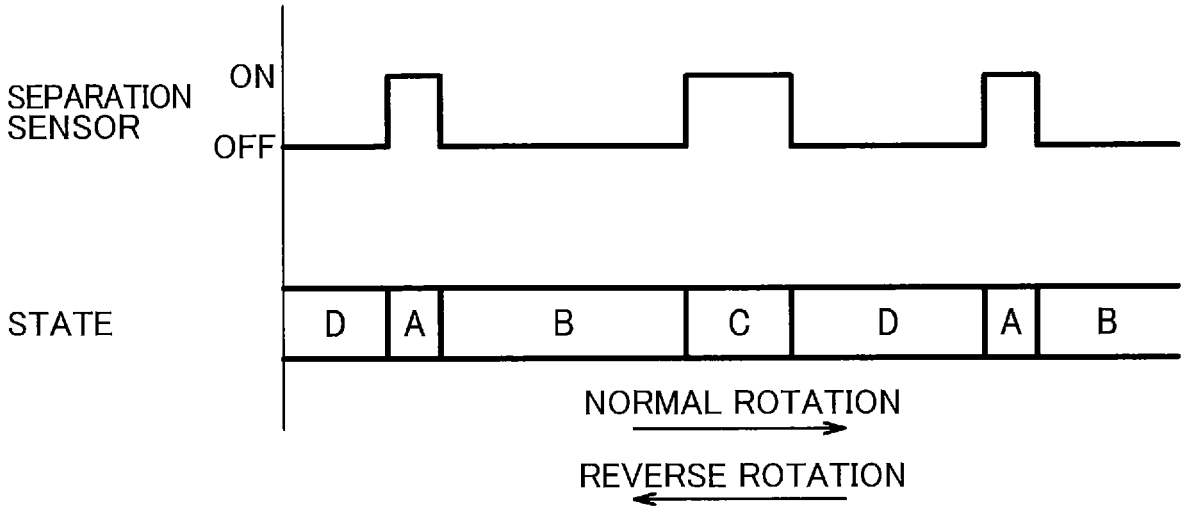
FIG. 15 is a view for description of a relationship between a signal output from a separation sensor and a state of the developing roller in the image forming apparatus according to the embodiment.

Here, the state of the cam 150 will be described. As illustrated in FIG. 15, in accordance with the normal rotation or reverse rotation of the cam 150, the separation sensor 4C and 4K outputs to the controller 2 ON signal of a short duration in according to detection of the first slit 154A and outputs ON signal of long duration according to detection of the second slit 154B.

Hereinafter, the detection mechanism by which the separation sensor 4C detects the first slit 154A or the second slit 154B will be described, because the detection mechanism by which the separation sensor 4K detects the first slit 154A or the second slit 154B is the same as the detection mechanism of separation sensor 4C. The controller 2 determines the ON signal as a signal according to the detection of the second slit 154B when the duration of the ON signal is greater or longer than the predetermined threshold value, and determines the ON signal as a signal according to the detection of the first slit 154A when the duration of the ON signal is smaller or shorter than the predetermined threshold value. Further, in a case where the first slit 154A is aligned with the separation sensor 4C, a state "A" is stored, and in a case where the second slit 154B is aligned with the separation sensor 4C a state "C" is stored.

Hence, in case of the normal rotation of the cam 150, each time ON signal and OFF signal output from the separation sensor 4C are alternately switched from each other, the state of the cam 150 stored in the controller 2 is changed in the order of the states A→B→C→D→A→ . . . , and hence, the state of the cam 150 can be recognized. In case of the reverse rotation of the cam 150, the order of the states is reversed. That is, each time ON signal and OFF signal output from the separation sensor 4C are alternately switched from each other, the state of the cam 150 stored in the controller 2 is changed in the order of the states A→D→C→B→A→ . . . . In the above-described step 152, the state "D" is set, since the OFF signal is output after receipt of ON signal of short duration in the reverse rotation of the cam 150.

Turning back to FIG. 14, after the step S152, in S153 the controller 2 permits the motor 3 to stop rotating. Then, in S160, the controller 2 permits the motor 3 to start rotating in the normal rotating direction, and in S161 places the YMC clutch 140A into its ON state. Then, in S162, the controller 2 waits for the separation sensor 4C being turned its ON state.

In response to turning ON the separation sensor 4C (S162: YES), in S163, the controller 2 determines whether a predetermined time period T2 is elapsed from the turning ON timing of the separation sensor 4C. Upon elapsing the predetermined time period T2 from the turning ON timing of the separation sensor 4C (S163: YES), in S164, the controller 2 stores the state "A" as the state of the cam 150, and places the YMC clutch 140 into OFF state (S170) and permits the motor 3 to stop rotating (S171).

The predetermined time period T2 starts from the turning ON timing of the separation sensor 4C to a timing at which the light emitted from the light emitting element of the separation sensor 4C passes through a widthwise center of the first slit 154A after stopping rotation of the cam 150. The predetermined time period T2 is shorter than the predetermined time period T1.

Incidentally, the above-description pertains to the processing for returning each of the cams for the color of yellow, magenta and cyan to its initial position. However, with respect to the cam 150K for the color of black, similar processing is performed for returning the cam 150K to its initial position through the K clutch 140K instead of the YMC clutch 140A. Hence, further description as to the cam 150K will be omitted.

Next, an operation of each component in the image forming apparatus 1 performing the above-described process will be described with reference to a timing chart illustrated in FIGS. 16 and 17 and diagrams illustrated in FIGS. 19A through 24B.

When the cover 11 is at the closed position and the image forming apparatus 1 performs a normal operation, the following two situations are likely to occur. The first situation is that the contact portion 172 of each of the cam followers 170 is positioned on the first holding surface F1 of the corresponding first cam portion 152 as illustrated in FIGS. 19A and 19B (each the developing roller 61 is at the contact positions). The second situation is that the contact portion 172 of each of the cam followers 170 is positioned on the second holding surface F2 of the corresponding first cam portion 152 as illustrated in FIGS. 20A and 20B (each developing roller 61 is at the separated position).

In any of the situations, in a case where the cam 150 rotates in the normal rotating direction (clockwise direction in FIGS. 19A through 20B) in accordance with the rotation of the motor 3 in the normal rotating direction, the contact portion 172 is urged upward by the frictional force generating between the contact portion 172 and the first cam portion 152, so that the cam follower 170 is urged in the counterclockwise direction. Hence, the posture of the cam follower 170 is fixed by the abutment of the arm 173 on the release engagement portion 182A.

Figure 20A:
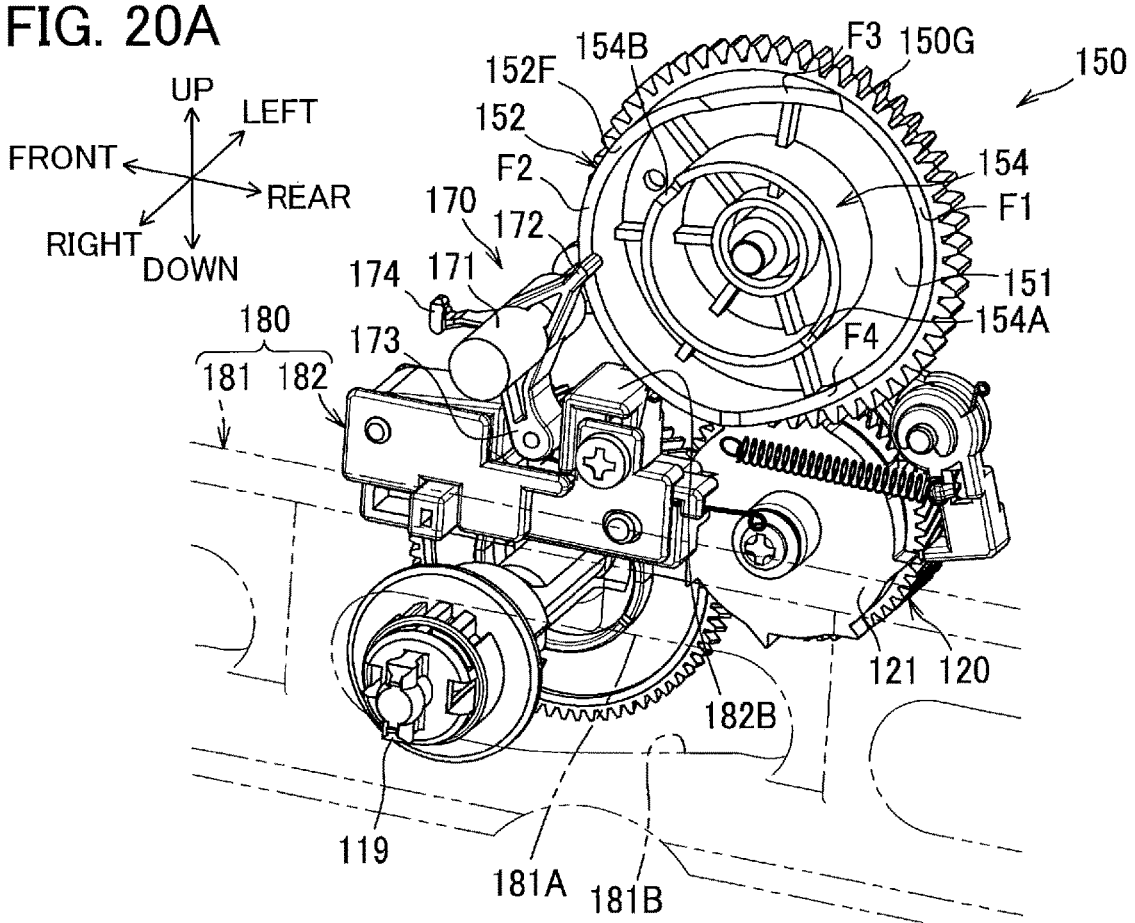
FIG. 20A is a perspective view illustrating the cam, the cam follower and the release member in a state where the cam rotates in the normal rotating direction and the developing roller is at a separated position in the image forming apparatus according to the embodiment.
Figure 20B:
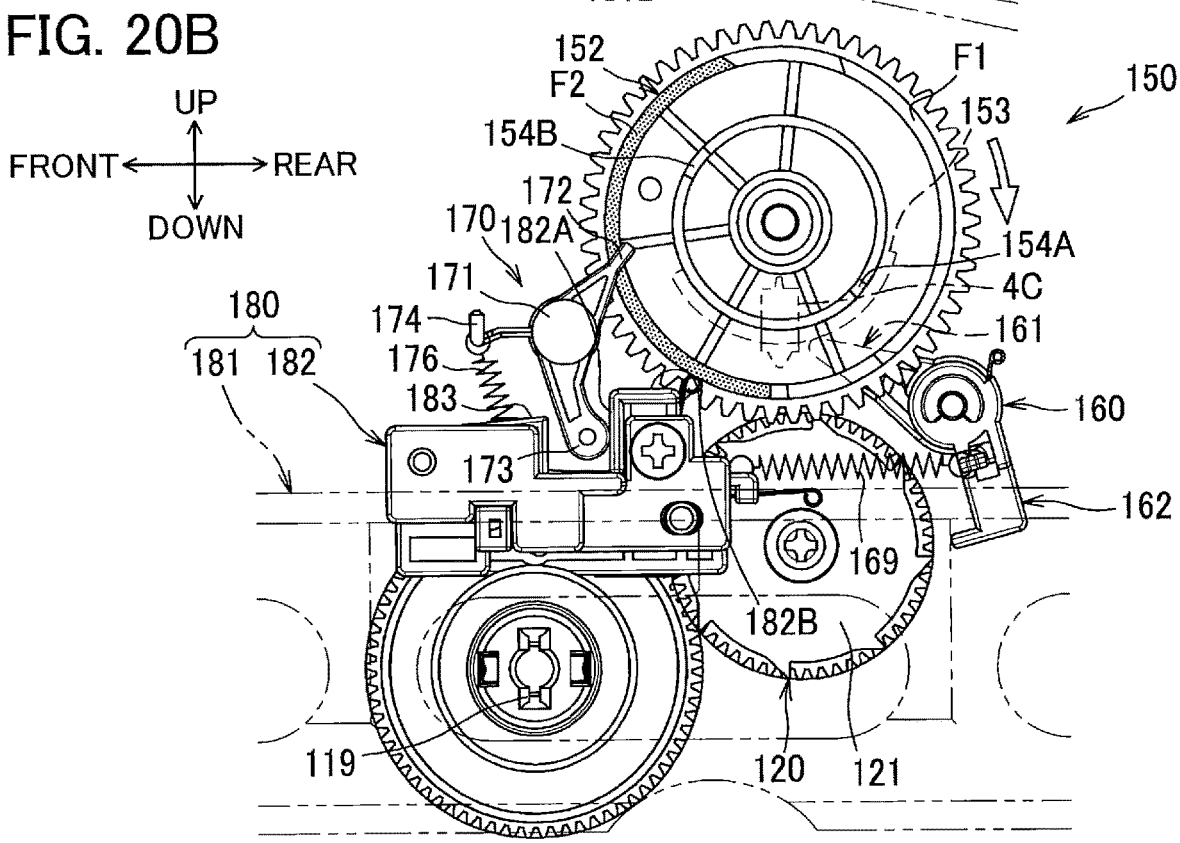
FIG. 20B is a side view illustrating the cam, the cam follower and the release member in the state where the cam rotates in the normal rotating direction and the developing roller is at the separated position in the image forming apparatus.
Figure 21A:
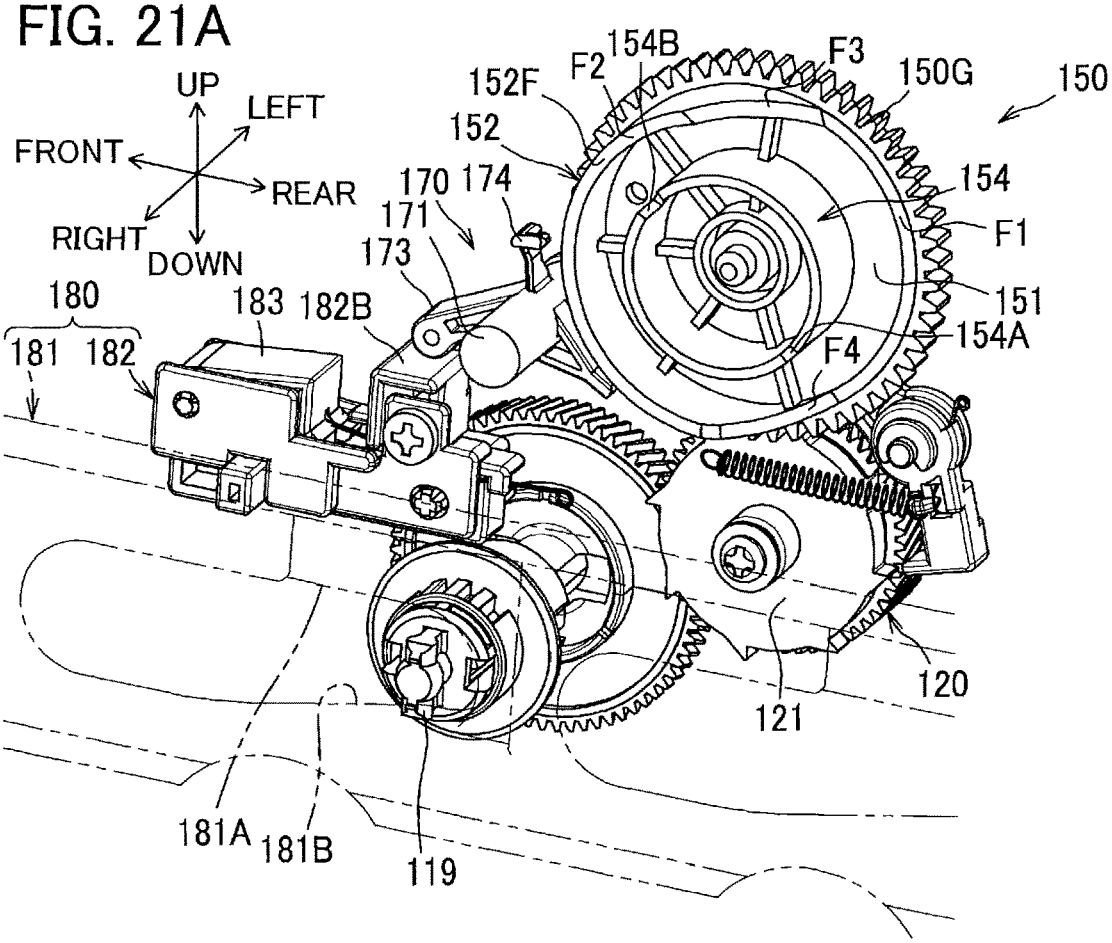
FIG. 21A is a perspective view illustrating the cam, the cam follower and the release member in a state where the cover is at the open position in the image forming apparatus according to the embodiment.
Figure 21B:
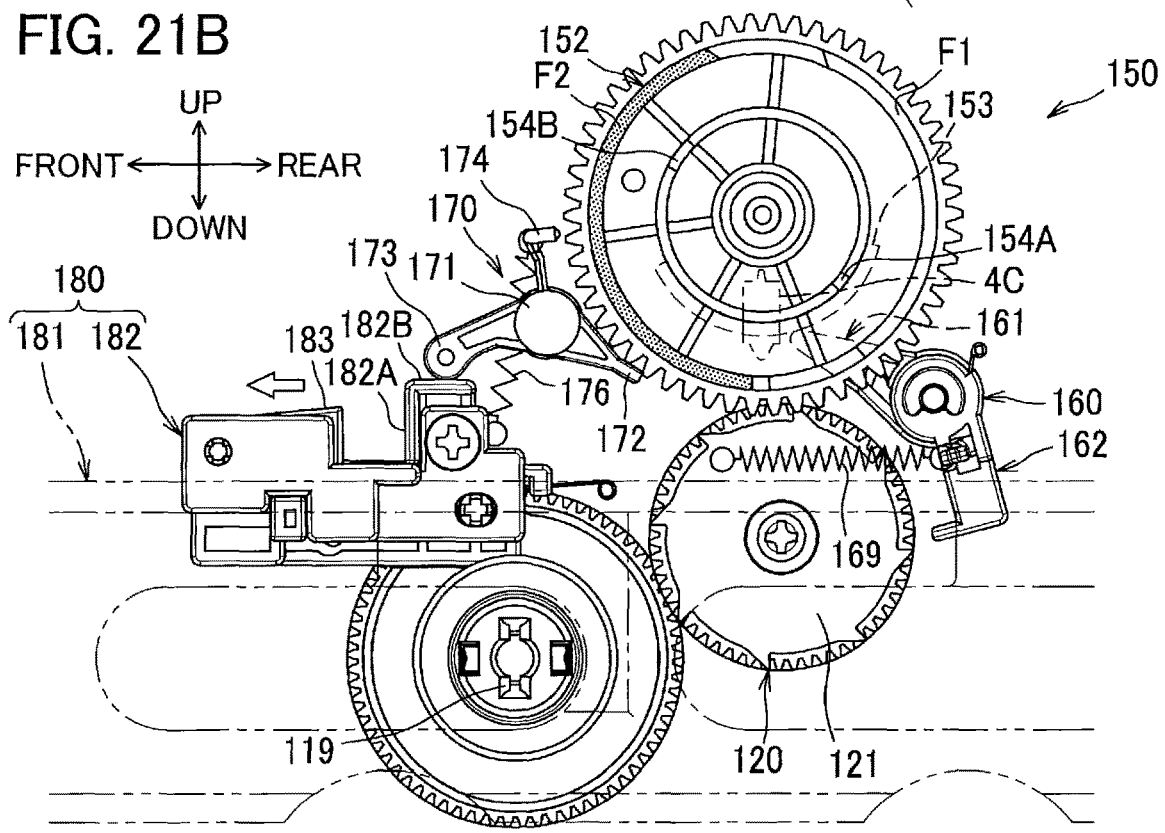
FIG. 21B is a side view illustrating the cam, the cam follower and the release member as viewed in the axial direction in the state where the cover is at the open position in the image forming apparatus according to the embodiment.

As illustrated in FIGS. 21A and 21B, the release member 180 is pulled by the cover 11 to linearly move frontward in accordance with the movement of the cover 11 from the closed position to the open position in a state where the contact portion 172 is positioned on the second holding surface F2 as illustrated in FIGS. 20A and 20B and the developing roller 61 is at the separated position. Hence, the coupling shaft 119 is pushed by the coupling retraction cam 181B of the release member 180 in the axial direction (leftward) to be disengaged from the coupling 65.

Further, in accordance with the frontward linear movement of the release member 180, the release engagement portion 182A urges the arm 173 of the cam follower 170 frontward to pivotally move the cam follower 170 from the operating position to the non-operating position. Further, the arm 173 is seated on the cam follower holding portion 182B, whereupon a posture of the cam follower 170 is maintained. Therefore, the cam follower 170 can maintain its non-operating position regardless of the angular rotational position of the cam 150 as long as the cam follower holding portion 182B holds the posture of the cam follower 170 in the open state of the cover 11.

By the pivotal movement of the cam follower 170 from the operating position to the non-operating position, the cam follower 170 moves from the protruding position to the standby position upon separation of the contact portion 172 from the first cam portion 152 since the first spring 176 urges the cam follower 170 toward the standby position. Hence, the developing roller 61 moves from the separated position to the contact position. When the cam follower 170 is at the standby position, the slide shaft portion 171 is positioned outside of the second opening 91A. Therefore, mechanical interference between the slide shaft portion 171 and the side frame 91L of the drawer 90 does not occur while the drawer 90 is pulled out of the housing 10 or is inserted into the housing 10 through the first opening 10A.

Figure 16:
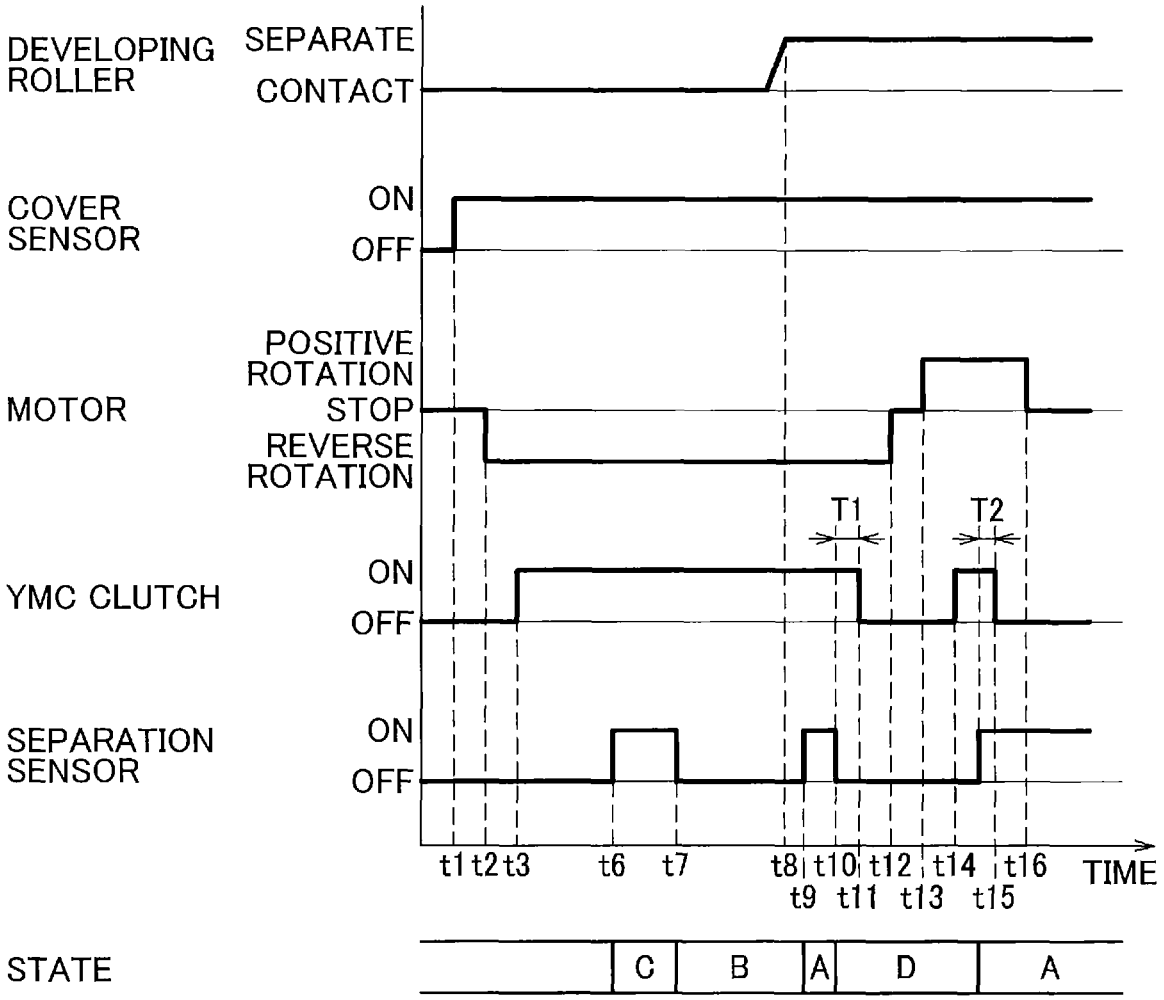
FIG. 16 is a timing chart illustrating operation of each component when the image forming apparatus is turned on, and particularly illustrating an occasion where the separation sensor initially detects a second slit in the image forming apparatus according to the embodiment.
Figure 17:
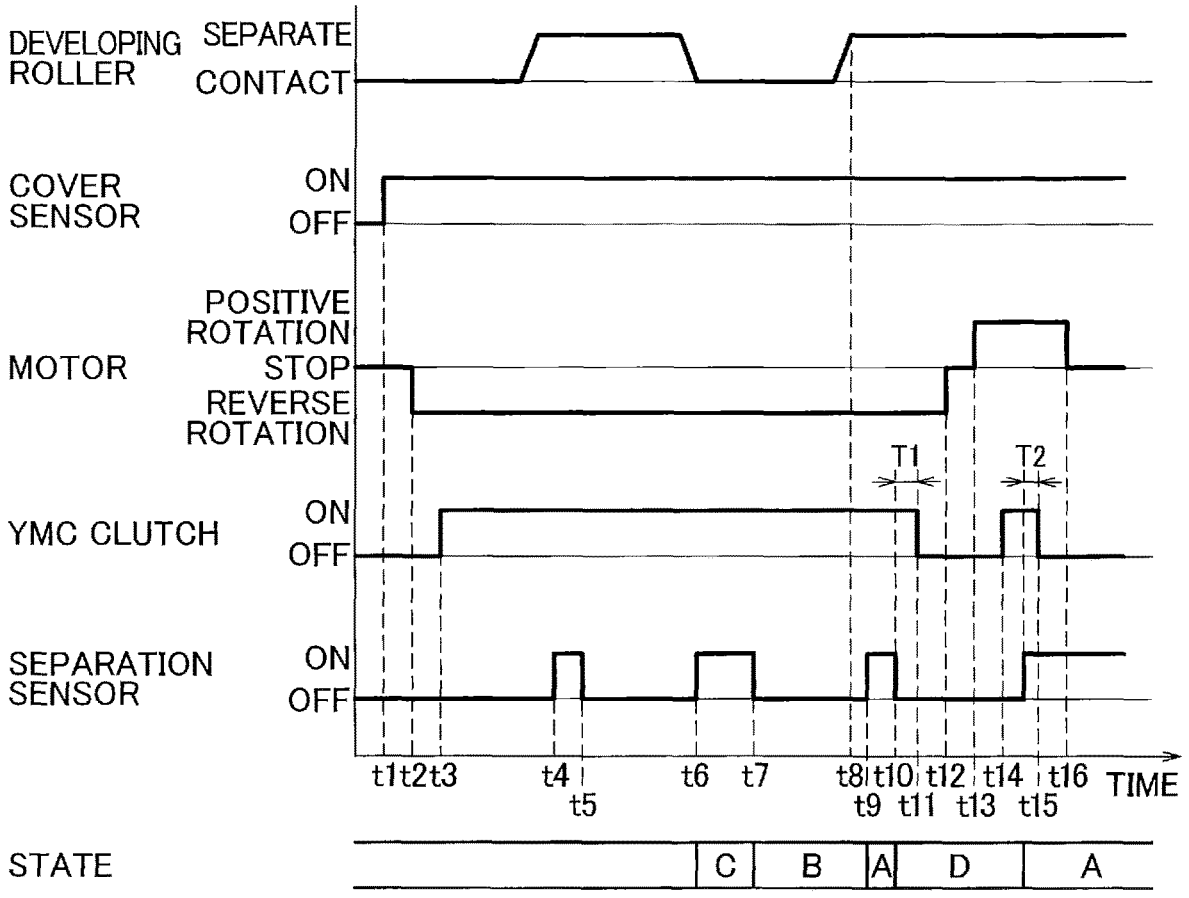
FIG. 17 is a timing chart illustrating operation of each component when the image forming apparatus is turned on, and particularly illustrating an occasion where the separation sensor initially detects a first slit in the image forming apparatus according to the embodiment.
Figure 22A:
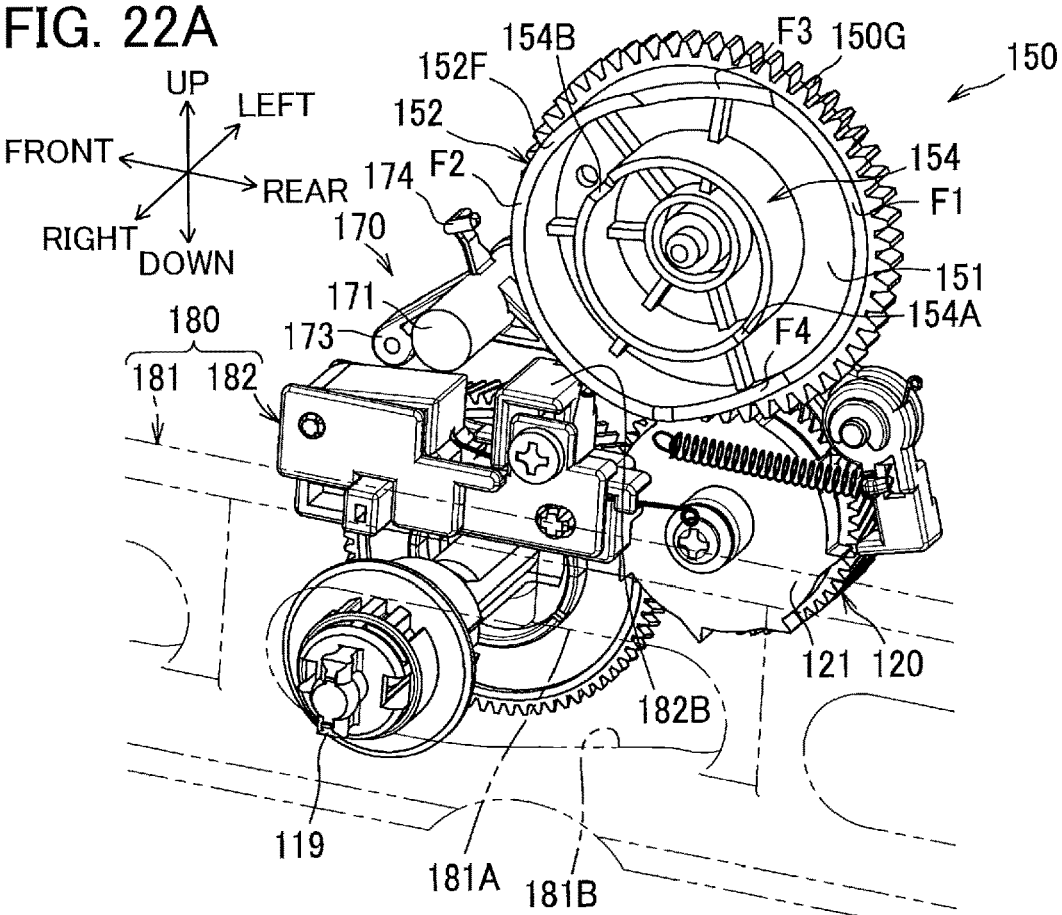
FIG. 22A is a perspective view illustrating the cam, the cam follower and the release member in a state where the cover is moved from the open position to the closed position from the state illustrated in FIG. 21 in the image forming apparatus according to the embodiment.
Figure 22B:
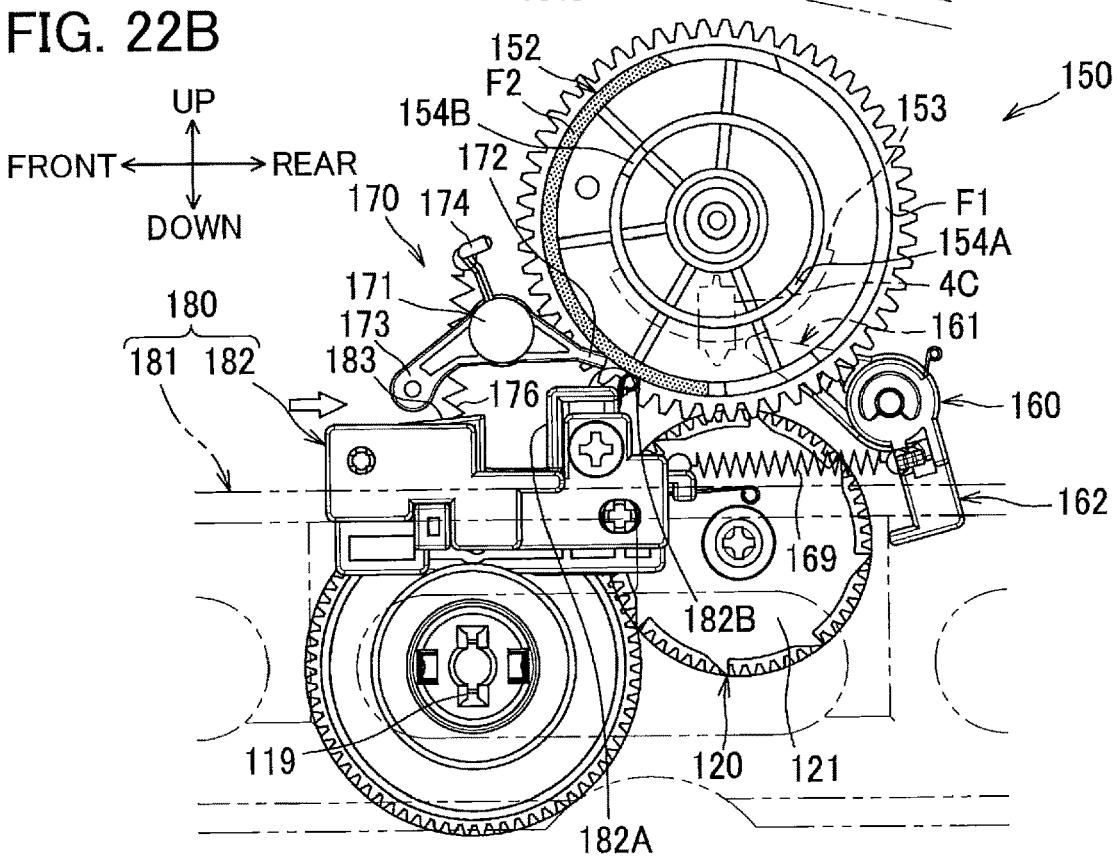
FIG. 22B is a side view illustrating the cam, the cam follower and the release member as viewed in the axial direction in the state where the cover is moved from the open position to the closed position from the state illustrated in FIG. 21 in the image forming apparatus according to the embodiment.

Then, when the cover 11 moves from the open position to the closed position, the cover sensor (not illustrated) is turned on at the timing t1 in FIG. 16), and the release member 180 is linearly moved rearward as illustrated in FIGS. 22A and 22B. Hence, the coupling shaft 119 moves in a protruding direction (rightward) to engage the coupling 65. Further, by the linear rearward movement of the release member 180, the arm 173 of the cam follower 170 is displaced from and disengaged from the upper surface of the cam follower holding portion 182B. However, the cam follower 170 is still maintained at the non-operating position since the contact portion 172 is in contact with the outer peripheral surface of the first cam portion 152. At this time, the lower end of the arm 173 is positioned above the upper surface of the stopper 183. Thus, the stopper 183 can pass below the arm 173 to move rearward without mechanical interference with the arm 173.

Incidentally, when the cover 11 is moves from the closed position to the open position and then moves back to the closed position in a state where the developing roller 61 is at its contact position and the contact portion 172 is positioned on the second holding surface F1 while the cover 11 is at the closed position, the cam follower 170 is pivotally moved by the urging force of the first spring 176 so that the contact portion 172 can be moved to the position contactable with the first cam 152 (see FIGS. 19A and 19B). That is, the cam follower 170 is pivotally moved from the non-operating position to the operating position when the cover 11 moves from the open position to the closed position.

After the cover 11 is positioned at the closed position, the controller 2 permits the motor 3 to rotate in the reverse rotating direction at the timing t2, and places the YMC clutch 140A into its turn ON state at the timing t3. Hence, the cam 150 rotates in the reverse rotating direction.

Figure 23A:
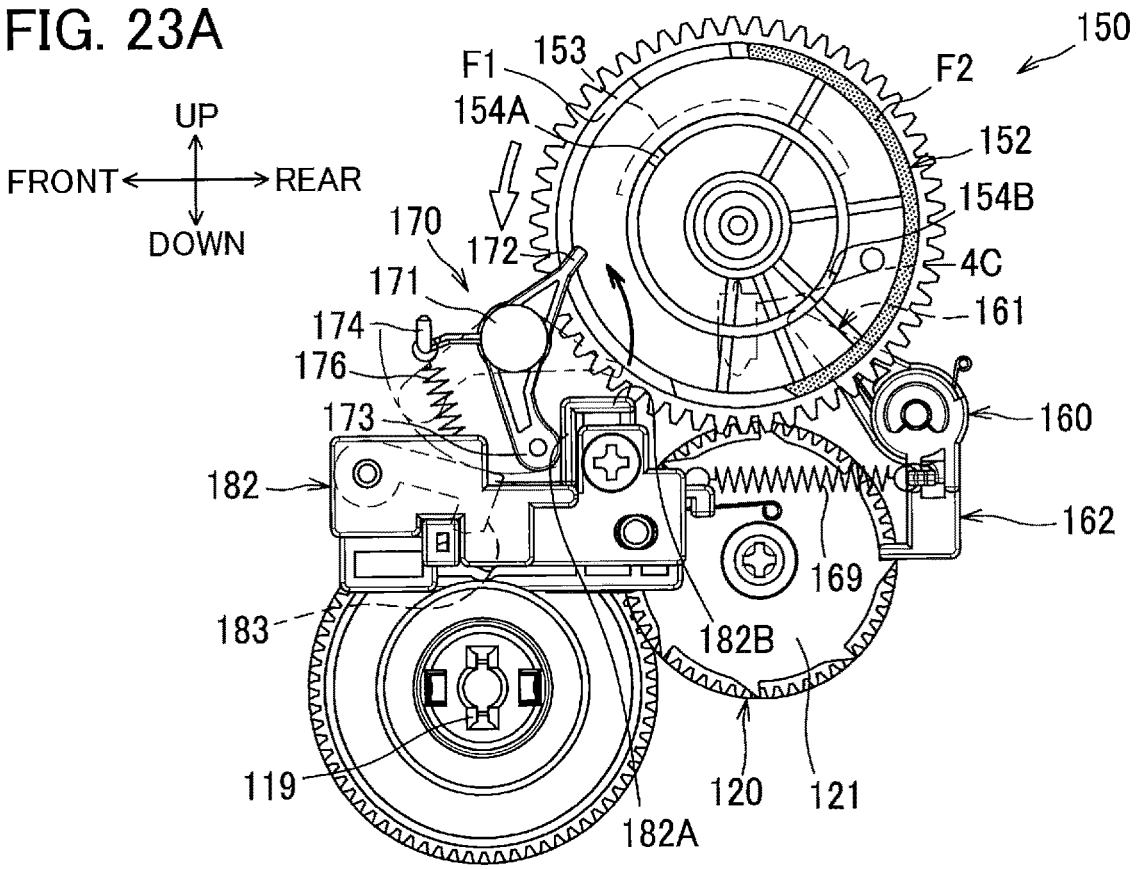
FIG. 23A is a side view illustrating the cam, the cam follower and the release member as viewed in the axial direction in a state where the cam rotates from the state illustrated in FIG. 22 in a reverse rotating direction and the cam follower moves from a non-operating position to an operating position in the image forming apparatus according to the embodiment.

When the cam 150 rotates in the reverse rotating direction as illustrated in FIG. 23A from the state where the contact portion 172 is in abutment with the outer peripheral surface of the first cam portion 152 as illustrated in FIGS. 22A and 22B, the cam follower 170 is pivotally moved in the counterclockwise direction from the non-operating position to the operating position by the urging force of the first spring 176 upon separation of the contact portion 172 from the outer peripheral surface of the first cam portion 152. In this case, the stopper 183 is once pivotally moved downward by the pressing force from the arm 173 of the cam follower 170.

Further, in accordance with the reversal rotation of the cam 150 from its angular position illustrated in FIG. 22A to its angular position illustrated in FIG. 23A, the second slit 154B is detected by the separation sensor 4C, so that the separation sensor 4C outputs ON signal of long duration. (t6 through t7).

Figure 23B:
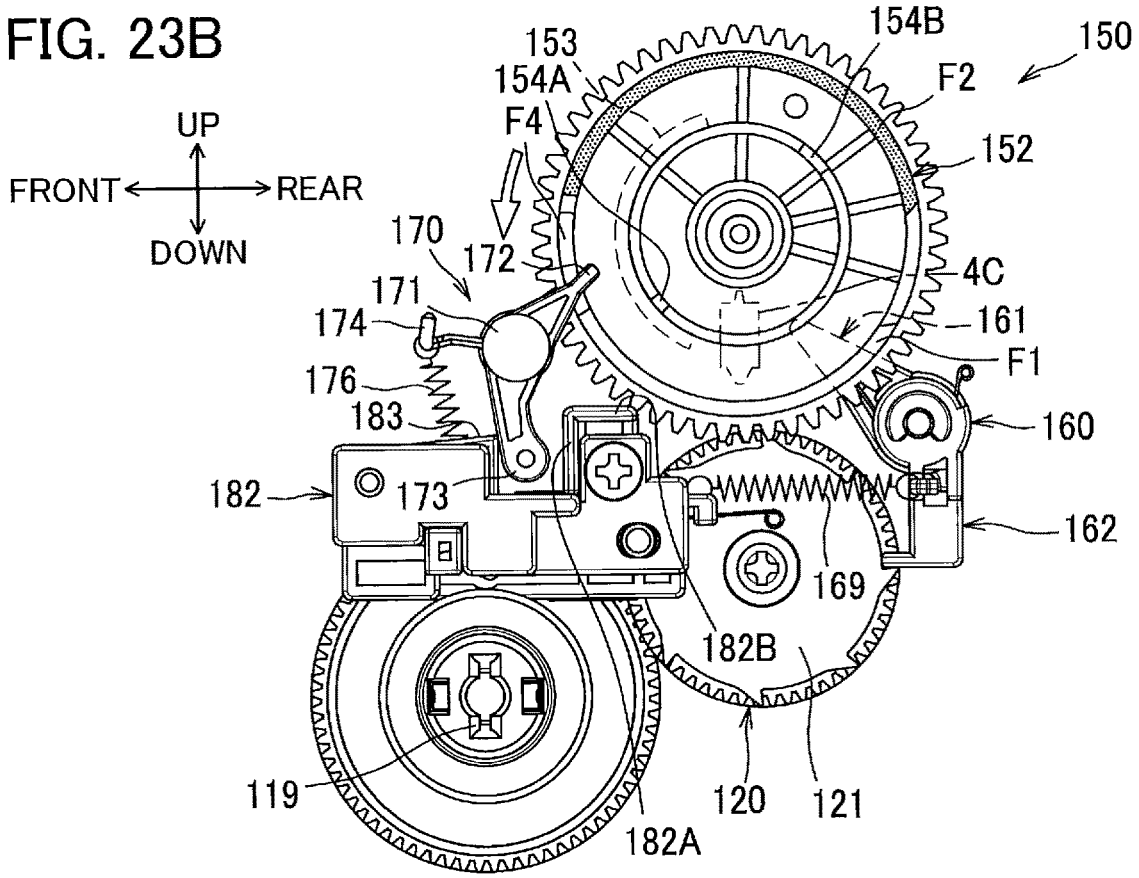
FIG. 23B is a side view illustrating the cam, the cam follower and the release member as viewed in the axial direction in a state where the cam further rotates from the state illustrated in FIG. 23A in the reverse rotating direction and the stopper prevents the cam follower from pivotally moving in the image forming apparatus according to the embodiment.

Then, as illustrated in FIG. 23B, upon abutment of the first cam portion 172 with the second guide surface F4 of the first cam portion 152 by the further rotation of the cam 150 in the reverse rotating direction, the contact portion 172 is urged downward by the frictional force between the second guide surface F4 and the contact portion 172, and hence, the cam follower 170 pivotally moves slightly in the clockwise direction. Then the posture of the cam follower 170 is fixed by the abutment of the arm 173 with the stopper 183. Thereafter, the cam follower 170 is moved, without its pivotal movement, to the protruding position by the pressing force from the second guide surface F4.

Then, upon further rotation in the reverse rotating direction of the cam 150 from the state illustrated in FIG. 23B, the contact portion 172 is positioned on the second holding surface F2 as illustrated in FIG. 24A, and hence, the slide shaft portion 171 is positioned at the protruding position. Thus, the developing roller 61 is positioned at the separated position (t8). Then, upon the first slit 154 moving past the separation sensor 4C, the signal outputted from the separation sensor 4C is changed to the ON signal at the timing t9, and then is changed to the OFF signal at the timing t10.

Then, the first lever 161 of the lever 160 comes into contact with the second cam portion 153. At this time, the second lever 162 cannot be moved, since the second lever 162 is engaged with the sun gear 121. Instead, the first lever 161 is pivotally moved to the pivotally moved position against the urging force of the second spring 163.

Further, the controller 2 places the YMC clutch 140A into its OFF state (t11) upon elapse of the predetermined time period T1 from a timing at which the separation sensor 4C generates OFF signal (t10), and then, permits the motor 3 to stop rotating (t12). At this time, the controller 2 stores the state "D" as the state of the cam 150. Incidentally, in FIGS. 16 and 17, the states A through C prior to the time t12 are also indicated as reference.

Then, the controller 2 permits the motor 3 to rotate in the normal rotating direction (t13), and places the YMC clutch 140A into its ON state (t14) to start rotating the cam 150 in the normal rotating direction. Then, after the cam 150 is rotated in the normal rotating direction by a predetermined angle, the controller 2 places the YMC clutch 140A into OFF state (t15) upon elapse of the predetermined time period T2 from the timing at which the separation sensor 4C generates ON signal in response to the arrival of the first slit 154A at the separation sensor 4C. Then, the controller 2 permits the motor 3 to stop rotating (t16).

Figure 24B:
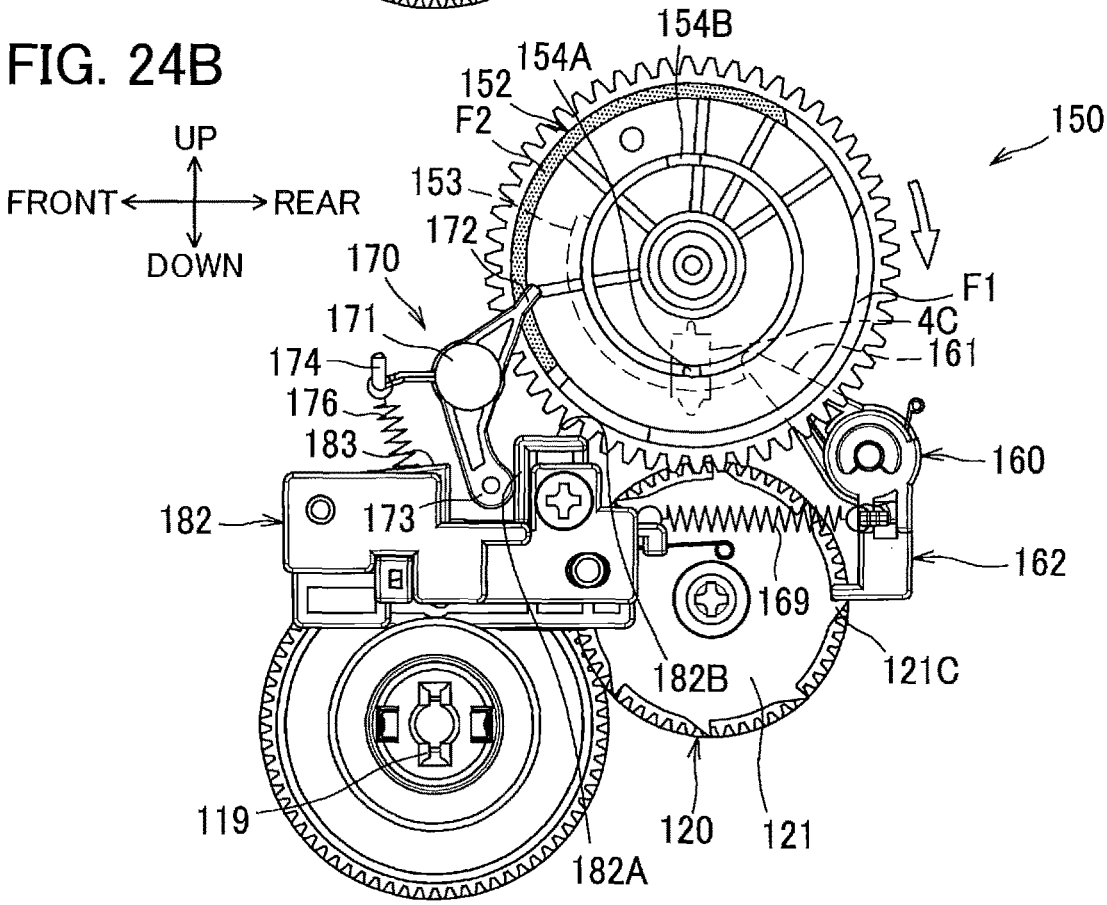
FIG. 24B is a side view illustrating the cam, the cam follower and the release member, and particularly illustrating a state where the cam is positioned at an initial position by the normal rotation of the cam from the state illustrated in FIG. 24A.

Hence, as illustrated in FIG. 24B, the contact portion 172 is positioned on the second holding surface F2 positioning the slide shaft portion 171 at the protruding position, so that the developing roller 61 is at the separated position. Further, the second lever 162 is in engagement with the pawl portion 121C of the sun gear 121, and the tip end portion of the first lever 161 is positioned rightward away from the second cam portion 153. Thus, an initializing operation at the turning ON timing of the power source with the closed state of the cover 11 is completed, and the cam 150 is positioned at the initial position.

The above-description as to the initializing operation with reference to FIG. 16 pertains to the second slit 154B firstly moving past the separation sensor 4C after the cover 11 is closed and the cam 150 starts rotating in the reverse rotating direction. However, as illustrated in FIG. 17, in a case where the first slit 154A firstly passes through the separation sensor 4C (t40 to t5) after the cam 150 starts rotating in the reverse rotating direction, the controller 2 permits the cam 150 to stop rotating (t11) upon elapsing the predetermined time period T1 from the timing at which the first slit 154A passes through the separation sensor 4C (t9 to t10) after the second slit 154B passes through the separation sensor (t6 to t7). Then, the controller 2 permits the cam 150 to rotate in the normal rotating direction (t14), and permits the YMC clutch 140A to turn OFF (t15) upon elapsing the predetermined time period T2 from the timing at which the separation sensor 4C generates ON signal. In this way, the cam 150 can be stopped at the initial position in the procedure the same as that of FIG. 16.

Figure 25:
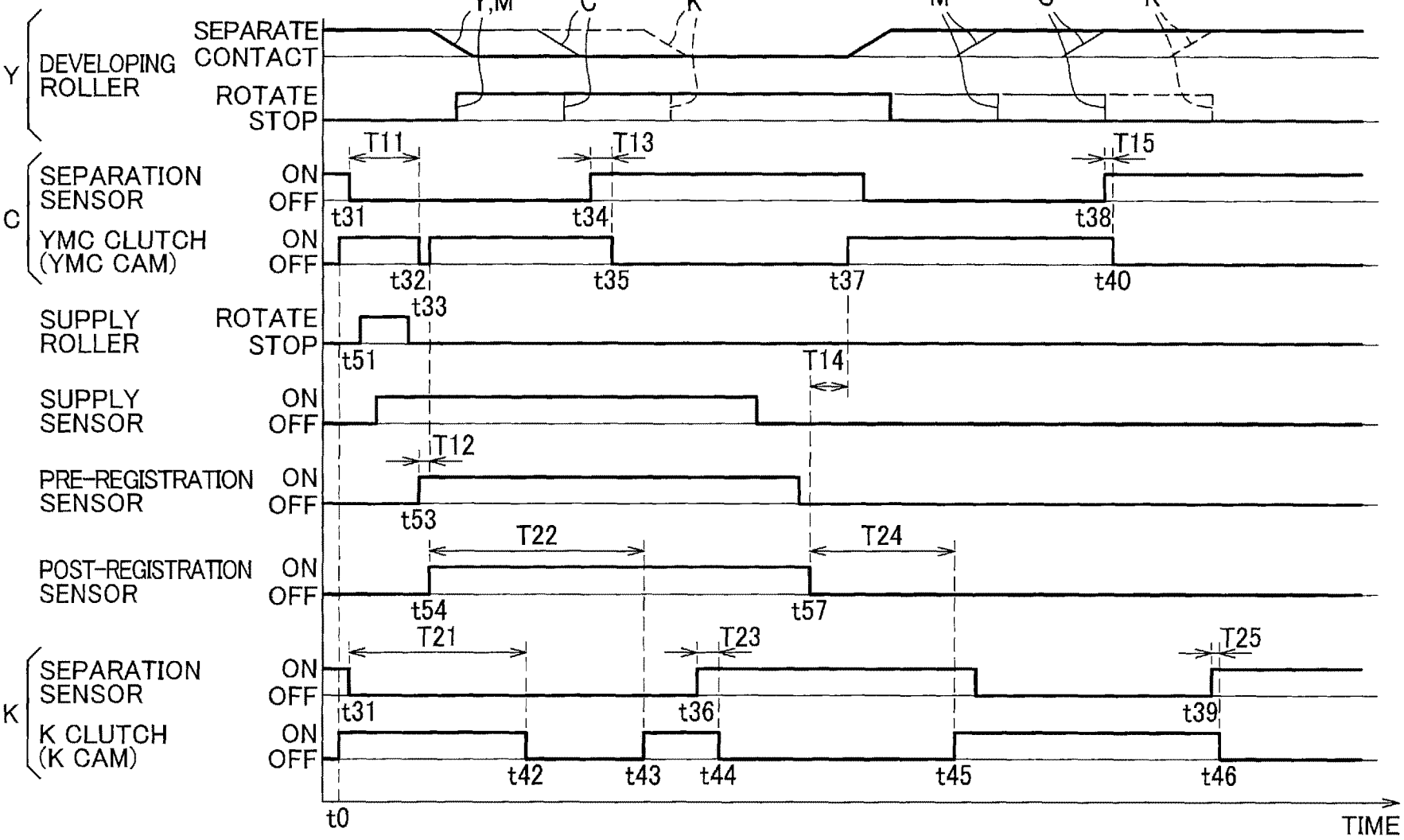
FIG. 25 is a timing chart for description of operational relationship among various components in the image forming apparatus according to the embodiment.

Next, control routine performed by the controller 2 and operation of components for image forming operation will be described with reference to a timing chart illustrated in FIG. 25, in which, in a first line, operation timing of the first developing roller 61Y for the color of yellow is indicated by a bold line, and operation timing of the second and third developing rollers 61M, 61C for the colors of magenta and cyan and operation timing of the fourth developing roller 61K for the colors of black are indicated by a normal line, and a broken line, respectively, those being partly overlapped with the bold line.

In case of processing color printing, all developing rollers 61 are at the separated positions prior to image forming operation, since initializing operation is completed. The controller 2 places the YMC clutch 140A into its ON and places the K clutch 140K into its ON state (t0) in order to successively move the developing rollers 61 to the contact position. As a result, the cams 150Y, 150M, 150C and 150K start rotating in the normal rotating direction, and immediately thereafter, the separation sensors 4C and 4K are turned OFF (t31). In case of the image forming operation, the terms "rotate in the normal rotating direction" will be simply referred to as "rotate". Then, the controller 2 permits the sheet feed roller 23 to rotate for a predetermined time period (t51) to pick-up the sheet S for starting sheet conveying operation.

Then, the controller 2 places the YMC clutch 140A into its OFF state (t32) to temporarily stop rotation of the cams 150Y, 150M, 150C upon elapsing a time period T11 from a timing at which the separation sensor 4C outputs OFF signal. The time period T11 is set so that the temporary stop timing of the cams is coincident with a timing at which the contact portion 172 of the cam follower 170 for the color of yellow is positioned on a region of the second holding surface F2, the region being closest to the second guide surface F4.

Then, the controller 2 places the YMC clutch 140A into its ON state (t33) to restart rotating the cams 150Y, 150M, 150C upon elapsing a time period T12 from a timing at which the pre-registration sensor 28B outputs ON signal (t53), i.e., at which the leading edge of the sheet S moves past the pre-registration sensor 28B. The time period T12 is set so that development of toner image on the first photosensitive drum 50Y by the first developing roller 61Y can be ready in time for the transfer of the toner image to the conveyed sheet S.

Further, the controller 2 places the K clutch 140K into its OFF state (t42) to temporarily stop rotation of the cam 150K upon elapsing a time period T21 from a timing at which the separation sensor 4K outputs OFF signal. The time period T21 is set so that the temporary stop timing of the cam 140K is coincident with a timing at which the contact portion 172 of the cam follower 170 for the color of black is positioned on a region of the second holding surface F2, the region being closest to the second guide surface F4.

Further, the controller 2 places the K clutch 140K into its ON state (t43) to start rotating the cam 150K upon elapsing a time period T22 from a timing at which the post-registration sensor 28C outputs ON signal (t54), i.e., at which the leading edge of the sheet S moves past the post-registration sensor 28C. The time period T22 is set so that development of toner image on the fourth photosensitive drum 50K by the fourth developing roller 61K can be ready in time for the transfer of the toner image to the conveyed sheet S.

Then, the controller 2 places the YMC clutch 140A into its OFF state (t35) to stop rotation of the cams 150Y, 150M, 150C upon elapsing a time period T13 from a timing at which the separation sensor 4C outputs ON signal (t34). The time period T13 is set so that the first through third developing rollers 61Y, 61M, 61C can be positioned at the contact positions, and the cams 150Y, 150M, 150C can be stopped at a timing at which the light emitted from the light emitting element of the separation sensor 4C passes through a widthwise center of the second slit 154B in the circumferential direction.

Then, the controller 2 places the K clutch 140K into its OFF state (t44) to stop rotation of the cam 150K upon elapsing a time period T23 from a timing at which the separation sensor 4K outputs ON signal (t36). The time period T23 is set so that the fourth developing roller 61K can be positioned at the contact position, and the cam 150K can be stopped at a timing at which the light emitted from the light emitting element of the separation sensor 4K passes through a widthwise center of the second slit 154B in the circumferential direction.

Then, the controller 2 places the YMC clutch 140A into its ON state (t37) to rotate the cams 150Y, 150M, 150C upon elapsing a time period T14 from a timing at which the post-registration sensor 28C outputs OFF signal (T57), that is at which the trailing end of the sheet S moves past the post-registration sensor 28C, so that the first through third developing rollers 61Y, 61M, 61C are successively separated from the corresponding photosensitive drums. The time period T14 is set so that the first developing roller 61Y can be moved to the separated position in time immediately after completion of image transfer from the photosensitive drum 50Y to the sheet S after completion of development of toner image on the photosensitive drum 50Y by the developing roller 61Y.

Then, the controller 2 places the K clutch 140K into its ON state (t45) to rotate the cam 150K upon elapsing a time period T24 from a timing at which the post-registration sensor 28C outputs OFF signal (T57). The time period T24 is set so that the fourth developing roller 61K can be moved to the separated position in time immediately after completion of image transfer from the photosensitive drum 50K to the sheet S after completion of development of toner image on the photosensitive drum 50K by the developing roller 61K.

Then, the controller 2 places the YMC clutch 140A into its OFF state (t40) to stop rotation of the cams 150Y, 150M, 150C upon elapsing a time period T15 from a timing at which the separation sensor 4C outputs ON signal (t38). The time period T15 is set so that rotation of the cams 150Y, 150M, 150C can be stopped at a timing at which the light emitted from the light emitting element of the separation sensor 4C passes through a widthwise center of the first slit 154A in the circumferential direction.

Then, the controller 2 places the K clutch 140K into its OFF state (t46) to stop rotation of the cam 150K upon elapsing a time period T25 from a timing at which the separation sensor 4K outputs ON signal (t39). The time period T25 is set so that rotation of the cam 150K can be stopped at a timing at which the light emitted from the light emitting element of the separation sensor 4K passes through the widthwise center of the first slit 154A in the circumferential direction.

With such an image forming operation, the rotation of the cam 150 is stopped, during developing operation, at its angular position such that the light emitted from the light emitting element of the separation sensor 4C and 4K passes through the widthwise center of the second slit 154B in the circumferential direction. Hence, stabilized contact position of each developing roller 61 can be provided.

According to the above-described embodiment, in accordance with movement of the cover 11 from the closed position to the open position, the release engagement portion 182A contacts the arm 173 of the cam follower 170 to pivotally move the cam follower 170 to the non-operating position. Since the contact portion 172 is not guided by the first cam portion 152 when the cam follower 170 is at the non-operating position, the cam follower 170 is maintained at the standby position regardless of the rotation of the cam 150. Hence, mechanical interference between the cam follower 170 and the side frame 81L of the drawer 90 can be prevented when the cover 11 is opened, since the cam follower 170 is at the standby position.

Regarding the cam 150, the first cam portion 152 for moving the developing roller 61 protrudes from the first surface 151A which is one end face of the disc portion 151, and the phase detection wall 154 also protrudes from the first surface 151A. Therefore, the provision of the first cam portion 152 and the phase detection wall 154 does not cause the increase in dimension of the cam 150 in its axial direction. That is, the cam 150 capable of providing the detection of the contact state and separated state of the developing roller 61 relative to the photosensitive drum 50 can be compact, which leads to reduction in size of the resultant image forming apparatus 1.

In particular, a compact cam 150 can be provided, since the phase detection wall 154 is positioned in the inner space defined by the inner peripheral surface 152S of the first cam portion 152.

Further, the controller 2 performs initializing operation by permitting the cam 150 to reversely rotating, and is configured to permit the cam 150 to stop rotating after detection of the first slit 154A based on the time at which the light emitted from the light emitting element passes through the first slit 154A or the second slit 154B. Therefore, initializing operation can be performed within a short period, and the cam 150 can be stopped at an accurate angular position.

Further, since the controller 2 permits the cam 150 to stop rotating when the light emitted from the light emitting element passes through the first slit 154A, the initializing operation can be completed with high certainty of the separated position of the developing roller 61.

Further, since the controller 2 permits the cam 150 to stop rotating when the light emitted from the light emitting element passes through the second slit 154B in the image forming operation on the sheet S, the image forming operation can be performed with higher certainty of contact state of the developing roller 61 with the photosensitive drum 50 in comparison with a case where the rotation of the cam 150 is stopped at its angular position such that the light emitted from the light emitting element does not pass through the second slit 154B.

Further, according to the above-described embodiment, the single first spring 176 urges the cam follower 170 from the protruding position toward the standby position, and urges the cam follower 170 from the non-operating position toward the operating position. Therefore, numbers of components can be reduced.

Further, according to the above-described embodiment, the stopper 183 is pivotally moved by the arm 173 to allow the cam follower 170 to pivotally move from the non-operating position toward the operating position, even if the cam follower 170 is positioned at the non-operating position when the cover 11 is moved from the open position to the closed position. Hence, the cam follower 170 can be returned to the operating position.

Further, according to the above-described embodiment, the lever is provided by the combination of the first lever 161 and the second lever 162, and the first lever 161 is pivotally movable relative to the second lever 162. Therefore, excessive force application to the lever 160 can be avoided when the motor 3 is reversely rotated.

Various modifications are conceivable. For example, in the above-described embodiment, the size in the circumferential direction of the second slit 154B is greater than that of the first slit 154A. However, the size in the circumferential direction of the second slit 154B may be smaller than that of the first slit 154A.

Further, in the above-described embodiment, the phase detection wall 154 has two slits 154A, 154B whose size in the circumferential direction is different from each other. However, not less than three slits whose size in the circumferential direction is different from one another may be formed in the phase detection wall 154.

Further, in the above-described embodiment, the controller 2 stores the state of the cam 150 after the step S151 in FIG. 14. However, the storage of the state of the cam 150 may be performed immediately after the determination as to whether the count 2 is greater than the threshold level in the step S140.

Further, each of the second openings formed in the side frame is in the form of the recess or notch whose upper end is open. However, each second opening may be a through-hole extending throughout the thickness of the side frame.

Further, according to the above-described embodiment, the image forming apparatus 1 is a color printer using toners of the four colors. However, the image forming apparatus of the disclosure may be a color printer employing employ toners of three colors or five colors for forming color images. As a further modification, the image forming apparatus may be a monochromatic printer employing a toner of a single color. Still alternatively, a multifunction peripheral and a copying machine are also available as the image forming apparatus of the disclosure.

While the description has been made in detail with reference to specific embodiment and modifications, it would be apparent to those skilled in the art that various changes and modifications may be made therein without departing from the spirit and scope of the disclosure.

What is claimed is:

1. An image forming apparatus comprising:

a photosensitive drum;

a developing roller movable between a contact position where the developing roller is in contact with the photosensitive drum and a separated position where the developing roller is separated from the photosensitive drum;

a photo-interrupter comprising a light emitting element and a light receiving element; and a separation mechanism comprising a cam configured to move the developing roller between the contact position and the separated position, the cam being rotatable about a rotation axis extending in an axial direction, the cam comprising a phase detection wall extending in a circumferential direction around the rotation axis, the phase detection wall having a first slit and a second slit positioned away from the first slit in the circumferential direction, the first slit allowing the light emitted from the light emitting element to pass therethrough when the developing roller is at the separated position, the second slit allowing a light emitted from the light emitting element to pass therethrough when the developing roller is at the contact position, a size of the first slit in the circumferential direction being different from that of the second slit.

2. The image forming apparatus according to claim 1, wherein the cam comprises a disc having a first surface and a second surface opposite to the first surface in the axial direction of the cam, and wherein the phase detection wall protrudes from the first surface of the disc in the axial direction.

3. The image forming apparatus according to claim 1, wherein the cam comprises a first cam extends in the circumferential direction, and wherein the phase detection wall is positioned radially inward of an inner peripheral surface of the first cam.

4. The image forming apparatus according to claim 1, wherein the second slit has a size in the circumferential direction greater than that of the first slit.

5. The image forming apparatus according to claim 1, further comprising a controller configured to stop rotating the cam at an angular position thereof at timing where the light emitted from the light emitting element passes through the second slit in a state where the developing roller is maintained at the contact position in an image forming operation on a sheet.

6. The image forming apparatus according to claim 1, further comprising:

a housing having a first opening;

a cover movable between a closed position closing the first opening and an open position opening the first opening; and a cartridge comprising the developing roller, wherein the cartridge is attachable to and detachable from the housing through the first opening.

7. The image forming apparatus according to claim 6, further comprising a drawer movable between an inner position and an outer position through the first opening, wherein the cartridge is attachable to and detachable from the drawer.

8. The image forming apparatus according to claim 7, wherein the drawer is attachable to and detachable from the housing through the first opening.

9. The image forming apparatus according to claim 7, wherein the drawer comprises the photosensitive drum.

10. The image forming apparatus according to claim 1, wherein the cam comprises a first cam extending in the circumferential direction, wherein the separation mechanism further comprises:

a support shaft; and a cam follower supported by the support shaft, the cam follower being slidably movable along the support shaft between a protruding position and a standby position, and rotatable about the support shaft between an operating position and a non-operating position, and wherein:

in a state where the cam follower is at the protruding position, the developing roller is at the separated position;

in a state where the cam follower is at the standby position, the developing roller is at the contact position;

in a state where the cam follower is at the operating position, the cam follower is guided by the first cam in accordance with rotation of the cam to allow the cam follower to slidably move between the protruding position and the standby position; and in a state where the cam follower is at the non-operating position, the cam follower is left at the standby position independently from the rotation of the cam.

11. The image forming apparatus according to claim 10, wherein the separation mechanism further comprises a release member movable in accordance with movement of the cover between the open position and the closed position, the release member being configured to rotate the cam follower from the operating position to the non-operating position in accordance with the movement of the cover from the closed position to the open position.

12. The image forming apparatus according to claim 11, wherein the cam follower comprises:

a contact portion contactable with the first cam; and an arm extending in a radial direction of the support shaft.

13. The image forming apparatus according to claim 12, wherein the release member comprises a release engagement portion contactable with the arm, the release member being configured to pivotally move the cam follower from the operating position to the non-operating position by the release engagement portion pressing the arm in accordance with the movement of the cover between the open position and the closed position.

14. The image forming apparatus according to claim 12, wherein, in a state where the cam follower is at the operating position, the contact portion is guided by the first cam in accordance with rotation of the cam to allow the cam follower to reciprocally move between the protruding position and the standby position.

15. The image forming apparatus according to claim 10, wherein the drawer is attachable to and detachable from the housing through the first opening, the drawer comprising:

the photosensitive drum; and a side frame supporting the photosensitive drum and having a second opening, wherein:

in a state where the cam follower is at the protruding position, the cam follower is positioned in the second opening to press the cartridge to position the developing roller at the separated position; and in a state where the cam follower is at the standby position, the cam follower is positioned out of the second opening to separate from the cartridge to position the developing roller at the contact position.

16. The image forming apparatus according to claim 10, further comprising:

a controller configured to stop rotating the cam at an angular position thereof at timing where the light emitted from the light emitting element passes through the second slit in a state where the developing roller is maintained at the contact position in an image forming operation on a sheet; and a motor rotatable in a normal rotating direction and a reverse rotating direction, rotation of the motor being controlled by the controller, wherein the separation mechanism further comprises:

a power transmission gear train configured to transmit a driving force of the motor to the developing roller;

a transmission control gear train configured to transmit the driving force of the motor to the cam, and to rotate the cam in a normal rotating direction in response to normal rotation of the motor and to rotate the cam in a reverse rotating direction in response to reverse rotation of the motor; and a clutch configured to switch a power transmission status between an engaging state in which the clutch engages transmission of driving force from the motor to the developing roller and a disengaging state in which the clutch disengages the transmission of the driving force from the motor to the developing roller.

17. The image forming apparatus according to claim 16, wherein the cam further comprises a second cam rotatable along with the first cam, wherein the separation mechanism further comprises a lever movable by being guided by the second cam, wherein, in a case where the cam rotates in the normal rotating direction, the lever is configured to switch the power transmission status of the clutch between the engaging state and the disengaging state, and wherein, in a case where the cam rotates in the reverse rotating direction, the lever is configured to maintain the power transmission status of the clutch in the disengaging state.

18. The image forming apparatus according to claim 17, wherein the separation mechanism further comprises a spring configured to urge the cam follower from the protruding position toward the standby position and from the non-operating position toward the operating position.

19. The image forming apparatus according to claim 18, wherein the separation mechanism further comprises a release member movable in accordance with movement of the cover between the open position and the closed position, the release member being configured to rotate the cam follower from the operating position to the non-operating position in accordance with the movement of the cover from the closed position to the open position, wherein the cam follower comprises an arm extending in a radial direction of the support shaft, and wherein in a case where the cam rotates in the normal rotating direction to allow the first cam to guide the contact portion in a state where the cover is at the closed position, the release member is in contact with the arm to prevent the cam follower from pivotally moving between the operating position and the non-operating position.

20. The image forming apparatus according to claim 19, further comprising a stopper linearly movable in accordance with linear movement of the release member and pivotally movable relative to the release member, wherein in a case where the cover moves from the open position to the closed position while the cam follower is at the operating position, the stopper moves in accordance with the movement of the release member to position the arm between the release member and the stopper, and comes into contact with the arm to prevent the cam follower from pivotally moving to the non-operating position in case of rotation of the motor in a reverse rotating direction opposite to the normal rotating direction, and wherein in a case where the cover moves from the open position to the closed position while the cam follower is at the non-operating position, the cam follower pivotally moves toward the operating position by urging force of the spring, and the arm presses the stopper to pivotally move to allow the cam follower to further pivotally move to the operating position by the urging force of the spring.

21. The image forming apparatus according to claim 20, wherein the clutch comprises a planetary gear mechanism, wherein the lever is pivotally movable between a transmission position at which the lever is engaged with one component of the planetary gear mechanism to place the clutch into the engaging state and a non-transmission position at which the lever is disengaged from the one component of the planetary gear mechanism to place the clutch into the disengaging state.

22. An image forming apparatus comprising:

a photosensitive drum;

a developing roller movable between a contact position where the developing roller is in contact with the photosensitive drum and a separated position where the developing roller is separated from the photosensitive drum;

a clutch configured to control rotation of the developing roller;

a separation mechanism configured to move the developing roller between the contact position and the separated position, the separation mechanism comprising a cam rotatable about a rotation axis extending in an axial direction, the cam comprising:

a gear having an outer peripheral surface provided with gear teeth, a first surface and a second surface opposite to the first surface in an axial direction of the gear;

an end cam disposed at the first surface of the gear in the axial direction of the gear, the end cam being configured to move the developing roller between the contact position and the separate position;

a phase detection wall disposed at the first surface of the gear and having a hollow cylindrical shape, the phase detection wall having a first slit and a second slit, the first slit and the second slit having a size in the circumferential direction different from each other; and a plate cam disposed at the second surface of the gear, the plate cam being configured to operate the clutch; and a detector configured to detect the first slit and the second slit, wherein, when the end cam positions the developing roller at the separated position, the detector detects the first slit, and wherein, when the end cam positions the developing roller at the contact position, the detector detects the second slit.

* * * * *